US005403703A

United States Patent [19]

Mihayashi et al.

[11] Patent Number: 5,403,703

[45] Date of Patent: * Apr. 4, 1995

[54] SILVER HALIDE COLOR PHOTOGRAPHIC LIGHT-SENSITIVE MATERIAL, AND METHOD OR PROCESSING THE SAME

[75] Inventors: Keiji Mihayashi; Atsuhiro Ohkawa, both of Minami-Ashigara, Japan

[73] Assignee: Fuji Photo Film Co., Ltd., Kanagawa, Japan

[ * ] Notice: The portion of the term of this patent subsequent to Jul. 5, 2011 has been disclaimed.

[21] Appl. No.: 929,030

[22] Filed: Aug. 13, 1992

[30] Foreign Application Priority Data

Aug. 19, 1991 [JP] Japan ..... 3-230784
Jan. 10, 1992 [JP] Japan ..... 4-20790

[51] Int. Cl.[6] ..... G03C 7/38; G03C 7/30

[52] U.S. Cl. ..... 430/387; 430/386; 430/382; 430/226; 430/544; 430/549; 430/558; 430/957

[58] Field of Search ..... 430/544, 957, 549, 558 R, 430/382, 226, 386, 387

[56] References Cited

U.S. PATENT DOCUMENTS 4,698,297 10/1987 Ichijima et al. ..... 430/544
4,861,701 8/1989 Burns et al. ..... 430/544
4,959,299 9/1990 Sakanoue et al. ..... 430/544
5,135,839 8/1992 Szajewski ..... 430/544
5,286,620 2/1994 Ohkawa et al. ..... 430/544
5,326,688 7/1994 Ohkawa et al. ..... 430/544

FOREIGN PATENT DOCUMENTS 0310125 4/1989 European Pat. Off. .
0410450 1/1991 European Pat. Off. .
0438129 7/1991 European Pat. Off. .
60-218645 11/1985 Japan .
60-262158 12/1985 Japan .
63-74058 4/1988 Japan .
1251032 10/1989 Japan .

*Primary Examiner*—Richard L. Schilling
*Attorney, Agent, or Firm*—Sughrue, Mion, Zinn, Macpeak & Seas

[57] ABSTRACT

A silver halide color photographic light-sensitive material has at least one light-sensitive silver halide emulsion layer on a support, contains a pyrazoloazole-based coupler, and further contains a compound represented by Formula (I) and/or Formula (II) below:

Formula (I) $A—(L_1)_j—(L_2)_m—[(L_3)_n—PUG]_s$

Formula (II) $A—L_4—L_5—PUG$ where A represents a coupler moiety or an oxidation-reduction group, each of $L_1$ and $L_3$ represents a divalent timing group, $L_2$ represents a timing group with a valency of 3 or more and does not use electron transfer via a conjugated system, $L_4$ represents a coupling group such as —OCO—, $L_5$ represents a group for releasing PUG by electron transfer along a conjugated system or $L_4$, PUG represents a photographically useful group, each of j and n independently represents 0, 1, or 2, m represents 1 or 2, and s represents a number obtained by subtracting 1 from a valence number of $L_2$ and an integer of 2 or more. This silver halide color photographic light-sensitive material is excellent in sharpness, color reproducibility, and desilvering properties.

12 Claims, No Drawings

SILVER HALIDE COLOR PHOTOGRAPHIC LIGHT-SENSITIVE MATERIAL, AND METHOD OR PROCESSING THE SAME

BACKGROUND OF THE INVENTION

1. Field of the Invention

The present invention relates to a silver halide color photographic light-sensitive material and a method of processing this light-sensitive material. In particular, this invention relates to a silver halide color photographic light-sensitive material which contains novel timing DIR couplers and pyrazoloazole-based couplers, has high sensitivity, is excellent in color reproducibility, sharpness, graininess, and desilvering properties, and varies little in photographic properties during storage, and also to a method of processing this light-sensitive material.

2. Description of the Related Art

Silver halide color photographic light-sensitive materials, especially color light-sensitive materials for photographing purposes are required to have high sensitivity and good graininess, color reproducibility, and sharpness, and to vary little in photographic properties during storage.

A coupler which releases a development-inhibiting compound via two timing groups is known as a means for improving color reproducibility and sharpness. Examples of this coupler are described in, e.g., JP-A-51-146828 ("JP-A" means Unexamined Published Japanese Patent Application), JP-A-60-218645, JP-A-61-156127, JP-A-63-37346, JP-A-1-280755, JP-A-1-219747, JP-A-2-230139, EP 348139, EP 354,532, and EP 403,019. The use of these timing DIR couplers can enhance an interlayer effect or an edge effect to improve color reproducibility and sharpness to some extent. However, the release of a developing inhibitor is essentially performed through a single step, and the release timing is undesirable. Therefore, the effect of the coupler is still insufficient. In addition, light-sensitive materials using these couplers largely vary in photographic properties during storage.

On the other hand, JP-B-47-27411 ("JP-B" means Examined Published Japanese Patent Application), for example, has proposed a pyrazoloazole-based magenta coupler which does not cause much secondary absorption, is excellent in color hue of the coupler, and is therefore desirable in improving color reproducibility. However, no satisfactory color reproducibility has been obtained yet.

For the above reasons, several attempts have been made to achieve outstanding effects by combining a plurality of techniques, instead of using only the techniques described above. For example, combinations of pyrazoloazole-based magenta couplers and various development inhibitor-releasing compounds are proposed in JP-A-60-262158, JP-A-62-151850, JP-A-63-74058, JP-A-64-77056, and JP-A-1-251032. Although these combinations provide effects to a certain extent, they are still unsatisfactory in color reproducibility, sharpness, graininess, desilvering properties, and storage stability of a light-sensitive material.

In addition, combinations of so-called timing DIR couplers and bleaching accelerator-releasing compounds are proposed in, e.g., JP-A-63-216048, JP-A-2-39146, JP-A-2-44338, and JP-A-2-44339. These combinations are also still unsatisfactory though they can improve color reproducibility, desilvering properties, graininess, and sharpness to some extent.

SUMMARY OF THE INVENTION

It is a first object of the present invention to provide a light-sensitive material having high sensitivity and excellent in sharpness, color reproducibility, and graininess, and also to provide a method of processing this light-sensitive material. It is a second object of the present invention to provide a light-sensitive material which varies little in photographic properties during storage. It is a third object of the present invention to provide a light-sensitive material having good desilvering properties.

The above objects of the present invention are achieved by the following silver halide color photographic light-sensitive material.

According to the invention, there is provided a silver halide color photographic light-sensitive material having at least one light-sensitive silver halide emulsion layer on a support and containing a pyrazoloazole-based coupler, wherein the silver halide color photographic light-sensitive material contains a compound represented by Formula (I) and/or Formula (II) below.

$$A-(L_1)_j-(L_2)_m+(L_3)_n-PUG]_s \qquad \text{Formula (I)}$$

where A represents a coupler moiety or an oxidation-reduction group, each of $L_1$ and $L_3$ represents a divalent timing group, $L_2$ represents a timing group with a valency of 3 or more, and PUG represents a photographically useful group. Each of j and n independently represents 0, 1, or 2, m represents 1 or 2, and s represents a number which is obtained by subtracting one from the valence number of $L_2$ and is an integer of 2 or more. If a plurality of $L_1$'s, $L_2$'s, or $L_3$'s are present in the molecule, they may be the same or different. A plurality of PUGs may be the same or different. $L_2$ is not a timing group using electron transfer via a conjugated system.

Formula (II)

$$A-L_4-L_5-PUG$$

where A and PUG have the same meanings as in Formula (I). $L_4$ represents an —OCO— group, an —OSO— group, an —$OSO_2$— group, an —OCS— group, an —SCO— group, an —SCS—group, or a —$WCR_{11}R_{12}$— group wherein W represents an oxygen atom, a sulfur atom, or a tertiary amino group (—$NR_{13}$—), each of $R_{11}$ and $R_{12}$ independently represents a hydrogen atom or a substituent, and $R_{13}$ represents a substituent. $R_{11}$, $R_{12}$, and $R_{13}$ may represent divalent groups and combine together to form a cyclic structure. $L_5$ represents a group which releases PUG by electron transfer along a conjugated system or a group defined by $L_4$.)

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

Couplers represented by Formulas (I) and (II) will be described in more detail below.

In Formula (I), A specifically represents a coupler moiety or an oxidation-reduction group.

Examples of the coupler moiety represented by A are a yellow coupler moiety (e.g., an open-chain ketomethylene-type coupler moiety such as acylacetanilide or malondianilide), a magenta coupler moiety (e.g., a 5-pyrazolone-type, pyrazolotriazole-type, or imidazopyrazole-type coupler moiety), a cyan coupler moiety (e.g., a phenol-type coupler moiety, a naphthol-type coupler moiety, an imidazole-type coupler moiety described in EP 249,453, or a pyrazolopyrimidine-type coupler moiety described in EP 304,001), and a colorless compound forming coupler moiety (e.g., an indanone-type or acetophenone-type coupler moiety). Alternatively, a heterocyclic-type coupler moiety described in U.S. Pat. Nos. 4,315,070, 4,183,752, 4,174,969, 3,961,959, or 4,171,223, or JP-A-52-82423 may be used.

When A represents an oxidation-reduction group, this oxidation-reduction group is a group which can be oxidized by an oxidized form of a developing agent. Examples of the group are hydroquinones, catechols, pyrogallols, 1,4-naphthohydroquinones, 1,2-naphthohydroquinones, sulfonamidophenols, hydrazides, and sulfonamidonaphthols. Specific examples of these groups are described in, e.g., JP-A-61-230135, JP-A-62-251746, JP-A-61-278852, U.S. Pat. Nos. 3,364,022, 3,379,529, 3,639,417, and 4,684,604, and J. Org. Chem., 29,588 (1964).

A preferable example of A is a coupler moiety represented by Formula (Cp-1), (Cp-2), (Cp-3), (Cp-4), (Cp-5), (Cp-6), (Cp-7), (Cp-8), (Cp-9), (Cp-10), or (Cp-11) to be presented below. These couplers are preferable because of their high coupling rates.

Formula (Cp-1)

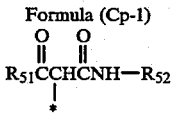

Formula (Cp-2)

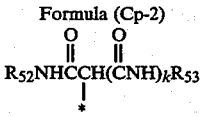

Formula (Cp-3)

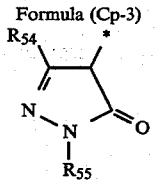

-continued

Formula (Cp-4)

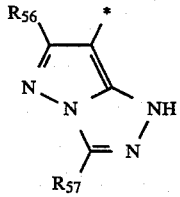

Formula (Cp-5)

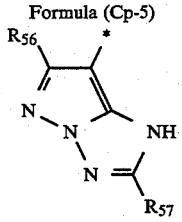

Formula (Cp-6)

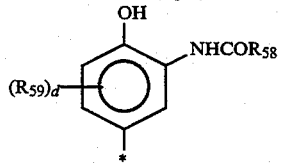

Formula (Cp-7)

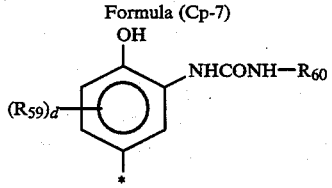

Formula (Cp-8)

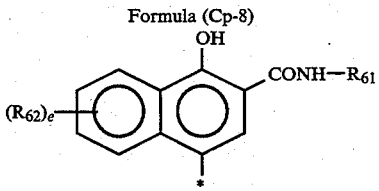

Formula (Cp-9)

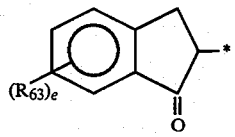

Formula (Cp-10)

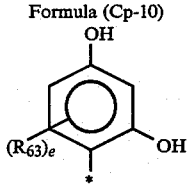

Formula (Cp-11)

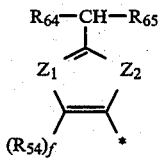

In the above formulas, a symbol * deriving from the coupling position represents the position to which $L_1$ et seq in Formula (I) or $L_4$ et seq in Formula (II) is coupled.

In the above formulas, if $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, $R_{63}$, $R_{64}$, or $R_{65}$ contains a nondiffusing group, the group is so selected as to have 8 to 40, and preferably 10 to 30 carbon atoms in total. Otherwise, the total number of carbon atoms is preferably 15 or less.

$R_{51}$ to $R_{65}$, k, d, e, and f will be described in more detail below. In the following description, $R_{41}$ represents an aliphatic group, an aromatic group, or a heterocyclic group, $R_{42}$ represents an aromatic group or a heterocyclic group, and each of $R_{43}$, $R_{44}$, and $R_{45}$ represents a hydrogen atom, an aliphatic group, an aromatic group, or a heterocyclic group.

$R_{51}$ has the same meaning as $R_{41}$. Each of $R_{52}$ and $R_{53}$ has the same meaning as $R_{42}$. k represents 0 or 1. $R_{54}$ represents a group having the same meaning as $R_{41}$, an $R_{41}CON(R_{43})$— group, an $R_{41}R_{43}N$— group, an $R_{41}SO_2N(R_{43})$— group, an $R_{41}S$— group, an $R_{43}O$— group, an $R_{45}N(R_{43})CON(R_{44})$— group, or a ≡C— group. $R_{55}$ represents a group having the same meaning as $R_{41}$. Each of $R_{56}$ and $R_{57}$ represents a group having the same meaning as $R_{43}$, an $R_{41}S$— group, an $R_{43}O$— group, an $R_{41}CON(R_{43})$— group, or an $R_{41}SO_2N(R_{43})$— group. $R_{58}$ represents a group having the same meaning as $R_{41}$. $R_{59}$ represents a group having the same meaning as $R_{41}$, an $R_{41}CON(R_{43})$— group, an $R_{41}OCON(R_{43})$— group, an $R_{41}SO_2N(R_{43})$— group, an $R_{43}R_{44}NCON(R_{45})$— group, an $R_{41}O$— group, an $R_{41}S$— group, a halogen atom, or an $R_{41}R_{43}N$— group. d represents 0, 1, 2, or 3. If a plurality of d's are present, a plurality of $R_{59}$'s represent the same substituent or different substituents. Alternatively, these $R_{59}$'s may be divalent groups and combine together to form a cyclic structure. Examples of the cyclic structure are a pyridine ring and a pyrrole ring. $R_{60}$ represents a group having the same meaning as $R_{41}$. $R_{61}$ represents a group having the same meaning as $R_{41}$. $R_{62}$ represents a group having the same meaning as $R_{41}$, an $R_{41}OCONH$— group, an $R_{41}SO_2NH$— group, an $R_{43}R_{44}NCON(R_{45})$— group, an $R_{43}R_{44}NSO_2N(R_{45})$— group, an $R_{43}O$— group, an $R_{41}S$—group, a halogen atom, or an $R_{41}R_{43}N$— group. $R_{63}$ represents a group having the same meaning as $R_{41}$, an $R_{43}CON(R_{45})$—group, an $R_{43}R_{44}NCO$— group, an $R_{41}SO_2N(R_{44})$— group, an $R_{43}R_{44}NSO_2$— group, an $R_{41}SO_2$—group, an $R_{43}O$-CO— group, an $R_{43}O$—$SO_2$— group, a halogen atom, a nitro group, a cyan group, or an $R_{43}CO$— group. e represents an integer from 0 to 4. If a plurality of $R_{62}$'s or $R_{63}$'s are present, they represent the same group or different groups. Each of $R_{64}$ and $R_{65}$ represents an $R_{43}R_{44}NCO$— group, an $R_{41}CO$— group, an $R_{43}R_{44}NSO_2$— group, an $R_{41}OCO$— group, an $R_{41}SO_2$— group, a nitro group, or a cyano group. $Z_1$ represents a nitrogen atom or a $=C(R_{66})$— group (wherein $R_{66}$ represents a hydrogen atom or a group having the same meaning as $R_{63}$). $Z_2$ represents a sulfur atom or an oxygen atom. f represents 0 or 1.

A comprises preferably a nondiffusing group or nondiffusing groups.

In the above description, the aliphatic group is a saturated or unsaturated, chained or cyclic, straight-chain or branched, and substituted or nonsubstituted aliphatic hydrocarbon group having 1 to 32, and preferably 1 to 22 carbon atoms. Representative examples of the group are methyl, ethyl, propyl, isopropyl, butyl, (t)-butyl, (i)-butyl, (t)-amyl, hexyl, cyclohexyl, 2-ethylhexyl, octyl, 1,1,3,3-tetramethylbutyl, decyl, dodecyl, hexadecyl, and octadecyl.

The aromatic group is that having 6 to 20 carbon atoms, preferably a substituted or nonsubstituted phenyl group or a substituted or nonsubstituted naphthyl group.

The heterocyclic group is preferably a 3- to 8-membered substituted or nonsubstituted heterocyclic group having 1 to 20, and preferably 1 to 7 carbon atoms and containing an atom selected from a nitrogen atom, an oxygen atom, and a sulfur atom as a hetero atom. Representative examples of the heterocyclic group are 2-pyridyl, 2-furyl, 2-imidazolyl, 1-indolyl, 2,4-dioxo-1,3-imidazolidin-5-yl, 2-benzoxazolyl, 1,2,4-triazol-3-yl, and 4-pyrazolyl.

If the aliphatic hydrocarbon group, the aromatic group, and the heterocyclic group described above have substituents, representative examples of the substituents are a halogen atom, an $R_{47}O$— group, an $R_{46}S$— group, an $R_{47}CON(R_{48})$— group, an $R_{47}N(R_{48})CO$—group, an $R_{46}OCON(R_{47})$— group, an $R_{46}SO_2N(R_{47})$— group, an $R_{47}R_{48}NSO_2$— group, an $R_{46}SO_2$— group, an $R_{47}OCO$—group, an $R_{47}R_{48}NCON(R_{49})$— group, a group having the same meaning as $R_{46}$, an $R_{46}COO$— group, an $R_{47}OSO_2$— group, a cyano group, or a nitro group. $R_{46}$ represents an aliphatic group, an aromatic group, or a heterocyclic group, and each of $R_{47}$, $R_{48}$, and $R_{49}$ represents an aliphatic group, an aromatic group, a heterocyclic group, or a hydrogen atom. In this case, these aliphatic, aromatic, and heterocyclic groups have the same meanings as defined above.

Preferable ranges of $R_{51}$ to $R_{65}$, k, d, e, and f will be described below.

$R_{51}$ is preferably an aliphatic group or an aromatic group. Each of $R_{52}$ and $R_{53}$ is preferably an aromatic group. $R_{53}$ is preferably an aromatic group or a heterocyclic group.

In Formula (Cp-3), $R_{54}$ is preferably an $R_{41}CONH$— group or an $R_{41}R_{43}N$— group. $R_{55}$ is preferably an aromatic group, and more preferably a substituted phenyl group. In Formula (Cp-4) or (Cp-5), each of $R_{56}$ and $R_{57}$ is preferably an aliphatic group, an aromatic group, an $R_{41}O$— group, or an $R_{41}S$— group. In Formula (Cp-6), $R_{58}$ is preferably an aliphatic group or an aromatic group. $R_{59}$ is preferably a chlorine atom, an aliphatic group, or an $R_{41}CONH$— group. d is preferably 1 or 2. In Formula (Cp-7), $R_{60}$ is preferably an aromatic group. $R_{59}$ is preferably an R41CONH— group. In Formula (Cp-7), d is preferably 1. In Formula (Cp-8), $R_{61}$ is preferably an aliphatic group or an aromatic group. e is preferably 0 or 1. $R_{62}$ is preferably an $R_{41}O$-

CONH— group, an $R_{41}CONH$— group, or an $R_{41}SO_2NH$—group, and the substitution position of these groups is preferably the 5-position of a naphthol ring. In Formula (Cp-9), $R_{63}$ is preferably an $R_{41}CONH$— group, an $R_{41}SO_2NH$— group, an $R_{41}R_{43}NSO_2$— group, an $R_{41}SO_2$—group, an $R_{41}R_{43}NCO$— group, a nitro group, or a cyano group, and e is preferably 1 or 2. In Formula (Cp-10), $R_{63}$ is preferably an $(R_{43})_2NCO$— group, an $R_{43}OCO$— group, or an $R_{43}CO$— group, and e is preferably 1 or 2. In Formula (Cp-11), $R_{54}$ is preferably an aliphatic group, an aromatic group, or an $R_{41}CONH$— group, and f is preferably 1.

A preferably has a nondiffusing group.

In Formula (I), preferable examples of $L_1$ are as follows.

(1) Group using cleavage reaction of hemiacetal

Examples of this group are described in U.S. Pat. No. 4,146,396, JP-A-60-249148, and JP-A-60-249149. The group is represented by the following Formula (T-1). In Formula (T-1), a symbol , represents a position to be bonded to A or $L_1$ of a compound represented by Formula (I), and a symbol ** represents a position to be bonded to $L_1$ or $L_2$ of the compound.

Formula (T-1)

$$*-(W-CR_{11}(R_{12}))t-**$$

where W represents an oxygen atom, a sulfur atom, or an $-NR_{13}$— group, each of $R_{11}$ and $R_{12}$ represents a hydrogen atom or a substituent, $R_{13}$ represents a substituent, and t represents 1 or 2. If two t's are present, two $-W-CR_{11}(R_{12})$ represent the same or different. When $R_{11}$ and $R_{12}$ represent substituents, representative examples of each of $R_{11}$, $R_{12}$, and $R_{13}$ are an $R_{15}$ group, an $R_{15}CO$— group, an $R_{15}SO_2$— group, an $R_{15}(R_{16})NCO$— group, and an $R_{15}(R_{16})NSO_2$— group, wherein $R_{15}$ represents an aliphatic group, an aromatic group, or a heterocyclic group and $R_{16}$ represents a hydrogen atom, an aliphatic group, an aromatic group, or a heterocyclic group. $R_{11}$, $R_{12}$, and $R_{13}$ may represent divalent groups and combine together to form a cyclic structure. Specific examples of a group represented by Formula (T-1) are the following groups.

$*-OCH_2-**$

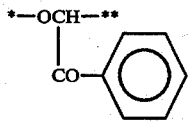

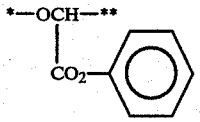

$*-SCH_2-**$

-continued

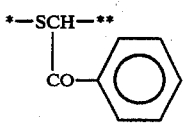

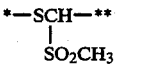

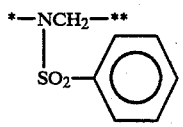

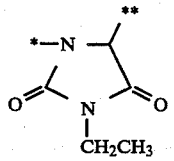

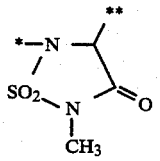

(2) Group using intramolecular nucleophilic substitution reaction to cause cleavage reaction An example of this group is a timing group described in U.S. Pat. No. 4,248,292. The group is represented by the following Formula (T-2).

Formula (T-2)

*-Nu-Link-E-** where Nu represents a nucleophilic group, and an example of a nucleophilic seed is an oxygen atom or a sulfur atom. E represents an electrophilic group which can cleave a bond with the symbol ** upon nucleophilic attack from Nu. Link represents a coupling group which three-dimensionally connects Nu with E so that they cause an intramolecular nucleophilic reaction. Specific examples of a group represented by Formula (T-2) are as follows.

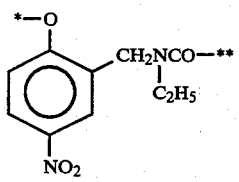

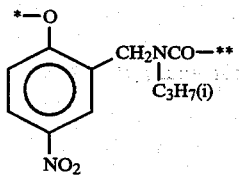

-continued

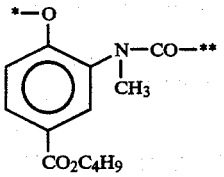

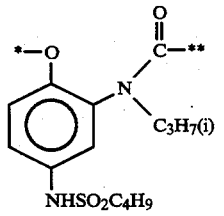

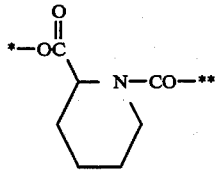

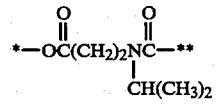

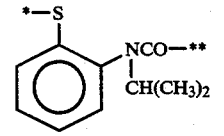

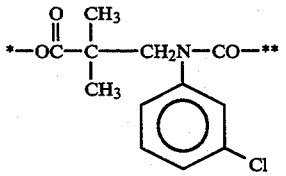

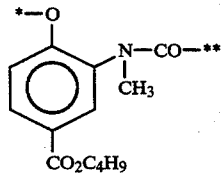

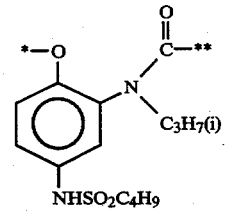

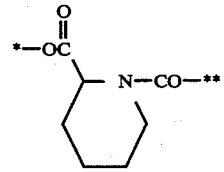

-continued

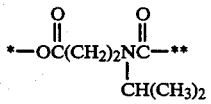

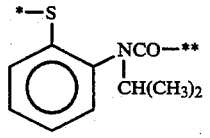

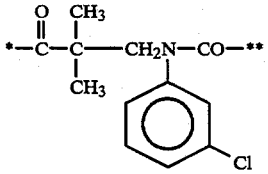

(3) Group using electron transfer reaction along conjugated system to cause cleavage reaction Examples of this group are described in U.S. Pat. Nos. 4,409,323 and 4,421,845, JP-A-57-188035, JP-A-58-98728, JP-A-58-209736, JP-A-58-209737, and JP-A-58-209738. The group is represented by the following Formula (T-3).

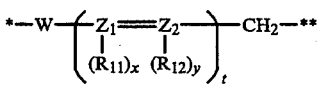

wherein a symbol *, a symbol , W, $R_{11}$, $R_{12}$, and t have the same meanings as those described above for (T-1). Note that $R_{11}$ and $R_{12}$ may combine to form a benzene ring or a heterocyclic ring. $R_{11}$ or $R_{12}$ and W may combine together to form a benzene ring or a heterocyclic ring. Each of $Z_1$ and $Z_2$ independently represents a carbon atom or a nitrogen atom, and each of x and y represents 0 or 1. If $Z_1$ is a carbon atom, x is 1. If $Z_1$ is a nitrogen atom, x is 0. The relationship between $Z_2$ and y is the same as that between $Z_1$ and x. t represents 1 or 2. If t is 2, two $-(Z_1(R_{11})_x{=}Z_2(R_{12})_y)-$ may be the same or different. A $-CH_2-$ group adjacent to the symbol  may be substituted by an alkyl group having 1 to 6 carbon atoms or a phenyl group.

Specific examples of a group represented by Formula (T-3) will be presented below.

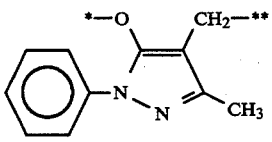

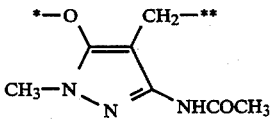

-continued

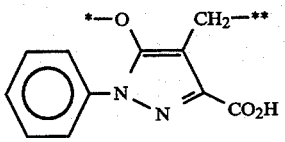

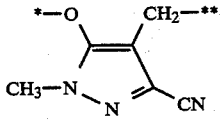

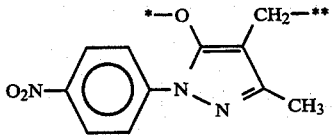

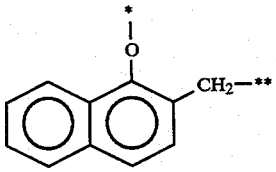

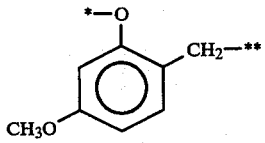

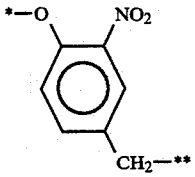

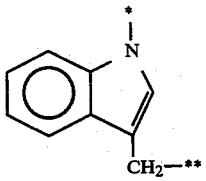

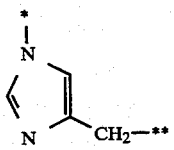

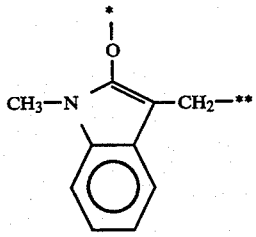

-continued

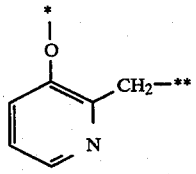

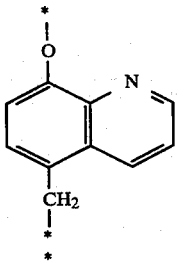

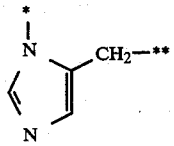

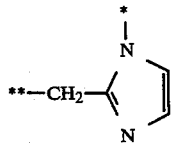

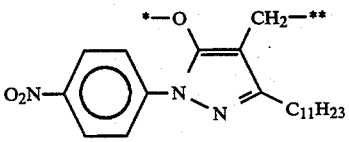

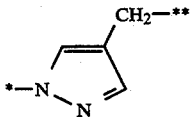

(4) Group using cleavage reaction caused by hydrolysis of ester

An example of this group is a coupling group described in West German Patent 2,626,315, such as a group represented by Formula (T-4) or (T-5) below. In each formula, symbols * and ** have the same meanings as described above for Formula (T-1).

Formula (T-4)

*—OCO—*

Formula (T-5)

*—SCS—**

(5) Group using cleavage reaction of iminoketal

An example of this group is a coupling group described in U.S. Pat. No. 4,546,073. The group is represented by the following Formula (T-6).

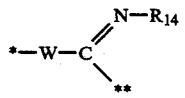

wherein symbols * and **, and W have the same meanings as described above for Formula (T-1), and $R_{14}$ has the same meaning as $R_{13}$. A specific example of a group represented by Formula (T-6) is as follows.

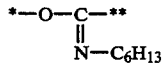

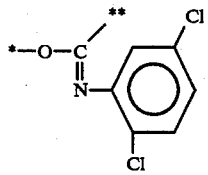

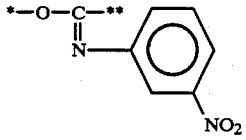

$L_1$ is preferably a group represented by one of Formulas (T-1) to (T-5), and most preferably a group represented by Formula (T-1), (T-3), or (T-4).

j is preferably 0 or 1.

A group represented by $L_2$ in Formula (I) represents a timing group with a valancy of 3 or more but does not use electron transfer via a conjugated system.

A preferable example of $L_2$ is that represented by Formula (T-$L_1$) below.

Formula (T-$L_1$)

where a symbol * represents a position to be bonded to $A—(L_1)_j—$ in Formula (I), and a symbol ** represents a position to be bonded to $—(L_3)_n—PUG$ in the formula.

A $Z_3$ group represents a substituted or nonsubstituted methylene group. Two $Z_3$ groups may be the same or different or may combine together to form a ring.

Specific examples of (T-$L_1$) will be presented below, but the present invention is not limited to these examples.

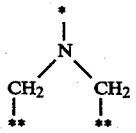

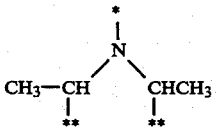

-continued

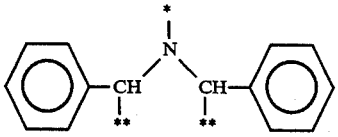

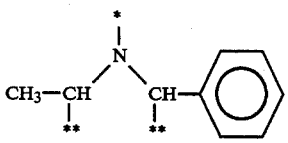

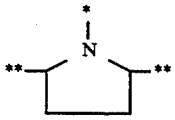

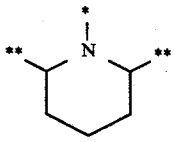

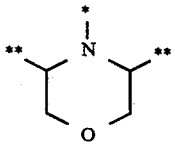

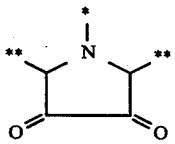

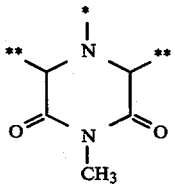

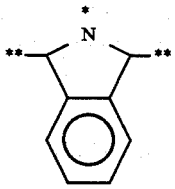

Note that these groups enumerated above as examples may further have substituents. Examples of the substituents are an alkyl group (e.g., methyl, ethyl, isopropyl, t-butyl, hexyl, methoxyethyl, methoxymethyl, chloroethyl, cyanoethyl, nitroethyl, hydroxypropyl, carboxyethyl, dimethylaminoethyl, benzyl, and phenethyl), an aryl group (e.g., phenyl, naphthyl, 4-hydroxyphenyl, 4-cyanophenyl, 4-nitrophenyl, 2-methoxyphenyl, 2,6-dimethylphenyl, 4-carboxyphenyl, and 4-sulfophenyl), a heterocyclic group (e.g., 2-pyridyl, 4-pyridyl, 2-furyl, 2-thienyl, and 2-pyrrolyl), a halogen atom (e.g., chlorine and bromine), a nitro group, an alkoxy group (e.g., methoxy, ethoxy, and isopropoxy), an aryloxy group (e.g., phenoxy), an alkylthio group (e.g., methylthio, isopropylthio, t-butylthio), an arylthio group (e.g., phenylthio), an amino group (e.g., amino, dimethylamino, diisopropylamino), an acylamino group (e.g., acetylamino and benzoylamino), a sulfonamide group (e.g., methanesulfonamide and benzenesulfonamide), a cyano group, a carboxy group, an alkoxycarbonyl group (e.g., methoxycarbonyl and ethoxycarbonyl), an aryloxycarbonyl group (e.g., phenoxycarbonyl), and a carbamoyl group (e.g., N-ethylcarbamoyl and N-phenylcarbamoyl).

Of these groups, most preferable examples are an alkyl group, a nitro group, an alkoxy group, an alkylthio group, an amino group, an acylamino group, a sulfonamide group, an alkoxycarbonyl group, and a carbamoyl group.

In Formula (I), m is preferably 1.

In Formula (I), a group represented by $L_3$ have the same meaning as $L_1$.

In Formula (I), n is preferably 0 or 1, particularly preferably 0.

In Formula (I), a photographically useful group represented by PUG is specifically a development inhibitor, a dye, a fogging agent, a developing agent, a coupler, a bleaching accelerator, or a fixing accelerator. Preferable examples of the photographically useful group are a photographically useful group described in U.S. Pat. No. 4,248,962 (a group represented by formula PUG in the patent specification), a dye described in JP-A-62-49353 (a portion of a split-off group released from a coupler in the specification), a development inhibitor described in U.S. Pat. No. 4,477,563, and bleaching accelerators described in JP-A-61-201247 and JP-A-2-558 (a portion of a split-off group released from a coupler in each of those specifications). In the present invention, a most preferable example of the photographically useful group is a development inhibitor.

Preferable examples of the development inhibitor are groups represented by the following Formulas (INH-1) to (INH-13).

Formula (INH-1)

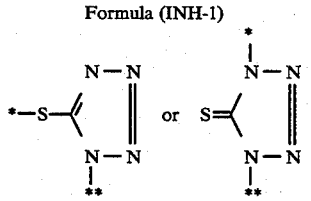

Formula (INH-2)

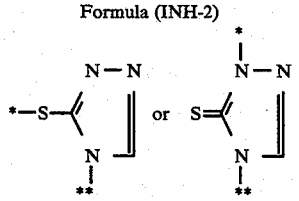

Formula (INH-3)

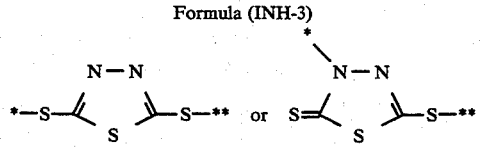

-continued

Formula (INH-4)

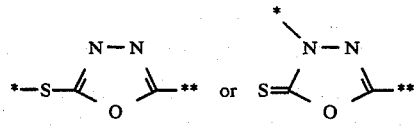

Formula (INH-5)

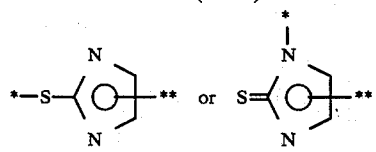

Formula (INH-6)

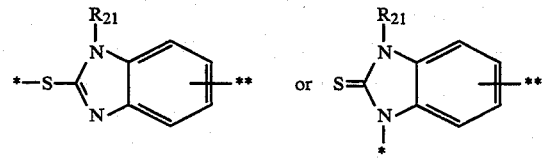

wherein $R_{21}$ represents a hydrogen atom or a substituted or nonsubstituted hydrocarbon group (e.g., methyl, ethyl, propyl, or phenyl).

Formula (INH-7)

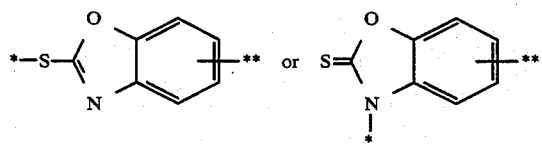

Formula (INH-8)

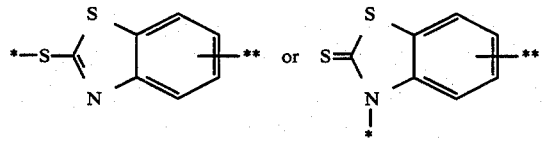

Formula (INH-9)

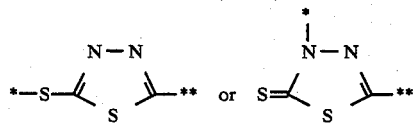

Formula (INH-10)

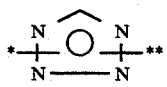

Formula (INH-11)

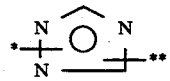

Formula (INH-12)

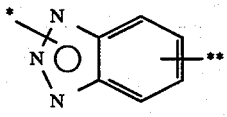

Formula (INH-13)

-continued

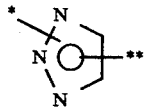

wherein a symbol * represents a position to be bonded to a group represented by $L_2$ or $L_3$ of a compound represented by Formula (I).

A symbol ** represents a position to be bonded to a substituent. Examples of the substituent are a substituted or nonsubstituted aliphatic group, an alkoxycarbonyl group, an aryloxycarbonyl group, an aryl group, and a heterocyclic group.

Specific examples of the aliphatic group are methyl, ethyl, propyl, butyl, hexyl, decyl, isobutyl, t-butyl, 2-ethylhexyl, 2-methylthioethyl, benzyl, 4-methoxybenzyl, phenethyl, 1-methoxycarbonylethyl, propyloxycarbonylmethyl, 2-(propyloxycarbonyl)ethyl, butyloxycarbonylmethyl, pentyloxycarbonylmethyl, 2-cyanoethyloxycarbonylmethyl, 2,2-dichloroethyloxycarbonylmethyl, 3-nitropropyloxycarbonylmethyl, 4-nitrobenzyloxycarbonylmethyl, and 2,5-dioxo-3,6-dioxadecyl.

Examples of the alkoxycarbonyl group are methoxycarbonyl, propoxycarbonyl, and a group represented by $—CO_2CH_2CO_2R_{100}$ wherein $R_{100}$ represents a substituted or nonsubstituted alkyl group having 1 to 8 carbon atoms.

An example of the aryloxycarbonyl group is a phenoxycarbonyl group.

Examples of the aryl group are phenyl, naphthyl, 4-methoxycarbonylphenyl, 4-ethoxycarbonylphenyl, 2-methylthiophenyl, 3-methoxycarbonylphenyl, and 4-(2-cyanoethylcarbonyl)-phenyl.

Examples of the heterocyclic group are 4-pyridyl, 3-pyridyl, 2-pyridyl, 2-furyl, and 2-tetrahydropyranyl.

Of these groups, preferable examples of INH are (INH-1), (INH-2), (INH-3), (INH-4), (INH-9), and (INH-12), and the most preferable examples are (INH-1), (INH-2), and (INH-3).

A substituent to be bonded to INH is preferably an aliphatic group or a substituted or nonsubstituted phenyl group.

A compound represented by Formula (I) is most preferably a compound represented by Formula (Ia) below.

Formula (Ia)

$$A—L_1—N—(Z_3—PUG)_2$$

wherein symbols have the same meanings as in Formulas (I) and (T-$L_1$). In Formula (Ia), $L_1$ is preferably an —OC(=O)— group, and PUG is preferably a development inhibitor.

If a plurality of photographically useful groups have different functions in Formula (I), a timing group does not use intramolecular nucleophilic substitution.

In this case, the function of the photographically useful group means a function exhibited by, e.g., a development inhibitor, a dye, a fogging agent, a developing agent, a coupler, a bleaching accelerator, or a fixing agent.

Most preferably, two or more PUGs released from a single compound are the same development inhibitor.

A compound represented by Formula (II) will be described below. In Formula (II), A and PUG have the same meanings as in Formula (I). $L_4$ represents an —OCO— group, an —OSO— group, an $—OSO_2—$ group, an —OCS—group, an —SCO— group, an —SCS— group, or a $—WCR_{11}R_{12}$—group. W, $R_{11}$, and $R_{12}$ have the same meanings as defined in Formula (T-1) in the explanation of $L_1$ of a compound represented by Formula (I).

When $L_4$ represents a $—WCR_{11}R_{12}$— group, W preferably represents an oxygen atom or a tertiary amino group. More preferably, $L_4$ represents an $—OCH_2—$ group or a group in which W and $R_{11}$ or $R_{12}$ forms a ring.

When $L_4$ represents a group other than $—WCR_{11}R_{12}—$, it is preferably an —OCO— group, an —OSO— group, or an $—OSO_2—$ group, and most preferably an —OCO— group.

A group represented by $L_5$ represents a group which releases PUG by electron transfer along a conjugated system or a group defined by $L_4$. The group which releases PUG by electron transfer along a conjugated system has the same meaning as a group represented by Formula (T-3) in the explanation of $L_1$ of Formula (I). $L_5$ is preferably a group which releases PUG by electron transfer along a conjugated system, and more preferably a group which can bond to $L_4$ via a nitrogen atom.

Preferable examples of a compound represented by Formula (II) are compounds represented by the following Formulas (III) and (IV).

Formula (III)

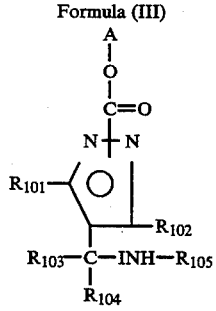

wherein A has the same meaning as in Formula (I). Each of $R_{101}$ and $R_{102}$ independently represents a hydrogen atom or a substituent. Each of $R_{103}$ and $R_{104}$ independently represents a hydrogen atom or a substituent. INH represents a group having a development inhibiting power. $R_{105}$ represents a nonsubstituted phenyl group, a nonsubstituted primary alkyl group, or a primary alkyl group substituted by a group except for an aryl group. Note that at least one of $R_{101}$ to $R_{104}$ is a substituent except for a hydrogen atom.

Formula (IV)

-continued

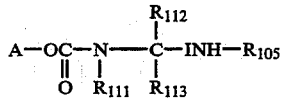

wherein A, INH, and $R_{105}$ have the same meanings as in Formula (III).

Each of $R_{111}$, R112, and $R_{113}$ represents a hydrogen atom or an organic moiety. Any two of $R_{111}$, $R_{112}$, and $R_{113}$ may be divalent groups and combine together to form a ring.

A compound represented by Formula (III) will be described in more detail below.

In Formula (III), A has the same meaning as in Formula (I). Each of $R_{101}$ and $R_{102}$ independently represents a hydrogen atom or a substituent. Specific examples of the substituent are an aryl group (e.g., phenyl, naphthyl, p-methoxyphenyl, p-hydroxyphenyl, p-nitrophenyl, and o-chlorophenyl), an alkyl group (e.g., methyl, ethyl, isopropyl, propyl, tert-butyl, tert-amyl, isobutyl, sec-butyl, octyl, methoxymethyl, 1-methoxyethyl, and 2-chloroethyl), a halogen atom (e.g., fluorine, chlorine, bromine, and iodine), an alkoxy group (e.g., methoxy, ethoxy, isopropyloxy, propyloxy, tert-butyloxy, isobutyloxy, butyloxy, octyloxy, 2-methoxyethoxy, 2-chloroethoxy, nitromethyl, 2-cyanoethyl, 2-carbamoylethyl, and 2-dimethylcarbamoylethyl), an aryloxy group (e.g., phenoxy, naphthoxy, and p-methoxyphenoxy), an alkylthio group (e.g., methylthio, ethylthio, isopropylthio, propylthio, tert-butylthio, isobutylthio, sec-butylthio, octylthio, and 2-methoxyethylthio), an arylthio group (e.g., phenylthio, naphthylthio, and p-methoxyphenylthio), an amino group (e.g., amino, methylamino, phenylamino, dimethylamino, diethylamino, diisopropylamino, and phenylmethylamino), a carbamoyl group (e.g., carbamoyl, methylcarbamoyl, dimethylcarbamoyl, diethylcarbamoyl, diisopropylcarbamoyl, ethylcarbamoyl, isopropylcarbamoyl, tert-butylcarbamoyl, phenylcarbamoyl, and phenylmethylcarbamoyl), a sulfamoyl group (e.g., sulfamoyl, methylsulfamoyl, ethylsulfamoyl, isopropylsulfamoyl, phenylsulfamoyl, octylsulfamoyl, dimethylsulfamoyl, diethylsulfamoyl, diisopropylsulfamoyl, dihexylsulfamoyl, and phenylmethylsulfamoyl), an alkoxycarbonyl group (e.g., methoxycarbonyl, propyloxycarbonyl isopropyloxycarbonyl, tert-butyloxycarbonyl, tert-amyloxycarbonyl, and octyloxycarbonyl), an aryloxycarbonyl group (e.g., phenoxycarbonyl and p-methoxyphenoxycarbonyl), an acylamino group (e.g., acetylamino, propanoylamino, pentanoylamino, N-methylacetylamino, or benzoylamide), a sulfonamide group (e.g., methanesulfonamide, ethanesulfonamide, pentanesulfonamide, benzenesulfonamide, and p-toluenesulfonamide), an alkoxycarbonylamino group (e.g., methoxycarbonylamino, isopropyloxycarbonylamino, tert-butoxycarbonylamino, and hexyloxycarbonylamino), an aryloxycarbonylamino group (e.g., phenoxycarbonylamino), a ureido group (e.g., 3-methylureido and 3-phenylureido), a cyano group, and a nitro group.

$R_{101}$ and $R_{102}$ may be the same or different, but the sum of their formular weights is preferably less than 120. The substituent are preferably an alkyl group, a halogen atom, or an alkoxy group, and most preferably an alkyl group.

In Formula (III), each of groups represented by $R_{103}$ and $R_{104}$ independently represents a hydrogen atom or an alkyl group. Examples of the alkyl group are methyl, ethyl, isopropyl, tert-butyl, isobutyl, hexyl, and 2-methoxyethyl. Each of $R_{103}$ and $R_{104}$ is preferably a hydrogen atom, a methyl group, or an ethyl group, and most preferably a hydrogen atom.

In Formula (III), a group represented by $R_{105}$ represents a nonsubstituted phenyl group, a nonsubstituted primary alkyl group, or a primary alkyl group substituted by a group except for an aryl group. Examples of the alkyl group are ethyl, propyl, butyl, isobutyl, pentyl, isopentyl, 2-methylbutyl, hexyl, 2-methylpentyl, 3-methylpentyl, 4-methylpentyl, 2-ethylbutyl, heptyl, and octyl. Examples of the substituent are a halogen atom, an alkoxy group, an alkylthio group, an amino group, a carbamoyl group, a sulfamoyl group, an alkoxycarbonyl group, an acylamino group, a sulfonamide group, an alkoxycarbonylamino group, a ureido group, a cyano group, a nitro group, and a group represented by $-CO_2CH_2CO_2R_{106}$. Specific examples of each group are those enumerated above as the substituents for $R_{101}$ and $R_{102}$ except for groups containing an aryl group.

$R_{106}$ represents a nonsubstituted alkyl group (e.g., propyl, butyl, isobutyl, pentyl, isopentyl, or hexyl) having 3 to 6 carbon atoms.

$R_{105}$ may be substituted by two or more types of substituents. Preferable examples of the substituent of $R_{105}$ are fluorine, chlorine, an alkoxy group, a carbamoyl group, an alkoxycarbonyl group, a cyano group, a nitro group, and $-CO_2CH_2CO_2R_{106}$. Of these groups, most preferable substituents are an alkoxycarbonyl group and a $-CO_2CH_2CO_2R_{106}$ group.

$R_{105}$ is preferably a phenyl group, a primary nonsubstituted alkyl group having 2 to 6 carbon atoms, or a primary alkyl group substituted by the groups enumerated above as the preferable substituents of $R_{105}$. Most preferably, $R_{105}$ is a primary nonsubstituted alkyl group having 3 to 5 carbon atoms or a primary alkyl group substituted by an alkoxycarbonyl group.

In Formula (III), a group represented by INH represents a group having a development inhibiting power. Specific examples of the group are (INH-1) to (INH-13) enumerated above in the explanation of PUG in Formula (I). Other comments on the INH, including preferable scope thereof, is same as that described in connection with formula (I).

A compound represented by Formula (IV) will be described in more detail below.

A case wherein each of $R_{111}$, $R_{112}$, and $R_{113}$ represents a hydrogen atom or a monovalent organic group will be described first.

When each of $R_{112}$ and $R_{113}$ represents a monovalent organic group, the organic group is preferably an alkyl group (e.g., methyl or ethyl) or an aryl group (e.g., phenyl). At least one of $R_{112}$ and $R_{113}$ is preferably a hydrogen atom. Most preferably, both of $R_{112}$ and $R_{113}$ are hydrogen atoms.

$R_{111}$ represents an organic group. Preferable examples of this organic group are an alkyl group (e.g., methyl, isopropyl, butyl, isobutyl, tert-butyl, sec-butyl, neopentyl, and hexyl), an aryl group (e.g., phenyl), an acyl group (e.g., acetyl and benzoyl), a sulfonyl group (e.g., methanesulfonyl and benzenesulfonyl), a carbamoyl group (e.g., ethylcarbamoyl and phenylcarbamoyl), a sulfamoyl group (e.g., ethylsulfamoyl and phenylsulfamoyl), an alkoxycarbonyl group (e.g., ethoxycarbonyl and butoxycarbonyl), an aryloxycarbonyl group (e.g., phenoxycarbonyl and 4-methylphenoxycarbonyl), an alkoxysulfonyl group (e.g., butoxysulfonyl and ethoxysulfonyl), an aryloxysulfonyl group (e.g., phenoxysulfonyl and 4-methoxyphenoxysulfonyl), a cyano group, a nitro group, a nitroso group, a thioacyl group (e.g., thioacetyl and thiobenzoyl), a thiocarbamoyl group (e.g., ethylthiocarbamoyl), an imidoyl group (e.g., N-ethylimidoyl), an amino group (e.g., amino, dimethylamino, and methylamino), an acylamino group (e.g., formylamino, acetylamino, and N-methylacetylamino), an alkoxy group (e.g., methoxy and isopropyloxy), and an aryloxy group (e.g., phenoxy).

These groups may further have substituents. Examples of the substituents are the groups enumerated above as the substituents of $R_{111}$, a halogen atom (e.g., fluorine, chlorine, and bromine), a carboxyl group, and a sulfo group.

$R_{111}$ preferably has 15 or less atoms except for a hydrogen atom.

$R_{111}$ is more preferably a substituted or nonsubstituted alkyl group or aryl group, and most preferably a substituted or nonsubstituted alkyl group.

A case wherein any two of groups represented by $R_{111}$, $R_{112}$, and $R_{113}$ become divalent groups and combine together to form a ring will be described below.

The ring to be formed is preferably a 4- to 8-membered ring, and more preferably a 4- to 6-membered ring.

Preferable examples of the divalent group are as follows:

—C(=O)—N($R_{114}$)—, —$SO_2$—N($R_{114}$)—, —$(CH_2)_3$—, —$(CH_2)_4$—, —$(CH_2)_5$—, —C(=O)—$(CH_2)_2$—, —C(=O)—N($R_{114}$)—C(=O)—, —$SO_2$—N($R_{114}$)—C(=O)—, —C(=O)—C($R_{114}$)($R_{115}$)—, and —$(CH_2)_2$—O—$CH_2$—.

Each of $R_{114}$ and $R_{115}$ represents a hydrogen atom or has the same meaning as $R_{111}$ when $R_{111}$ represents a monovalent organic group. $R_{114}$ and $R_{115}$ may be the same or different.

Of $R_{111}$, $R_{112}$, and $R_{113}$, a group which does not function as a divalent group represents a hydrogen atom or a monovalent organic group. Specific examples of the organic group are the same as those enumerated above for $R_{111}$, $R_{112}$, and $R_{113}$ in the case wherein they do not form a ring.

If any two of $R_{111}$, $R_{112}$, and $R_{113}$ combine to form a ring, either $R_{112}$ or $R_{113}$ is preferably a hydrogen atom, and the remaining one of $R_{112}$ and $R_{113}$, and $R_{111}$ form a ring. More preferably, the left end of the divalent group enumerated above bonds to a nitrogen atom of Formula (I), and its right end bonds to a carbon atom.

$R_{111}$, $R_{112}$, and $R_{113}$ preferably do not form a ring but respectively represent a hydrogen atom or a monovalent organic group.

In Formulas (I) and (II), each of the formular weights of the residues which are obtained by removing two groups represented by A and PUG from the formula (I) or (II) respectively, is preferably 64 to 240, more preferably 70 to 200, and most preferably 90 to 180.

Specific examples of compounds represented by Formulas (I) to (IV) for use in the present invention will be presented below, but the present invention is not limited to these examples.

Note that compounds in which A in Formula (I) represents a coupler moiety are denoted by numbers beginning with (CA), compounds in which A in Formulas (II) to (IV) represents a coupler moiety are denoted by numbers beginning with (CB), and compounds in which A in Formulas (I) to (IV) represents an oxidation-reduction group are denoted by numbers beginning with (SA).

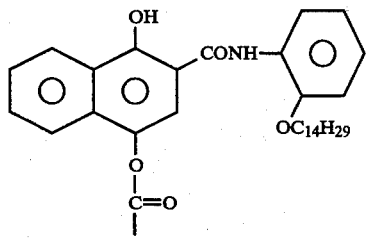

(CA-1)

-continued
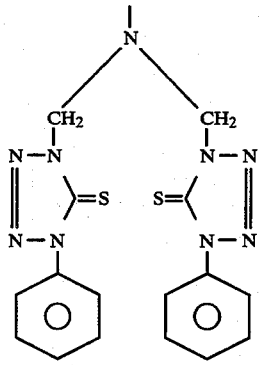
(CA-2)
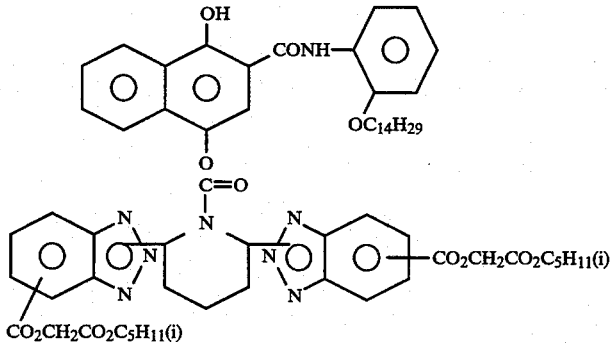
(CA-3)
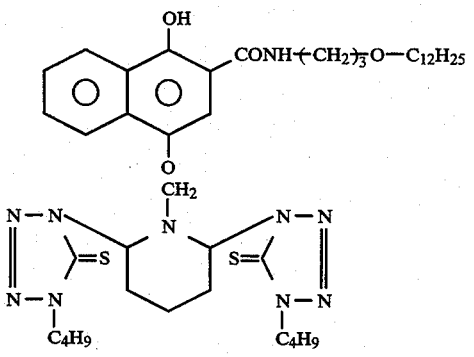
(CA-4)
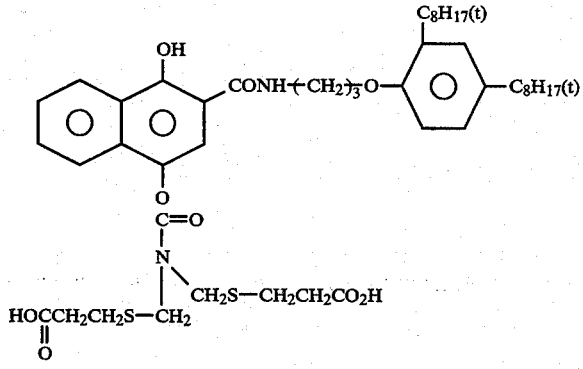

-continued
(CA-5)
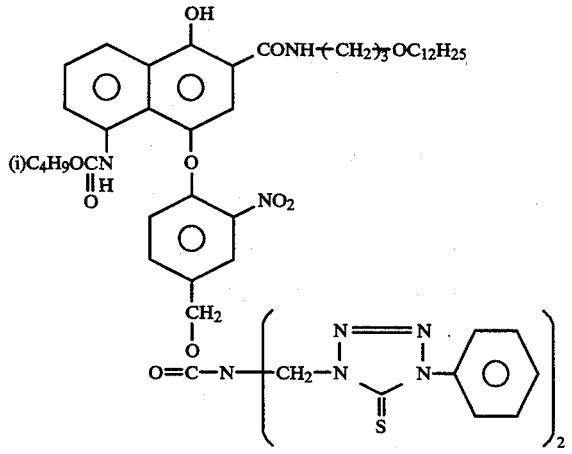
(CA-6)
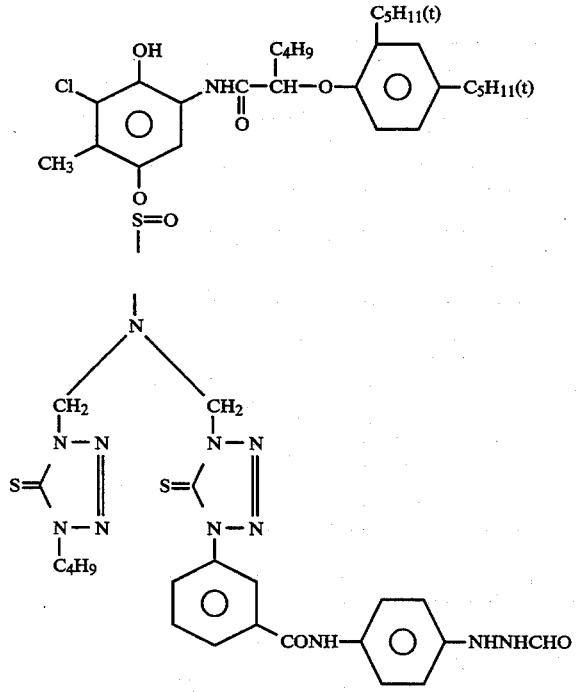
(CA-7)
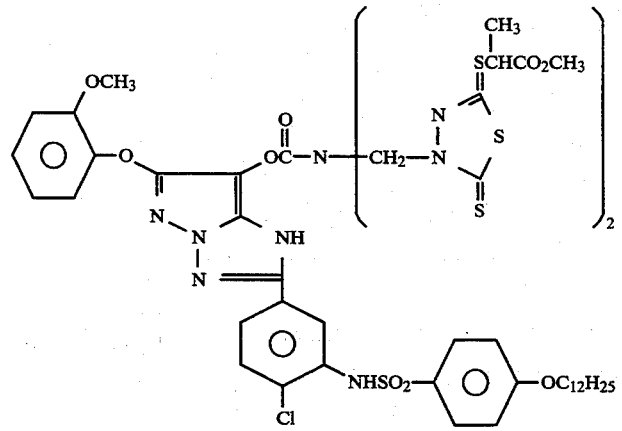

-continued
(CA-8)
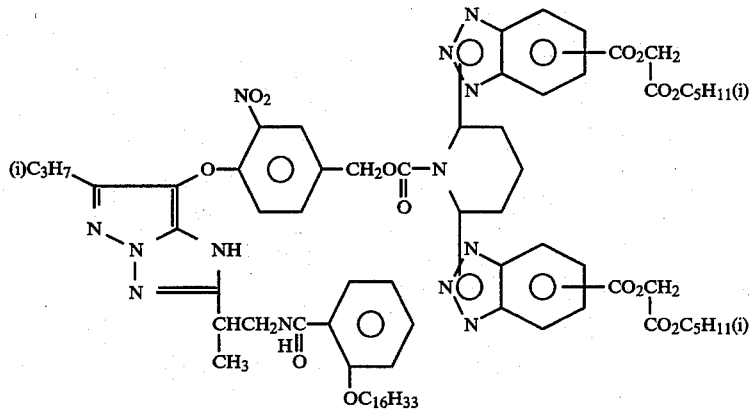
(CA-9)
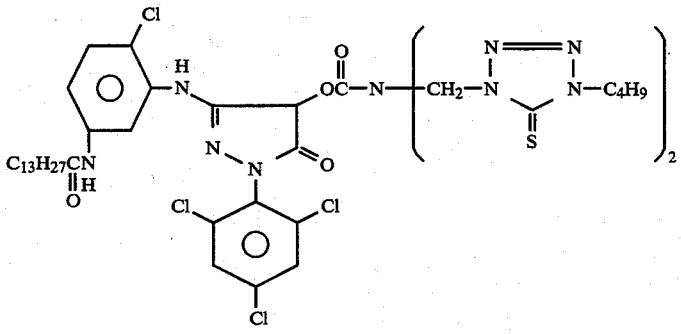
(CA-10)
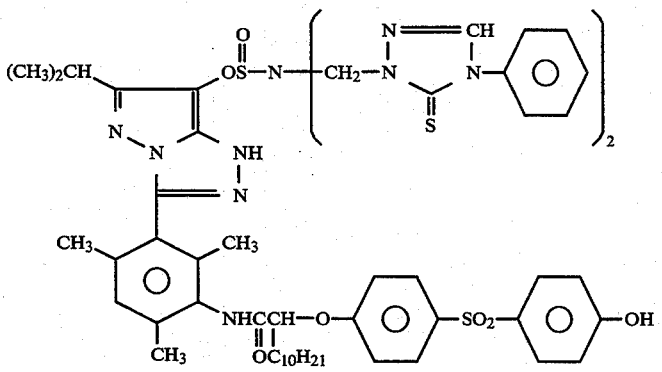
(CA-11)
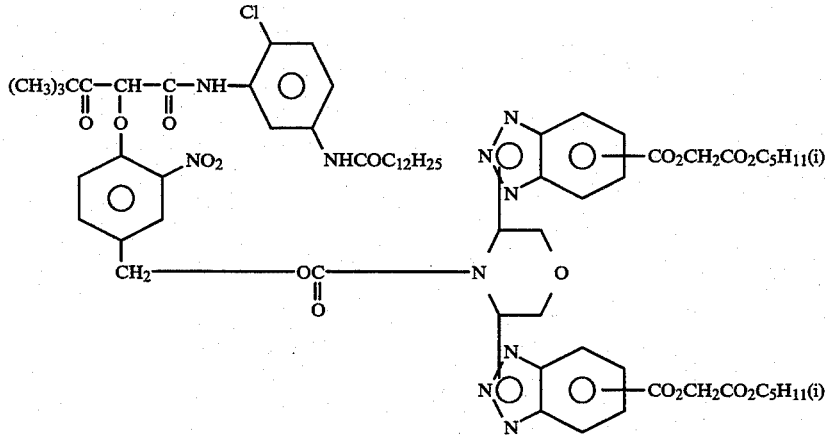

-continued
(CA-12)
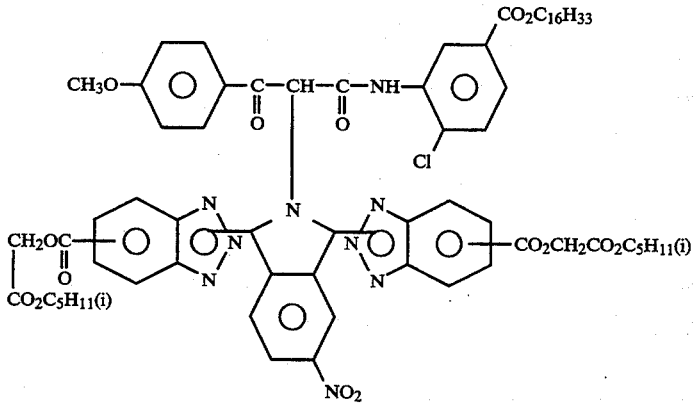
(CA-13)
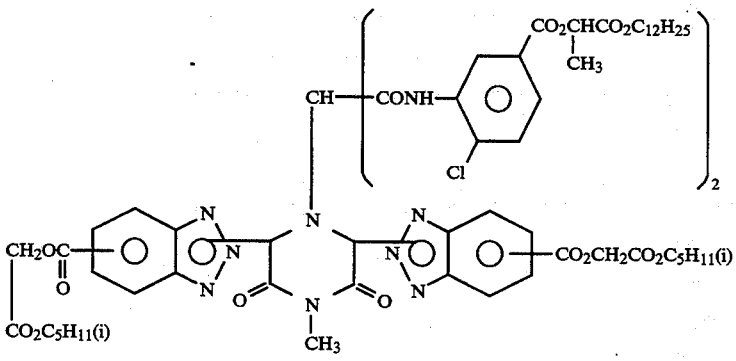
(CA-14)
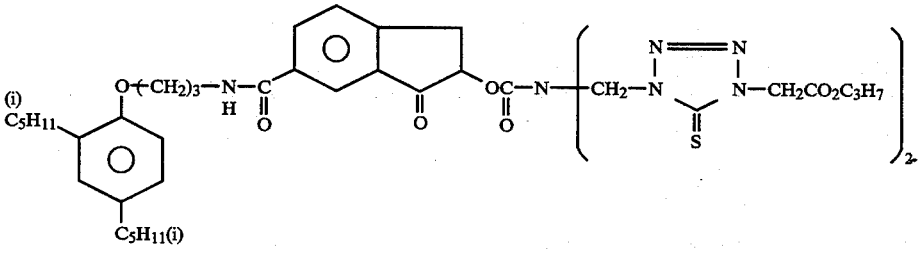
(CB-1)
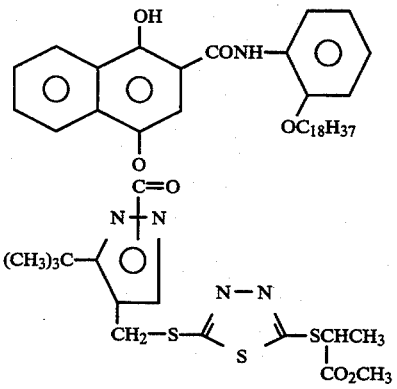
(CB-2)
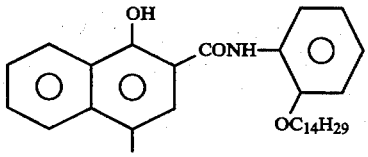

-continued
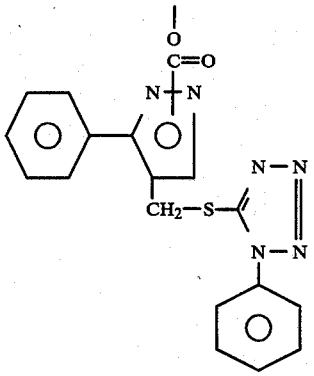
(CB-3)
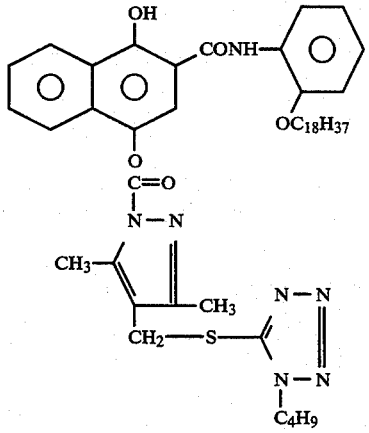
(CB-4)
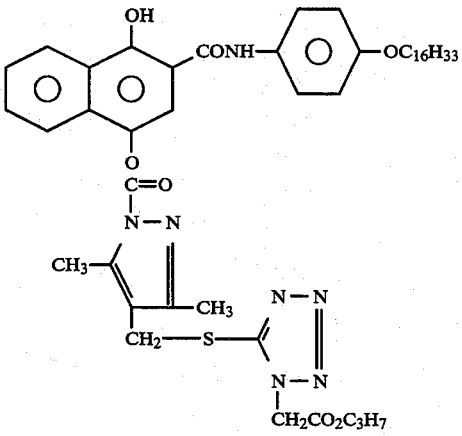
(CB-5)
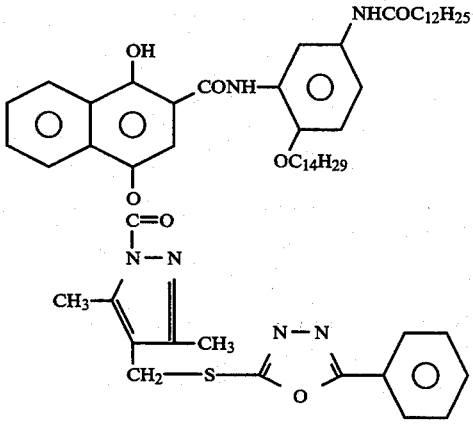

-continued
(CB-6)
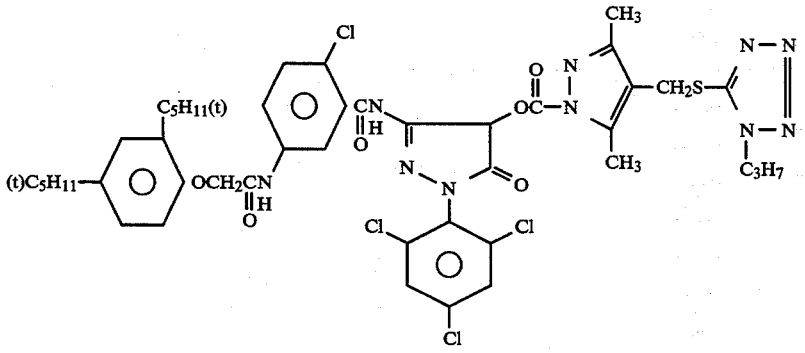
(CB-7)
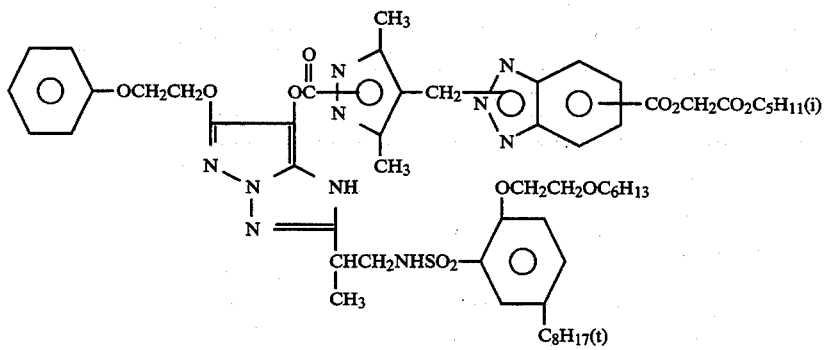
(CB-8)
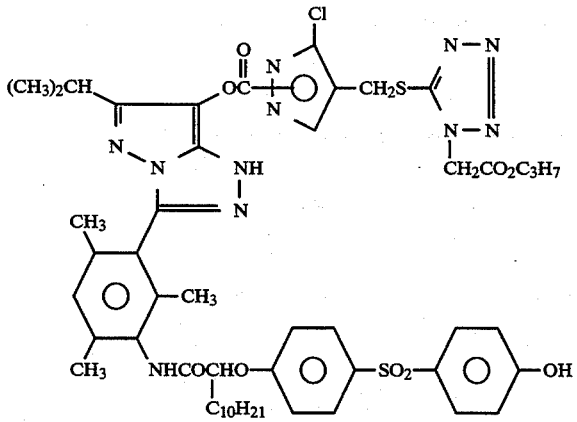
(CB-9)
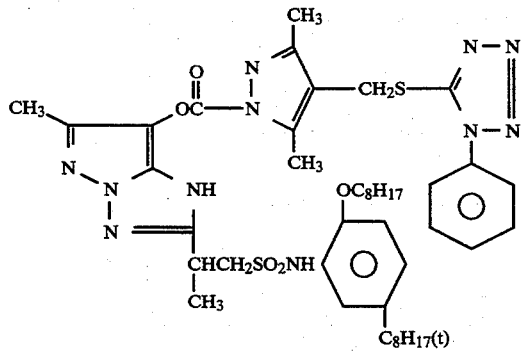

-continued
(CB-10)
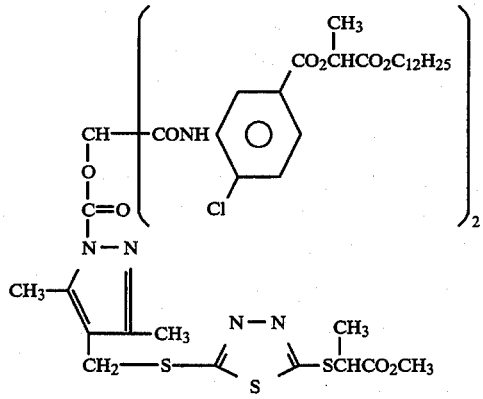
(CB-11)
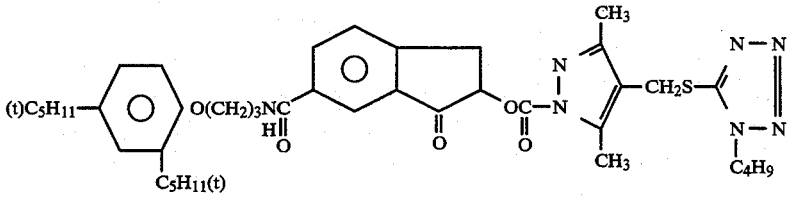
(CB-12)
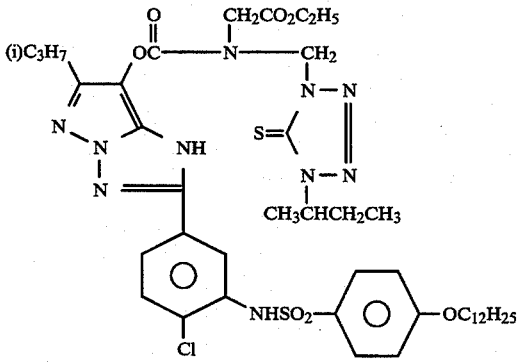
(CB-13)
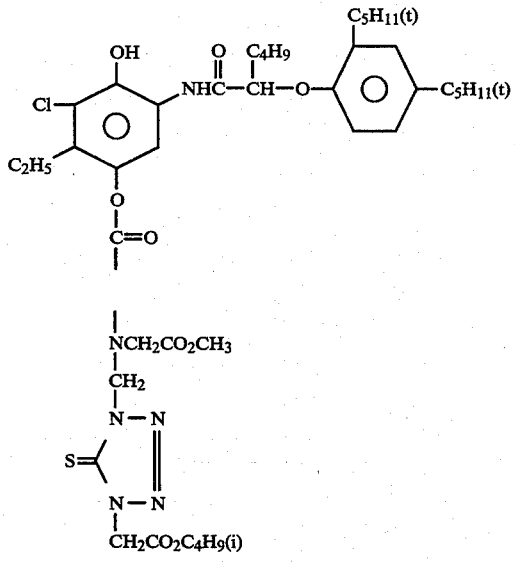

-continued
(CB-14)
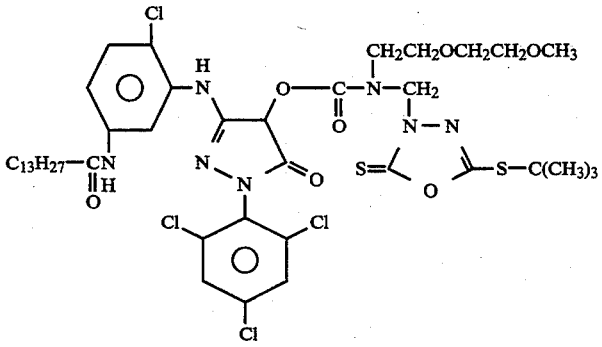
(CB-15)
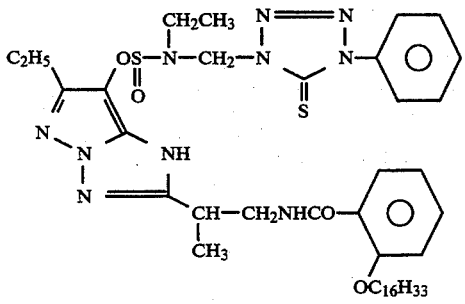
(CB-16)
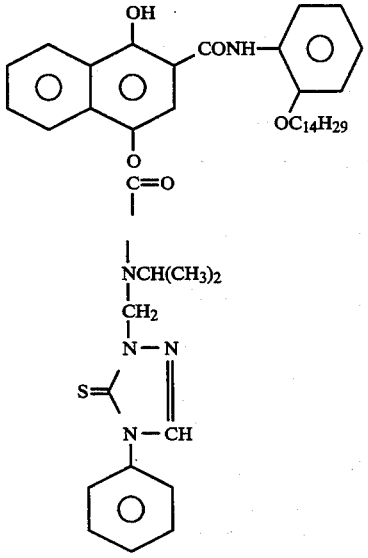
(CB-17)
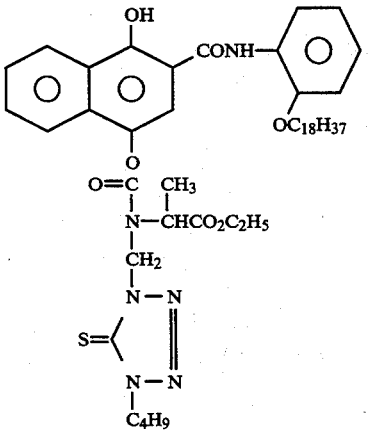

-continued
(CB-18)
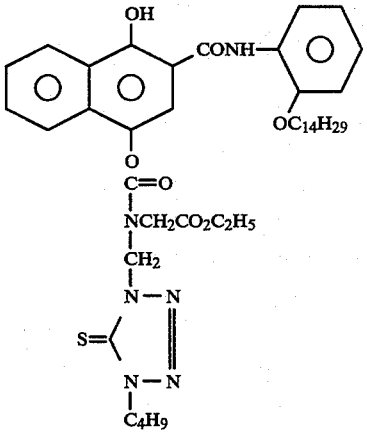
(CB-19)
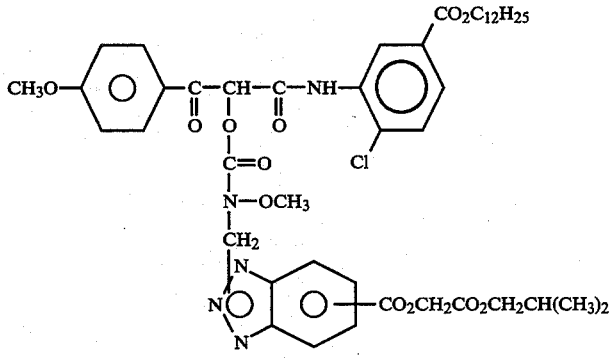
(CB-20)
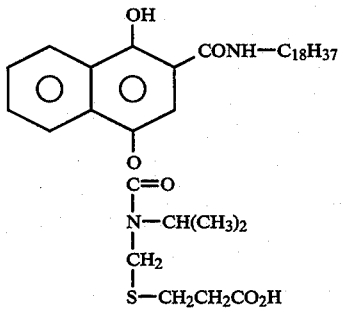
(CB-21)
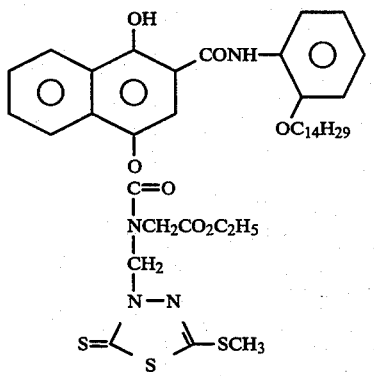

-continued
(CB-22)
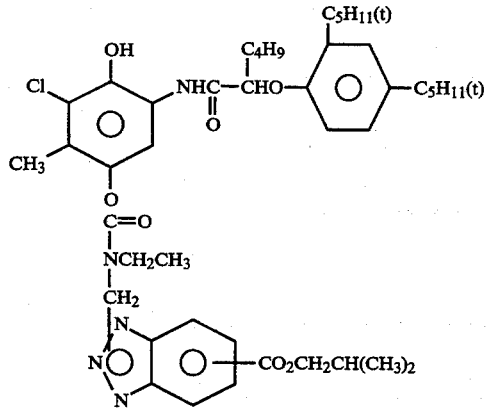
(CB-23)
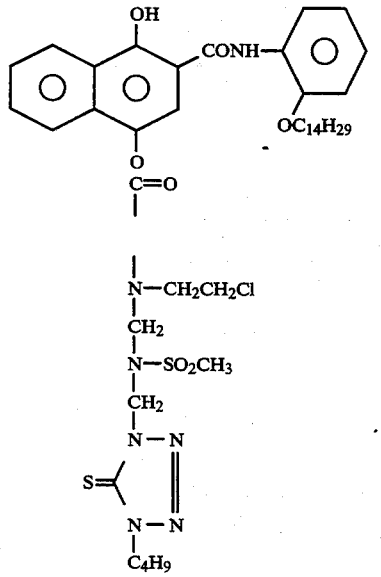
(CB-24)
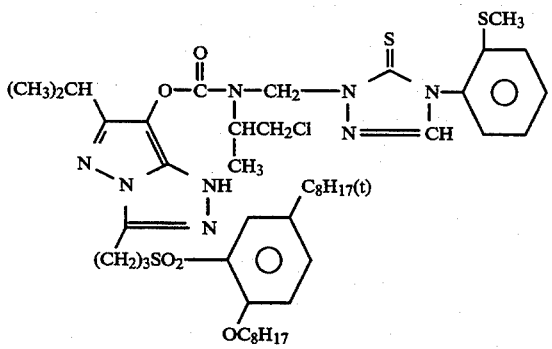
(CB-25)
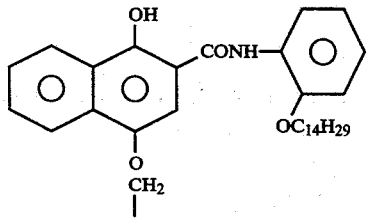

-continued
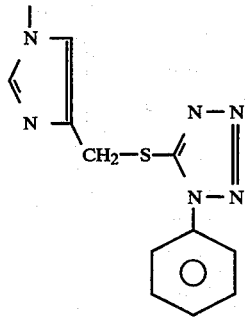
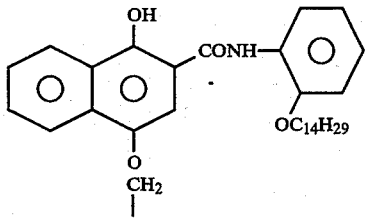
(CB-26)
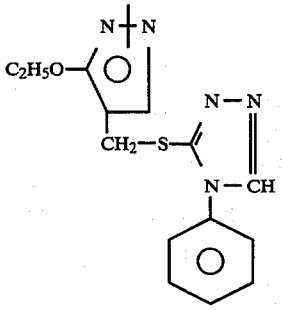
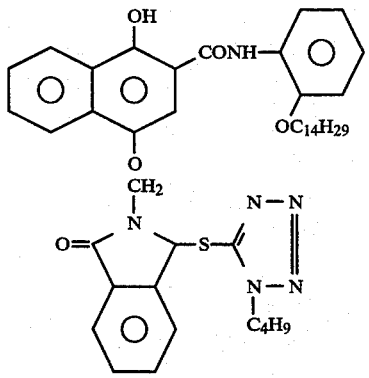
(CB-27)
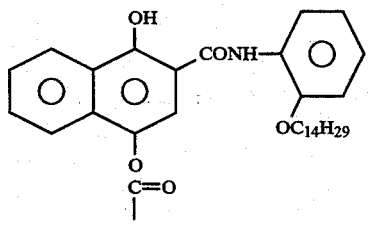
(CB-28)

-continued
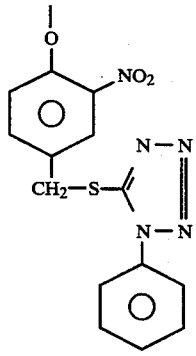
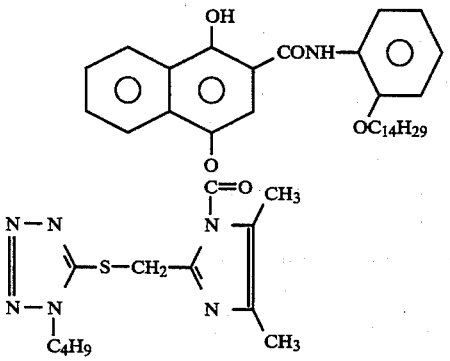
(CB-29)
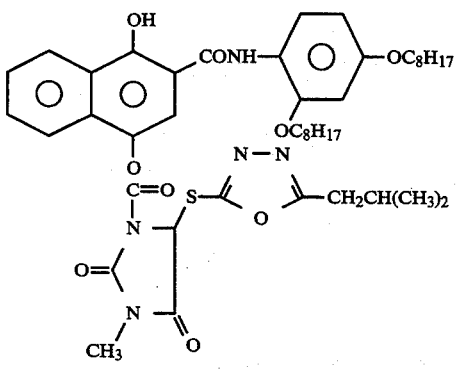
(CB-30)
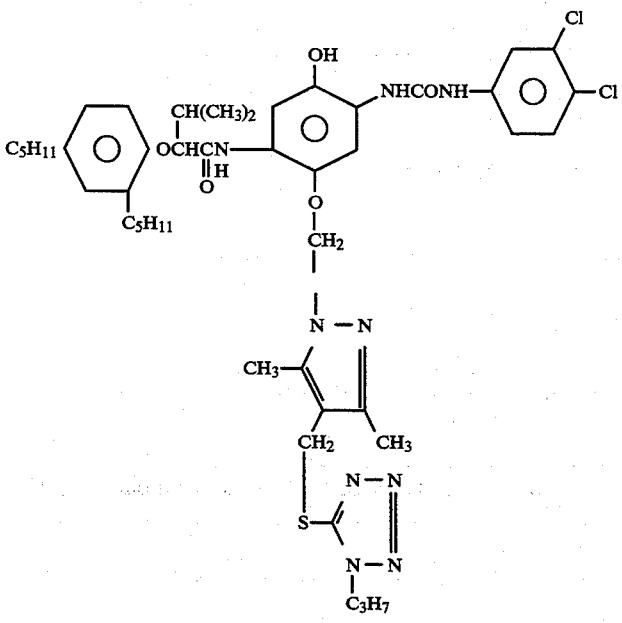
(CB-31)

-continued
(CB-32)
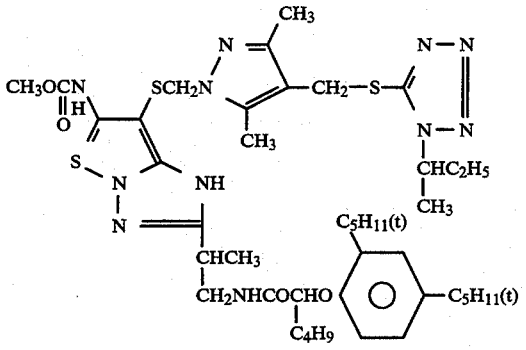
(CB-33)
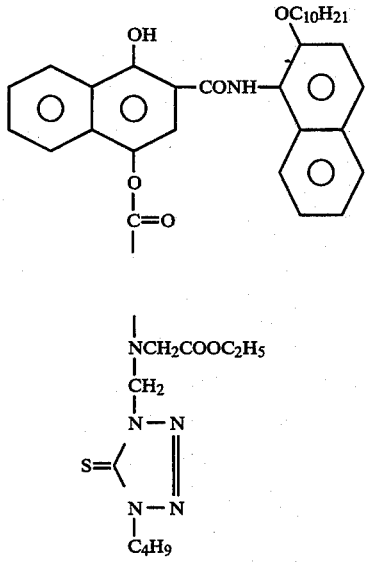
(CB-34)
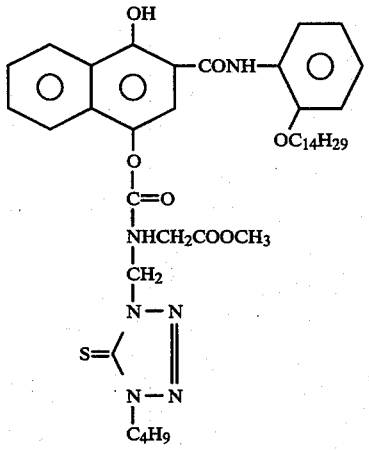

-continued
(CB-35)
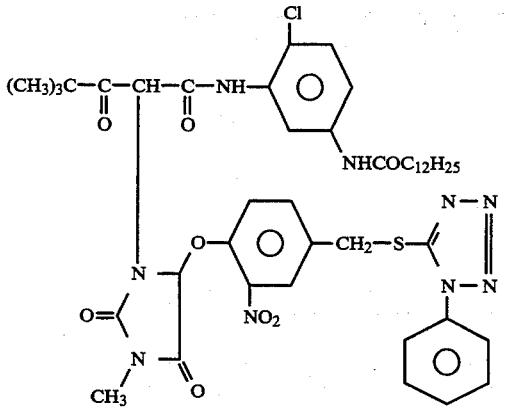
(CB-36)
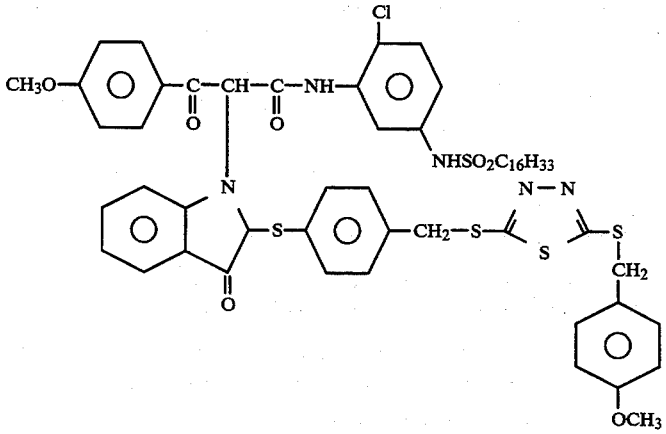
(CB-37)
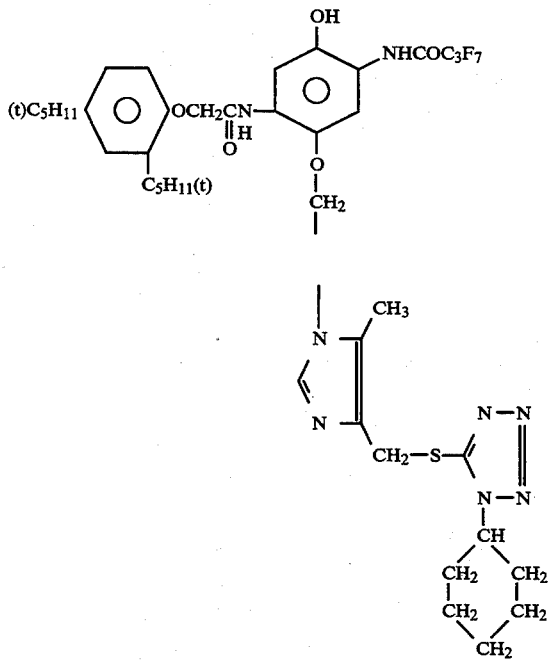

-continued
(CB-38)
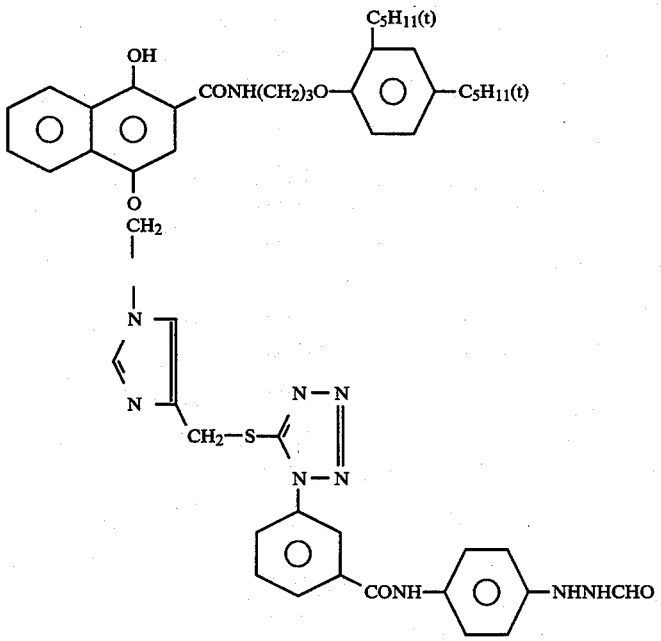
(SA-1)
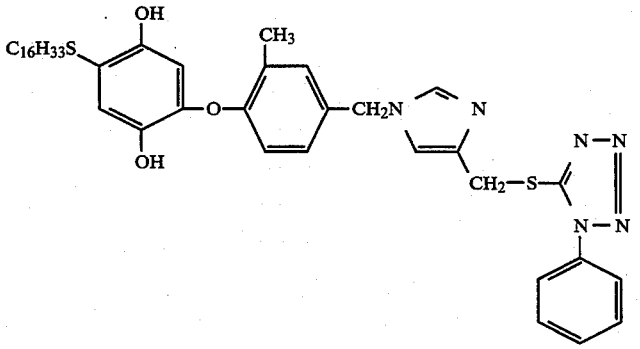
(SA-2)
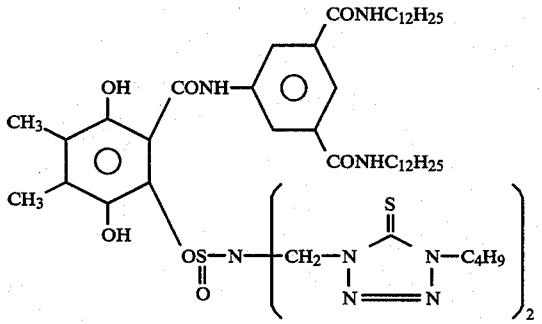
(SA-3)
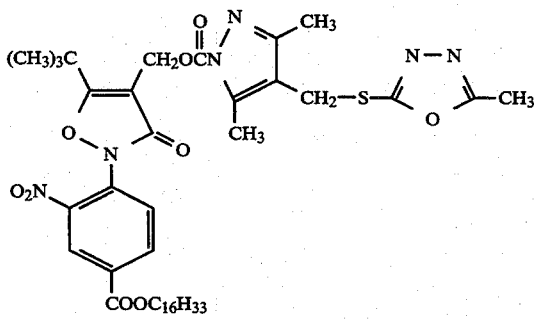

-continued (SA-4)

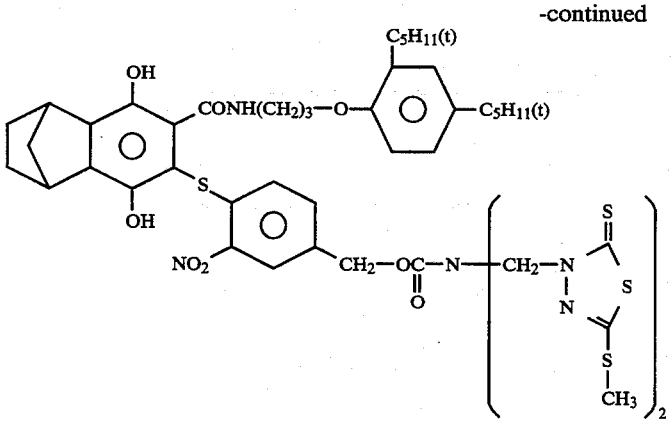

(SA-5)

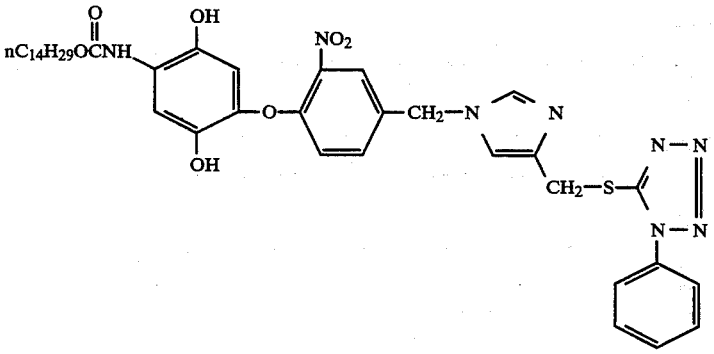

The compounds of the present invention can be synthesized by methods described in, e.g., U.S. Pat. Nos. 4,847,383, 4,770,990, 4,684,604, and 4,886,736, JP-A-60-218645, JP-A-61-230135, and Japanese Patent Application Nos. 2-37070, 2-170832, and 2-251192, or methods similar to these methods.

Specific synthesis examples will be described below.

(Synthesis Example 1) Synthesis of exemplified compound (CA-1)

The compound was synthesized by the following synthesis route.

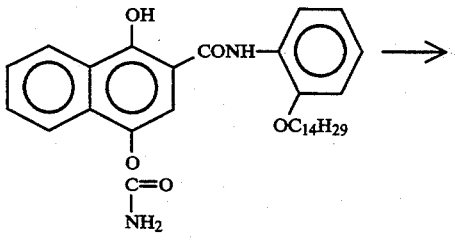

CA-1a

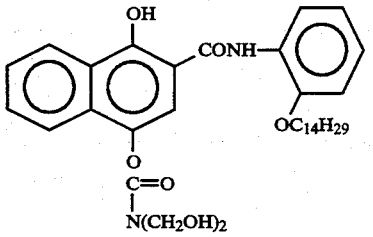

CA-1b

-continued

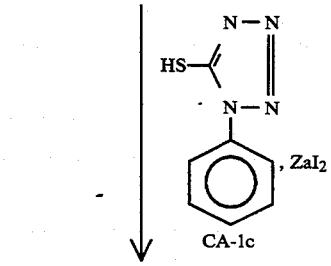

CA-1c

Exemplified Compound (CA-1)

CA-1a (10.7 g) and a 37% aqueous formalin solution (30 ml) were reacted in acetic acid (100 ml) at 70° C. for five hours, and the solvent was distilled off under reduced pressure. The residue was purified through a silica gel column chromatography (ethyl acetate-hexane 2:1) to obtain 6.4 g (yield=53%) of CA-1b.

CA-1b (3.2 g) and CA-1c (2.1 g) were suspended in chloroform (40 ml), and zinc iodide (5.7 g) was added to the suspension to cause a reaction at room temperature for two hours. 1N hydrochloric acid was added to stop the reaction, and the resultant solution was diluted with 40 ml of chloroform. The reaction solution was washed with water twice. The organic layer was dried over sodium sulfate and condensed, and the obtained residue was purified through a silica gel column chromatography (ethyl acetate-hexane 1:4), thereby obtaining 4.1 g (yield=25%) of the exemplified compound (CA-1). The structure was confirmed by NMR, mass spectrometric analysis, and elemental analysis.

(Synthesis Example 2) Synthesis of exemplified compound (CB-2)

The compound was synthesized by the following synthesis route.

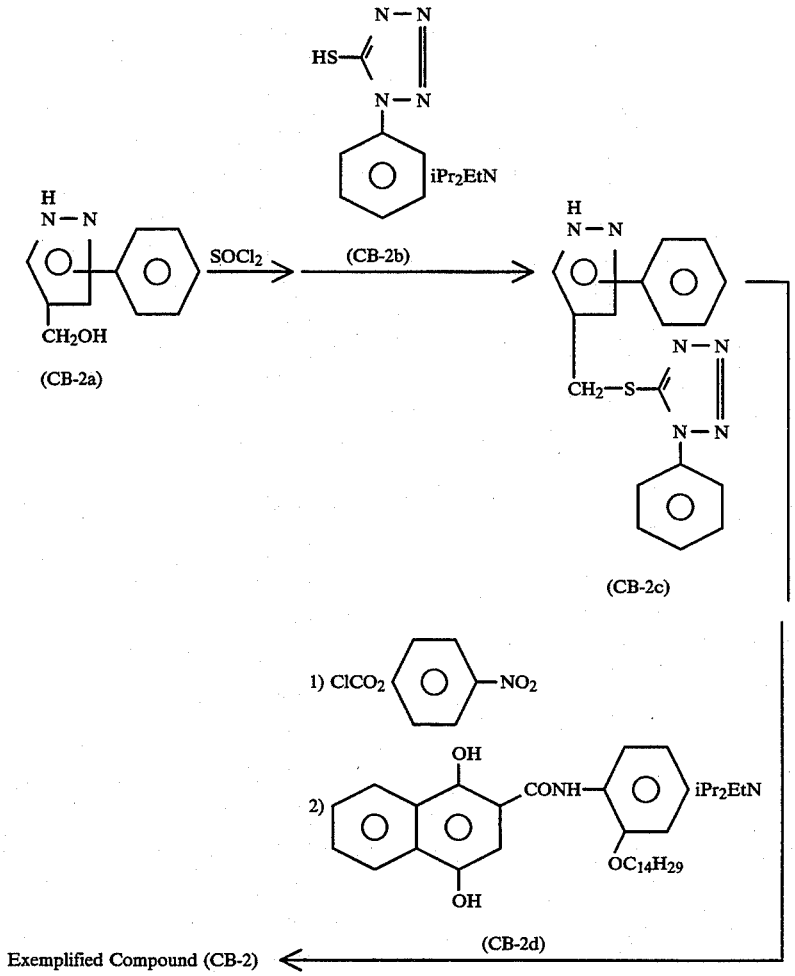

CB-2a (10 mmol) was suspended in chloroform (30 ml), and thionyl chloride (20 mmol) was added to the suspension to cause a reaction at 50° C. for one hour. Thereafter, the solvent was distilled off. The obtained residue was added to a dimethylformamide solution (30 ml) of CB-2b (10 mmol) and diisopropylethylamine (20 mmol) to cause a reaction for one hour, and the reaction solution was placed in ice water (200 ml). After 50 ml of chloroform were added and the resultant solution was stirred, the water phase was separated. The organic layer was washed with water (100 ml) twice and dried over sodium sulfate and condensed to obtain CB-2c.

The obtained CB-2c was dissolved in chloroform (30 ml), and nitrophenyl chlorocarbonate (10 mmol) was added to cause a reaction for one hour. An ethyl acetate solution (50 ml) of CB-2d (10 mmol) was added to the reaction solution, and diisopropylethylamine (50 mmol) was added to the resultant solution to cause a reaction for one hour. 1N hydrochloric acid (10 ml) was added to stop the reaction, and the resultant solution was diluted with ethyl acetate (10 ml). The organic layer was washed with water and dried over sodium sulfate and condensed. The obtained residue was purified through a silica gel column chromatography (eluent: ethyl acetate-hexane 1:3) to obtain 1.94 g (yield=23%) of the exemplified compound CB-2. The m.p. was 101.5° C. to 102.5° C.

(Synthesis Example 3) Synthesis of exemplified compound (CB-3)

The compound was synthesized by the following synthesis route.
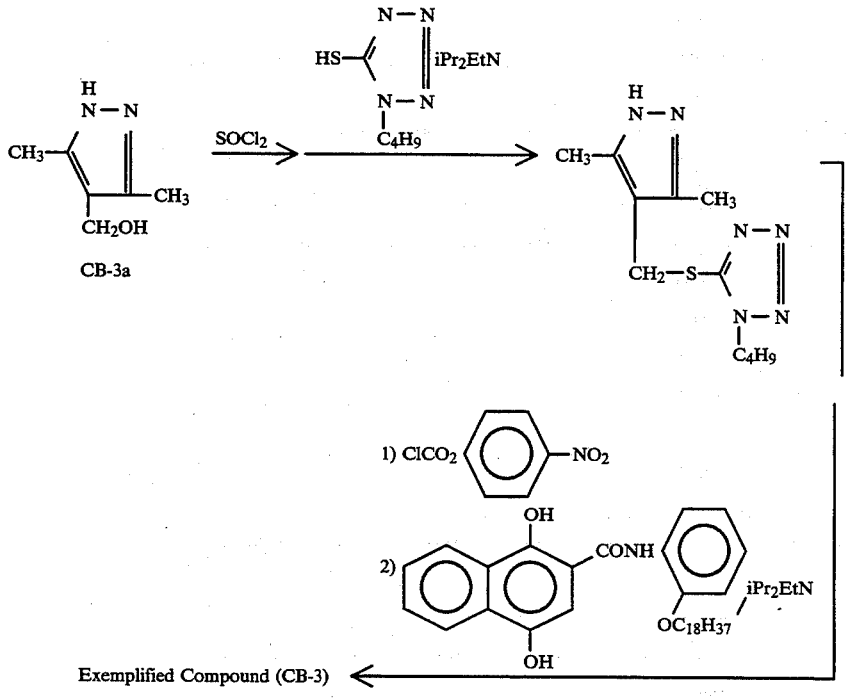
This compound could be synthesized by using (CB-3a) as a material, following the same procedures as for the exemplified compound CB-2. The yield was 31%. The m.p. was 68.0° C. to 69.0° C.
(Synthesis Example 4) Synthesis of exemplified compound (CB-16)
The compound was synthesized by the following synthesis route.
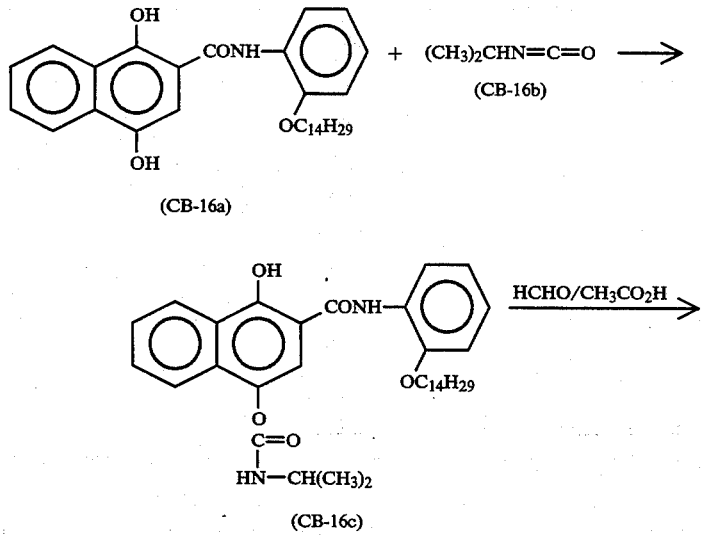

-continued

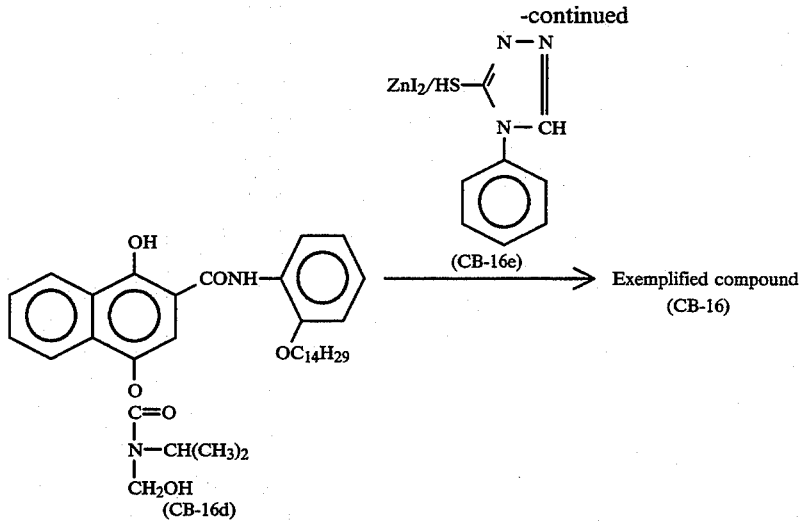

200 g of (CB-16a) and 34.7 g of (CB-16b) were dissolved in ethyl acetate (500 ml), and diisopropylethylamine (142 ml) was added to the solution. The resultant solution was stirred for four hours. Precipitated crystals were filtered out and washed with ethyl acetate to obtain 176 g (yield=75%) of (CB-16c).

53.6 g of (CB-16c) and paraformaldehyde (27.9 g) were reacted in a solution mixture of 1,2-dichloroethane (500 ml) and acetic acid (54 ml) under reflux for four hours. The reaction solution was cooled to room temperature and washed with water. The resultant solution was dried over sodium sulfate anhydride and condensed. The obtained residue was purified through a silica gel column chromatography using chloroform as an eluent to obtain 23.2 g (yield=41.2%) of (CB-16d).

23.2 g of (CB-16d) and 6.78 g of (CB-16e) were dissolved in chloroform (250 ml), and 26.88 g of zinc iodide were added to the solution. The resultant solution was stirred for three hours. After 1N hydrochloric acid was added to the solution, the reaction solution was washed with water. The organic layer was dried over sodium sulfate anhydride and condensed. The obtained residue was purified through a silica gel column chromatography (ethyl acetate-hexane 1:4) to obtain 7.0 g (yield=23.9%) of the exemplified compound (CB-16). The m.p. was 117.0° C. to 118.5° C.

(Synthesis Example 5) Synthesis of exemplified compound (CB-18)

The compound was synthesized following the same procedures as in Synthesis Example 4. The m.p. was 61.5° C. to 63.0° C.

(Synthesis Example 6) Synthesis of exemplified compound (CB-25)

The compound could be synthesized following the same procedures as in Synthesis Example 2 of JP-A-60-218645. The yield was 7%, and the m.p. was 115° C.

Compounds represented by Formula (I) and/or Formula (II) are preferably added to light-sensitive emulsion layers, and most preferably red-sensitive emulsion layers of a light-sensitive material. If an emulsion layer sensitive to one color is constituted by two or more layers having different sensitivities (e.g., high- and low-sensitivity layers or high-, medium-, and low-sensitivity layers), the compounds are preferably added to layers except for the lowest sensitivity layer.

The total addition amount of the compound of the invention to a light-sensitive material is $1.0\times10^{-7}$ to $1.0\times10^{-3}$ mol/m$^2$, preferably $5.0\times10^{-7}$ to $1.0\times10^{-4}$ mol/m$^2$, and more preferably $1.0\times10^{-6}$ to $5.0\times10^{-5}$ mol/m$^2$.

A pyrazolotriazole-based coupler of the present invention will be described below.

The pyrazolotriazole-based coupler can be represented by Formula (M) below.

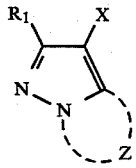

where $R_1$ represents a hydrogen atom or a substituent. Z represents a nonmetallic atom group required to form a 5-membered azole ring containing two to three nitrogen atoms. This azole ring may have a substituent (including a condensed ring). X represents a hydrogen atom or a group which can split off upon a coupling reaction with an oxidized form of a developing agent.

Of coupler skeletons represented by Formula (M), preferable skeletons are 1H-imidazo[1,2-b]pyrazole, 1H-pyrazolo[1,5-b][1,2,4]triazole, 1H-pyrazolo[5,1-c][1,2,4]triazole, and 1H-pyrazolo[1,5-d]tetrazole. These four skeletons are represented by the following Formulas (M-I), (M-II), (M-III), and (M-IV), respectively.

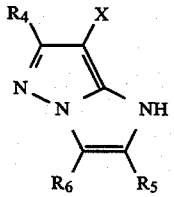

[M-I]

-continued

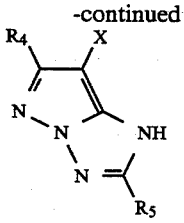

[M-II]

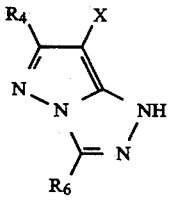

[M-III]

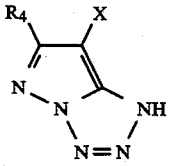

[M-IV]

Substituents $R_4$, $R_5$, and $R_6$ and X in these formulas will be described in detail below.

$R_4$ represents a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and an azolyl group. $R_4$ may be a divalent group, forming a bis form of the coupler.

More specifically, $R_4$ is a hydrogen atom, a halogen atom (e.g., chlorine or bromine), an alkyl group (e.g., a straight-chain or branched alkyl group having 1 to 32 carbon atoms, an aralkyl group, an alkenyl group, an alkinyl group, a cycloalkyl group, or a cycloalkenyl group, such as methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)-phenoxy]dodecaneami do}phenyl}propyl, 2-ethoxytridecyl, trifluoromethyl, cyclopentyl, 3-(2,4-di-t-amylphenoxy)propyl), an aryl group (e.g., phenyl, 4-t-butylphenyl, 2,4-di-t-amylphenyl, or 4-tetradecaneamidophenyl), a heterocyclic group (e.g., 2-furyl, 2-thienyl, 2-pyrimidinyl, or 2-benzothiazolyl), a cyano group, a hydroxyl group, a nitro group, a carboxyl group, an amino group, an alkoxy group (e.g., methoxy, ethoxy, 2-methoxyethoxy, 2-dodecylethoxy, or 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, or 3-methoxycarbamoylphenoxy), an acylamino group (e.g., acetoamide, benzamide, tetradecaneamide, 2-(2,4-di-t-amylphenoxy)-butaneamide, 4-(3-t-butyl-4-hydroxyphenoxy)butaneamide, 2-{4-(4-hydroxyphenylsulfonyl)phenoxy}decaneamide), an alkylamino group (e.g., methylamino, butylamino, dodecylamino, diethylamino, or methylbutylamino), an anilino group (e.g., phenylamino, 2-chloroanilino, 2-chloro-5-tetradecaneaminoanilino, 2-chloro-5-dodecyloxycarbonylanilino, N-acetylanilino, 2-chloro-5-{α-(3-t-butyl-4-hydroxyphenoxy)-dodecaneamido}anilino), a ureido group (e.g., phenylureido, methylureido, of N,N-dibutylureido), a sulfamoylamino group (e.g., N,N-dipropylsulfamoylamino or N-methyl-N-decylsulfamoylamino), an alkylthio group (e.g., methylthio, octylthio, tetradecylthio, 2-phenoxyethylthio, 3-phenoxypropylthio, or 3-(4-t-butylphenoxy)propylthio), an arylthio group (e.g., phenylthio, 2-butoxy-5-t-octylphenylthio, 3-pentadecylphenylthio, 2-carboxyphenylthio, or 4-tetradecaneamidophenylthio), an alkoxycarbonylamino group (e.g., methoxycarbonylamino or tetradecyloxycarbonylamino), a sulfonamide group (e.g., methanesulfonamide, hexadecanesulfonamide, benzenesulfonamide, p-toluenesulfonamide, octadecanesulfonamide, or 2-methyloxy-5-t-butylbenzenesulfonamide), a carbamoyl group (e.g., N-ethylcarbamoyl, N,N-dibutylcarbamoyl, N-(2-dodecyloxyethyl)carbamoyl, N-methyl-N-dodecylcarbamoyl, or N-{3-(2,4-di-t-amylphenoxy)-propyl}carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, or N,N-diethylsulfamoyl), a sulfonyl group (e.g., methanesulfonyl, octanesulfonyl, benzenesulfonyl, or toluenesulfonyl), an alkoxycarbonyl group (e.g., methoxycarbonyl, butyloxycarbonyl, dodecyloxycarbonyl, or octadecyloxycarbonyl), a heterocyclic oxy group (e.g., 1-phenyltetrazole-5-oxy or 2-tetrahydropyranyloxy), an azo group (e.g., phenylazo, 4-methoxyphenylazo, 4-pybaloylaminophenylazo, or 2-hydroxy-4-propanoylphenylazo), an acyloxy group (e.g., acetoxy), a carbamoyloxy group (e.g., N-methylcarbamoyloxy or N-phenylcarbamoyloxy), a silyloxy group (e.g., trimethylsilyloxy or dibutylmethylsilyloxy), an aryloxycarbonylamino group (e.g., phenoxycarbonylamino), an imide group (e.g., N-succinimide, N-phthalimide, or 3-octadecenylsuccinimide), a heterocyclic thio group (e.g., 2-benzothiazolylthio, 2,4-di-phenoxy-1,3,5-triazole-6-thio, or 2-pyridylthio), a sulfinyl group (e.g., dodecanesulfinyl, 3-pentadecylphenylsulfinyl, or 3-phenoxypropylsulfinyl), a phosphonyl group (e.g., phenoxyphosphonyl, octyloxyphosphonyl, or phenylphosphonyl), an aryloxycarbonyl group (e.g., phenoxycarbonyl), an acyl group (e.g., acetyl, 3-phenylpropanoyl, benzoyl, or 4-dodecyloxybenzoyl), or an azolyl group (e.g., imidazolyl, pyrazolyl, 3-chloro-pyrazole-1-yl, or triazolyl). Of these substituents, a group which can further have a substituent may further have an organic substituent, which is bonded to a carbon atom, an oxygen atom, a nitrogen atom, or a sulfur atom, or a halogen atom.

Of these substituents, preferable examples of $R_4$ are an alkyl group, an aryl group, an alkoxy group, an aryloxy group, an alkylthio group, a ureido group, a urethane group, and an acylamino group.

$R_5$ represents groups similar to the substituents enumerated above for $R_4$ and is preferably a hydrogen atom, an alkyl group, an aryl group, a heterocyclic group, an alkoxycarbonyl group, a carbamoyl group, sulfamoyl group, a sulfinyl group, an acyl group, or a cyano group.

$R_6$ represents groups having the same meanings as the substituents enumerated for $R_4$ and is preferably a hydrogen atom, an alkyl group, an aryl group, a heterocyclic group, an alkoxy group, an aryloxy group, an alkylthio group, an arylthio group, an alkoxycarbonyl group, a carbamoyl group, or an acyl group, and more preferably an alkyl group, an aryl group, a heterocyclic group, an alkylthio group, or an arylthio group.

X represents a hydrogen atom or a group which can split off upon a reaction with an oxidized form of an aromatic primary amine color developing agent. Specific examples of the split-off group are a halogen atom, an alkoxy group, an aryloxy group, an acyloxy group, an alkylsulfonyloxy or arylsulfonyloxy group, an acylamino group, an alkylsulfonamide or arylsulfonamide group, an alkoxycarbonyloxy group, an aryloxycarbonyloxy group, an alkylthio, arylthio, or heterocyclic thio group, a carbamoylamino group, a 5- or 6-membered nitrogen-containing heterocyclic group, an imide group, and an arylazo group. These groups may be further substituted by groups permitted as the substituents for $R_4$.

More specifically, examples of X are a halogen atom (e.g., fluorine, chlorine, and bromine), an alkoxy group (e.g., ethoxy, dodecyloxy, methoxyethylcarbamoylmethoxy, carboxypropyloxy, methylsulfonylethoxy, and ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, and 2-carboxyphenoxy), an acyloxy group (e.g., acetoxy, tetradecanoyloxy, and benzoyloxy), alkylsulfonyloxy and arylsulfonyloxy groups (e.g., methanesulfonyloxy and toluenesulfonyloxy), an acylamino group (e.g., dichloroacetylamino and heptafluorobutyrylamino), alkylsulfonamide and arylsulfonamide groups (e.g., methanesulfonamino, trifluoromethanesulfonamino, and p-toluenesulfonylamino), an alkoxycarbonyloxy group (e.g., ethoxycarbonyloxy and benzyloxycarbonyloxy), an aryloxycarbonyloxy group (e.g., phenoxycarbonyloxy), alkylthio, arylthio, and heterocyclic thio groups (e.g., dodecylthio, 1-carboxydodecylthio, phenylthio, 2-butoxy-5-t-octylphenylthio, and tetrazolylthio), a carbamoylamino group (e.g., N-methylcarbamoylamino and N-phenylcarbamoylamino), a 5- or 6-membered nitrogen-containing heterocyclic group (e.g., imidazolyl, pyrazolyl, triazolyl, tetrazolyl, and 1,2-dihydro-2-oxo-1-pyridyl), an imide group (e.g., succinimide and hydantoinyl), and an arylazo group (e.g., phenylazo and 4-methoxyphenylazo). In addition, X sometimes takes a form of a bis-type coupler obtained by condensing 4-equivalent coupler with aldehydes or ketones, as a split-off group which is bonded via a carbon atom. Also, X can contain a photographically useful group such as a development inhibitor or a development accelerator. Preferable examples of X are a halogen atom, an alkoxy group, an aryloxy group, an alkylthio or arylthio group, and a 5- or 6-membered nitrogen-containing heterocyclic group which bonds to a coupling active position by a nitrogen atom.

Examples of a compound of a coupler represented by Formula (M) will be presented below. However, the present invention is not limited to these examples.

(M-1)

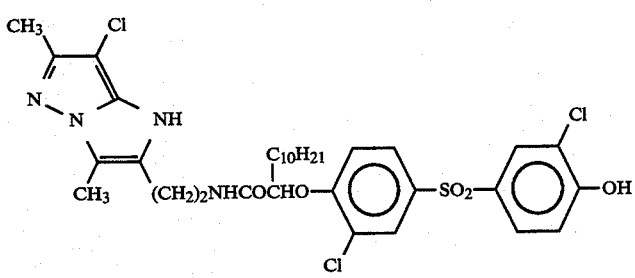

(M-2)

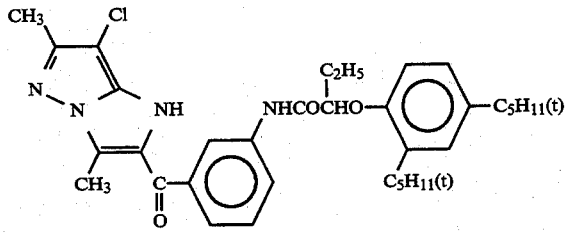

-continued
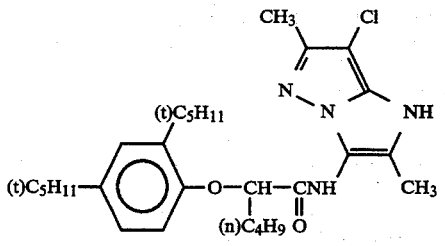
(M-3)
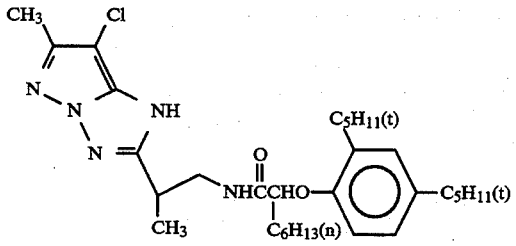
(M-4)
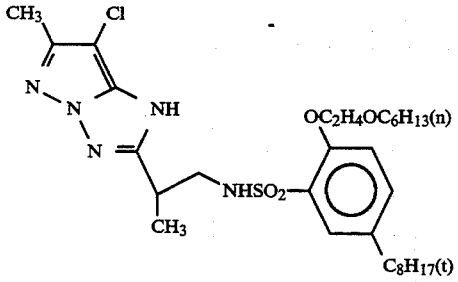
(M-5)
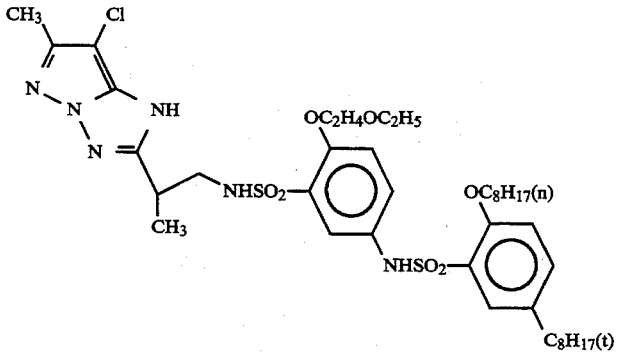
(M-6)
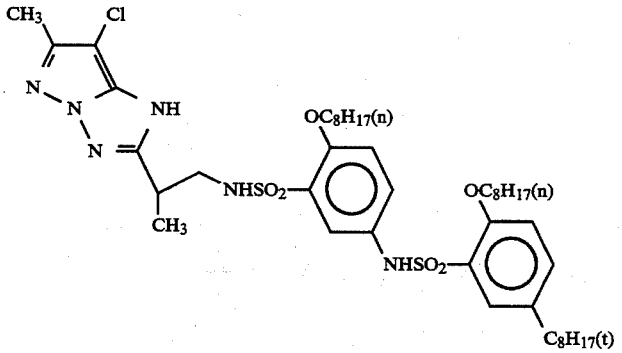
(M-7)

-continued
(M-8)
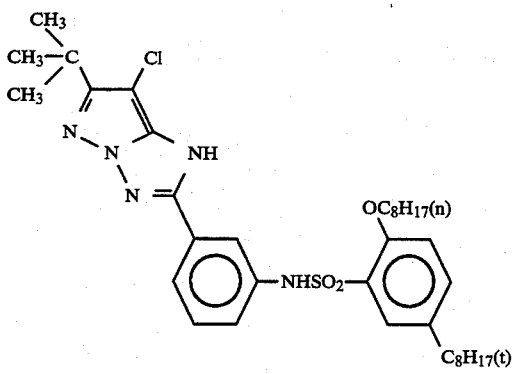
(M-9)
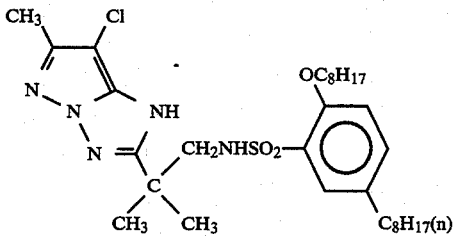
(M-10)
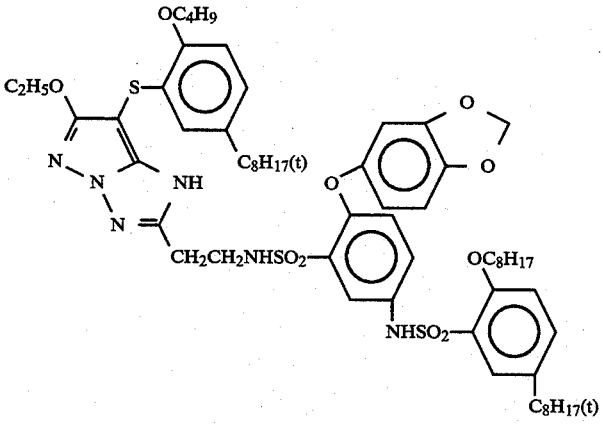
(M-11)
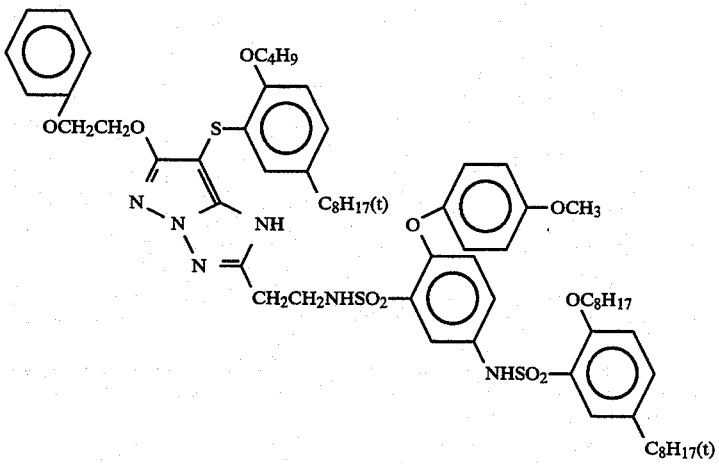

-continued
(M-12)
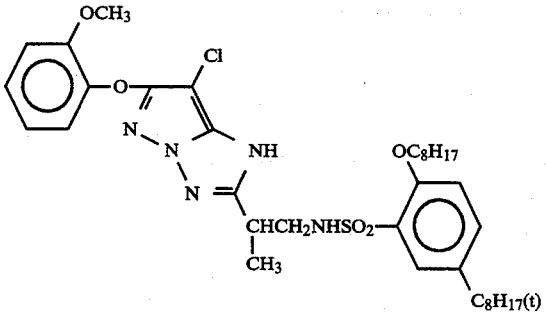
(M-13)
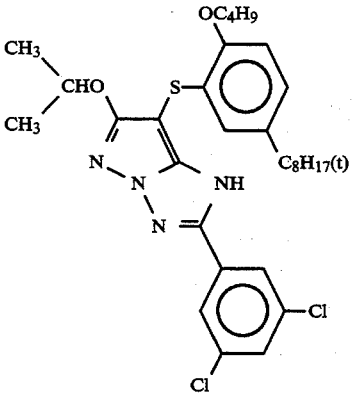
(M-14)
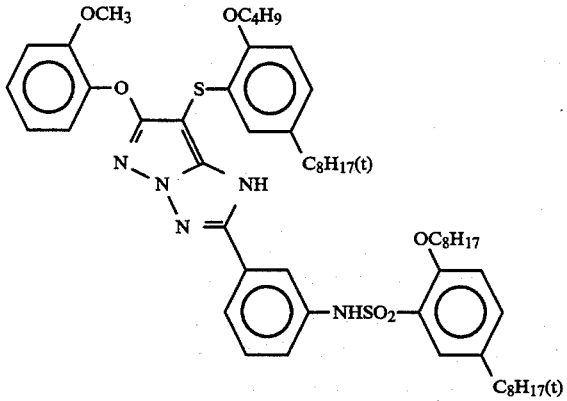
(M-15)
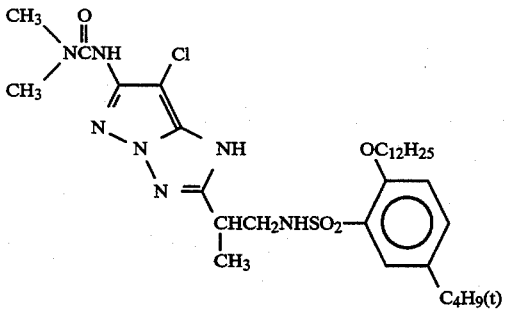
(M-16)
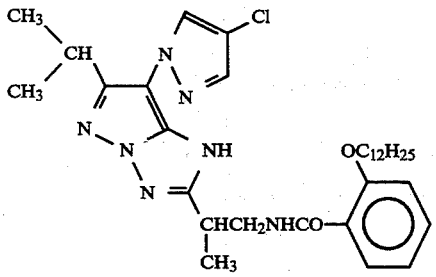

-continued
(M-17)
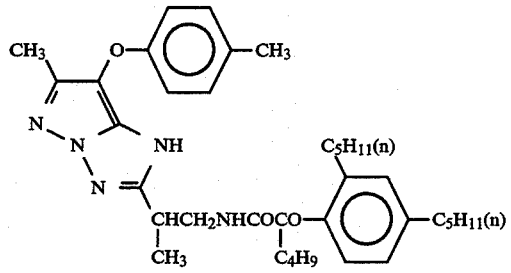
(M-18)
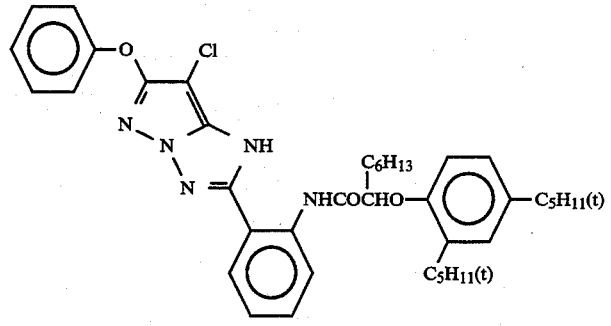
(M-19)
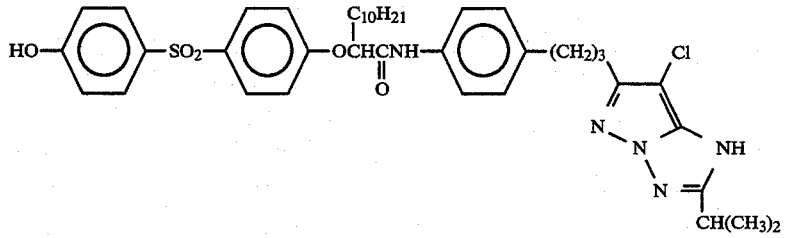
(M-20)
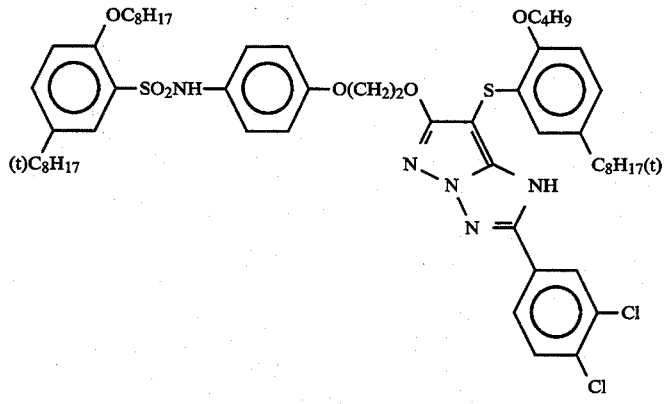
(M-21)
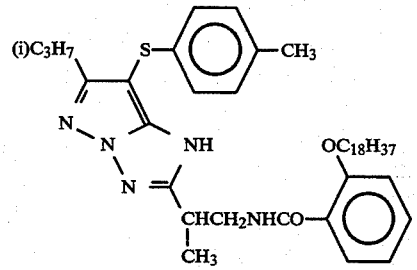

-continued
(M-22)
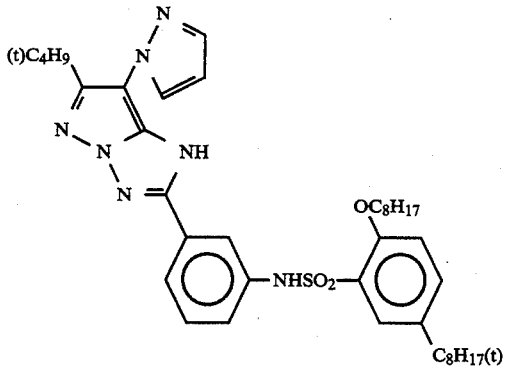
(M-23)
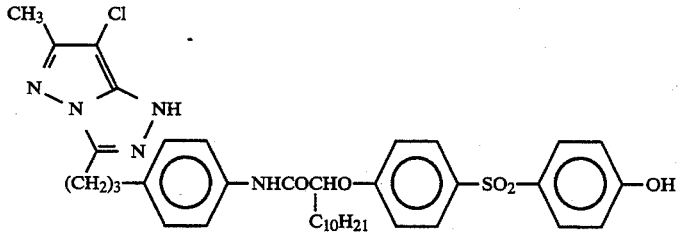
(M-24)
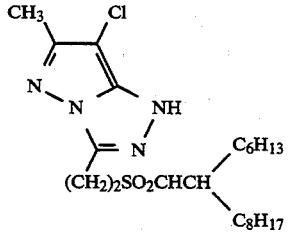
(M-25)
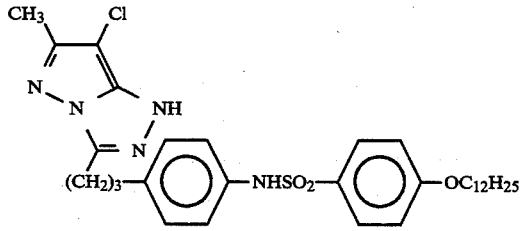
(M-26)
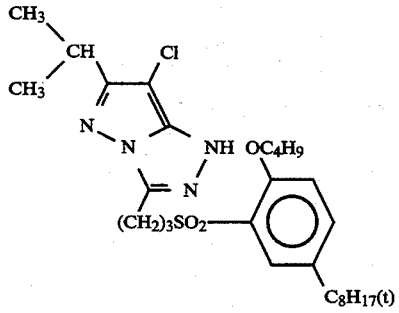

-continued
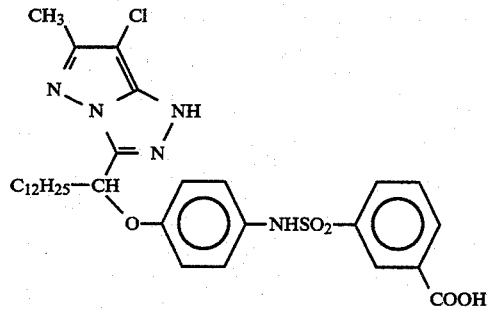
(M-27)
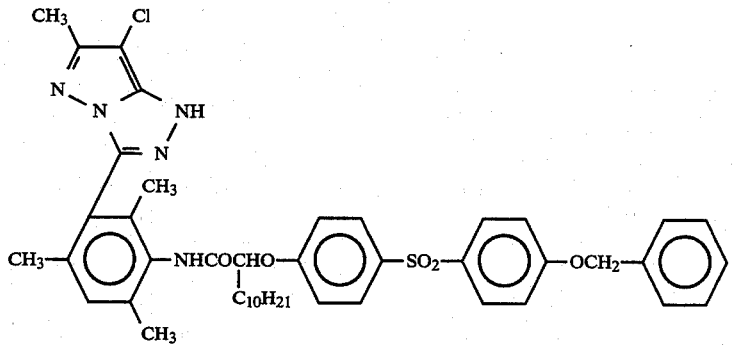
(M-28)
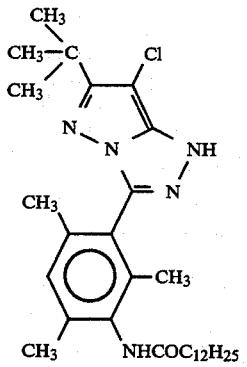
(M-29)
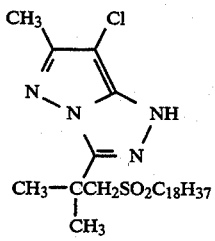
(M-30)
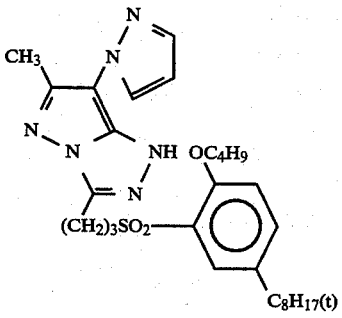
(M-31)

-continued
(M-32)
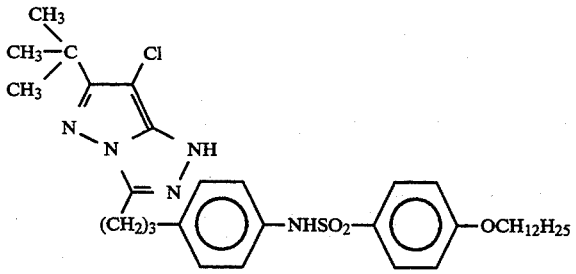
(M-33)
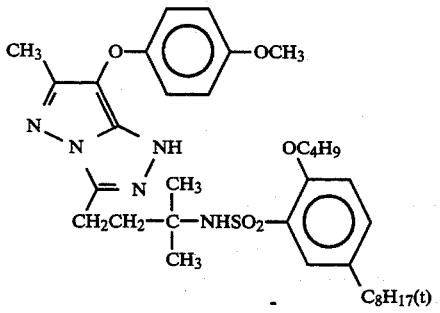
(M-34)
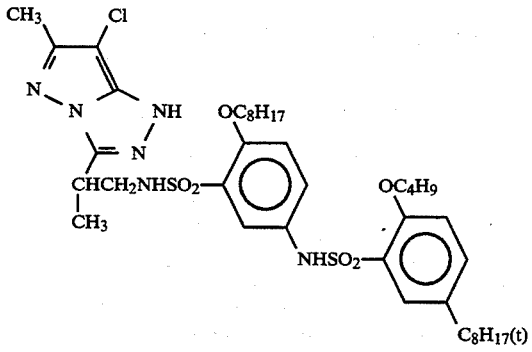
(M-35)
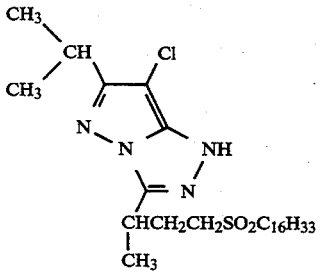
(M-36)
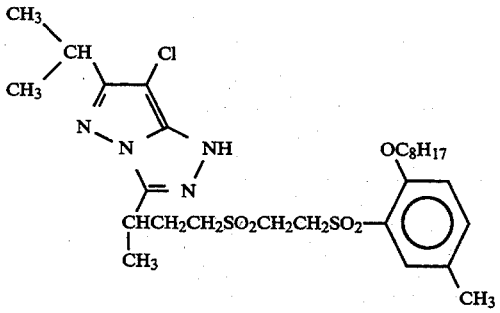

-continued
(M-37)
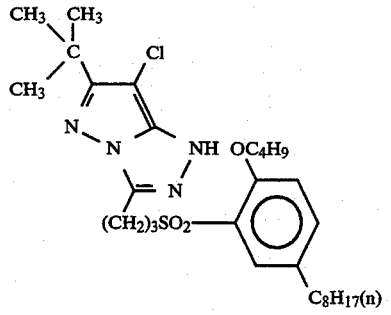
(M-38)
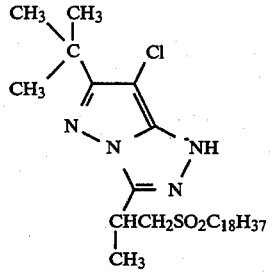
(M-39)
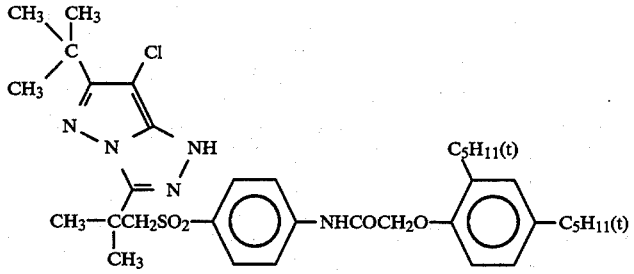
(M-40)
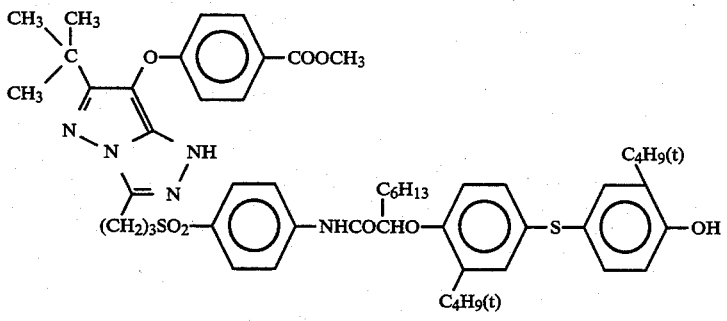
(M-41)
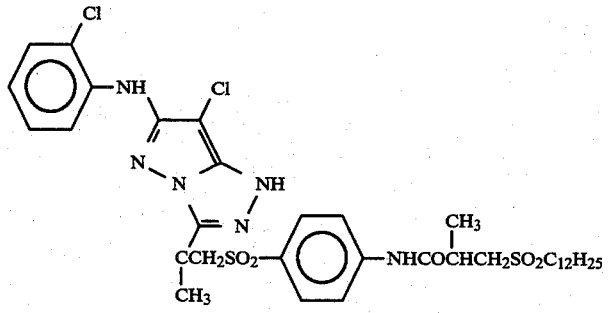

-continued
(M-42)
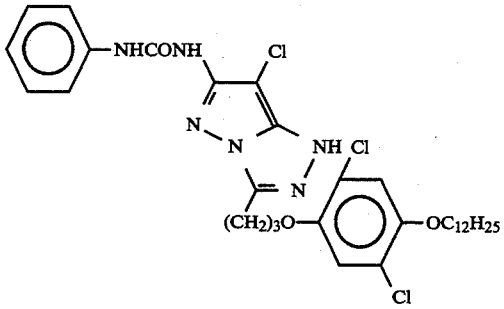
(M-43)
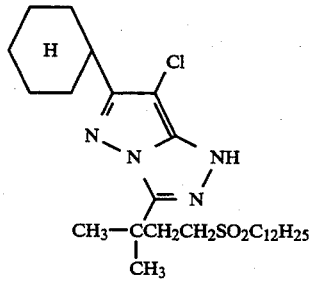
(M-44)
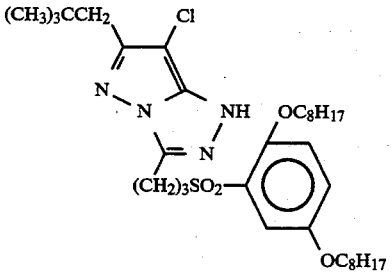
(M-45)
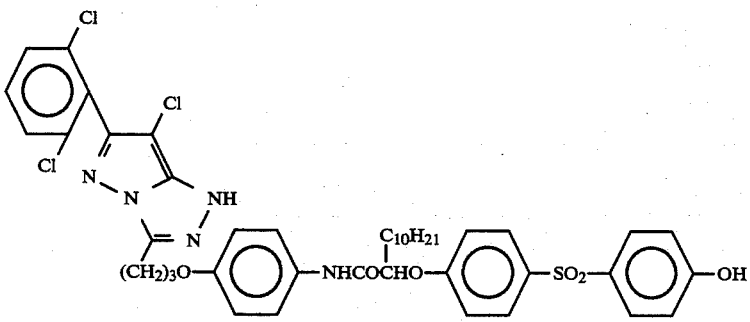
(M-46)
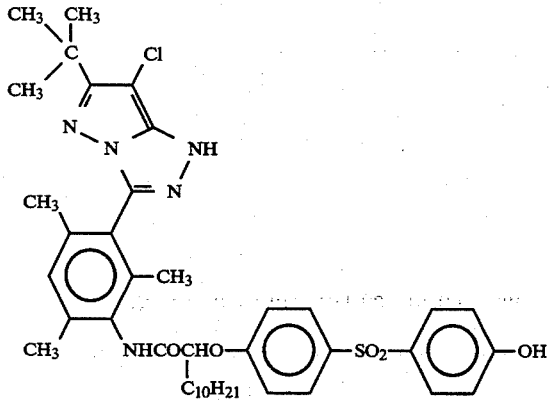

-continued
(M-47)
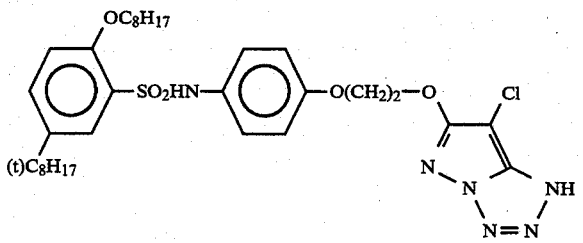
(M-48)
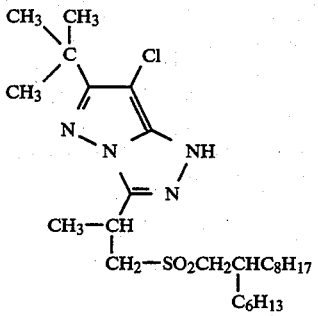
(M-49)
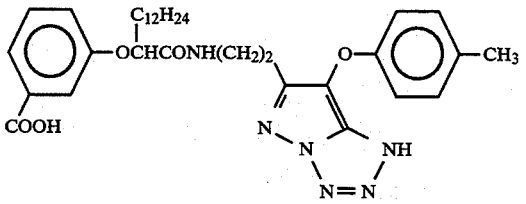
(M-50)
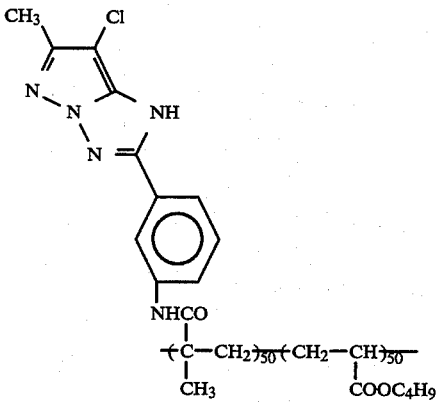
(M-51)
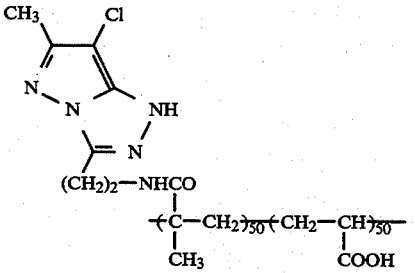

-continued (M-52)

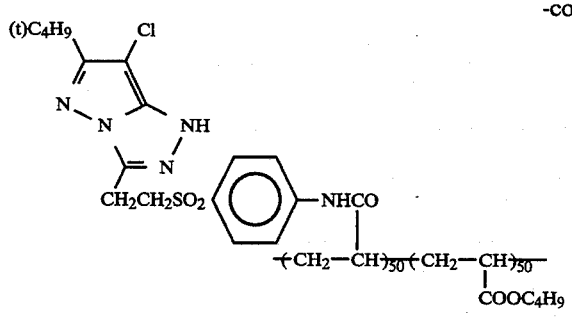

(M-53)

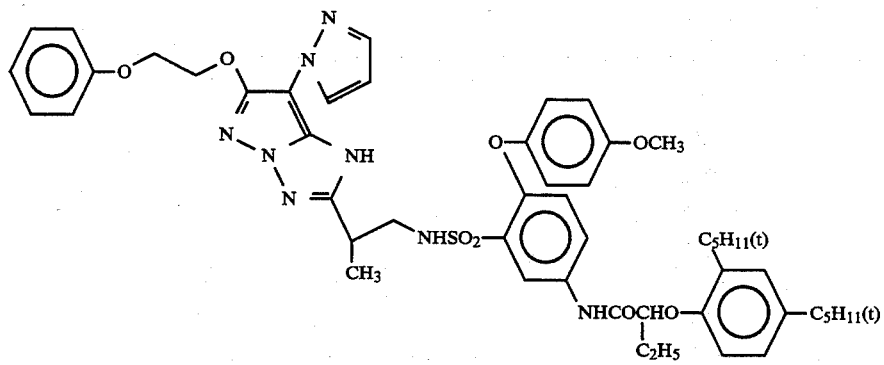

(M-54)

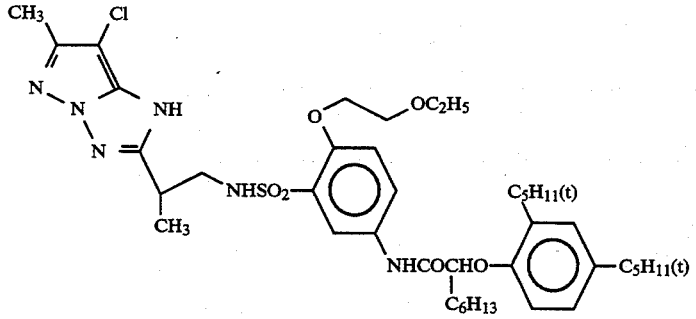

References describing methods of synthesizing couplers represented by Formula (M) will be enumerated below.

A compound represented by Formula (M-I) can be synthesized by a method described in, e.g., U.S. Pat. No. 4,500,630. A compound represented by Formula (M-II) can be synthesized by methods described in, e.g., U.S. Pat. Nos. 4,540,654 and 4,705,863, JP-A-61-65245, JP-A-62-209457, and JP-A-62-249155. A compound represented by Formula (M-III) can be synthesized by methods described in, e.g., JP-B-47-27411 and U.S. Pat. No. 3,725,067. A compound represented by Formula (M-IV) can be synthesized by a method described in, e.g., JP-A-60-33552.

Although a coupler represented by Formula (M) can be added to any layer of a light-sensitive material, it is preferably added to light-sensitive emulsion layers. Most preferably, the coupler is added to green-sensitive emulsion layers or light-sensitive emulsion layers having central sensitivities of 500 to 560 nm, which are described in JP-A-61-34541.

The total addition amount of the coupler of the invention to a light-sensitive material is 0.001 to 1.0 g/m$^2$, preferably 0.01 to 0.80 g/m$^2$, and more preferably 0.10 to 0.50 g/m$^2$.

In the present invention, in order to further improve graininess, color reproducibility, sharpness, and desilvering properties, it is preferred to use a compound (bleaching accelerator-releasing compound) which reacts with an oxidized form of an aromatic primary amine-based developing agent to release a bleaching accelerator. The bleaching accelerator-releasing compound can be preferably represented by Formula (B) below.

Formula (B)

$$A-(L_1)_i-Z_4$$

wherein A represents a group which reacts with an oxidized form of a developing agent to cleave $(L_1)_i-Z_4$, $L_1$ represents a group which cleaves Z after the bond with A is cleaved, i represents 0 or 1, and $Z_4$ represents a bleaching accelerator.

A compound represented by Formula (B) will be described below.

In Formula (B), A and $L_1$ have the same meanings as described above in Formula (I).

In Formula (B), A preferably represents a coupler moiety.

In Formula (B), a group represented by $Z_4$ is specifically a well-known bleaching accelerator group. Examples are various mercapto compounds described in U.S. Pat. No. 3,893,858, British Patent 1,138,842, JP-A-53-141623, a compound having a disulfide bond described in JP-A-53-95630, a thiazolidine derivative described in JP-B-53-9854, an isothiourea derivative described in JP-A-53-94927, thiourea derivatives described in JP-B-45-8506 and JP-B-49-26586, a thioamide compound described in JP-A-49-42349, dithiocarbamates described in JP-A-55-26506, and arylenediamine compound described in U.S. Pat. No. 4,552,834. Each of these compounds is preferably bonded to A—(L1)i— in Formula (B) at a substitutable hetero atom contained in the molecule.

A group represented by $Z_4$ is preferably a group represented by Formula (V), (VI), or (VII) below.

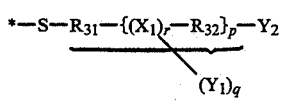

Formula (V)

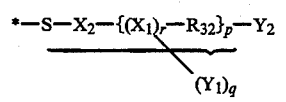

Formula (VI)

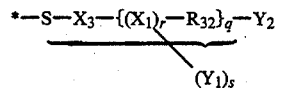

Formula (VII)

wherein a symbol * represents a position to be bonded to A—$(L_1)_i$—, $R_{31}$ represents a divalent aliphatic group having 1 to 8, and preferably 1 to 5 carbon atoms, $R_{32}$ represents a group having the same meaning as $R_{31}$, a divalent aromatic group having 6 to 10 carbon atoms, or a 3- to 8-membered, and preferably 5- or 6-membered divalent heterocyclic group, $X_1$ represents an —O— group, an —S— group, a —COO— group, an —$SO_2$— group, an —$NR_{33}$— group, an —$NR_{33}$—CO— group, an —$NR_{33}$—$SO_2$— group, an —S—CO— group, a —CO— group, an —$NR_{33}$—COO— group, an —N=$CR_{33}$— group, an —$NR_{33}$CO—$NR_{34}$— group, or an —$NR_{33}SO_2NR_{34}$— group, $X_2$ represents an aromatic group having 6 to 10 carbon atoms, $X_3$ represents a 3- to 8-membered, and preferably 5- or 6-membered heterocyclic group having at least one carbon atom to be bonded to S in its ring, $Y_1$ represents a carboxyl group or its salt, a sulfo group or its salt, a hydroxyl group, a phosphonic acid group or its salt, an amino group (which may be substituted by an aliphatic group having 1 to 4 carbon atoms), an —$NHSO_2$—$R_{35}$ group, or an —$SO_2NH$—$R_{35}$ group (in this case, a salt means, e.g., sodium salt, potassium salt, or ammonium salt), $Y_2$ represents groups having the same meanings as described above for $Y_1$ or a hydrogen atom, r represents 0 or 1, p represents an integer from 0 to 4, q represents an integer from 1 to 4, and s represents an integer from 0 to 4. Note that q $Y_1$'s are bonded at substitutable positions of $R_{31}$—$\{(X_1)_r$—$R_{32}\}_p$ and $X_2$—$\{(X_1)_r$—$R_{32}\}_p$, and s $Y_1$'s are bonded at substitutable positions of $X_3$—$\{(X_1)_r$—$R_{32}\}_p$. If s and q are the plural numbers, s Y1's and q Y1's represent the same group or different groups. If p is the plural number, p $(X_1)_r$—$R_{32}$'s represent the same group or different groups. Each of $R_{33}$, $R_{34}$, and $R_{35}$ represents a hydrogen atom or an aliphatic group having 1 to 8, and preferably 1 to 5 carbon atoms. When each of $R_{31}$ to $R_{35}$ represents the aliphatic group, the group may be chained or cyclic, straight-chain or branched, saturated or unsaturated, and substituted or nonsubstituted. Although the group is preferably nonsubstituted, it can have substituents such as a halogen atom, an alkoxy group (e.g., methoxy and ethoxy), and an alkylthio group (e.g., methylthio and ethylthio).

Each of an aromatic group represented by $X_2$ and an aromatic group represented by $R_{32}$, when $R_{32}$ represents an aromatic group, may have substituents. Examples of the substituents are those enumerated above as the substituents of the aliphatic group.

Each of a heterocyclic group represented by $X_3$ and a heterocyclic group represented by $R_{32}$, when $R_{32}$ represents a heterocyclic group, is a saturated or unsaturated and substituted or nonsubstituted heterocyclic group having an oxygen atom, a sulfur atom, or a nitrogen atom as a hetero atom. Examples of the heterocyclic group are pyridine, imidazole, piperidine, oxirane, sulforane, imidazolidine, thiazepine, or pyrazole. Examples of the substituent are those enumerated above as the substituents of the aliphatic group.

Specific examples of a group represented by Formula (V) are as follows.

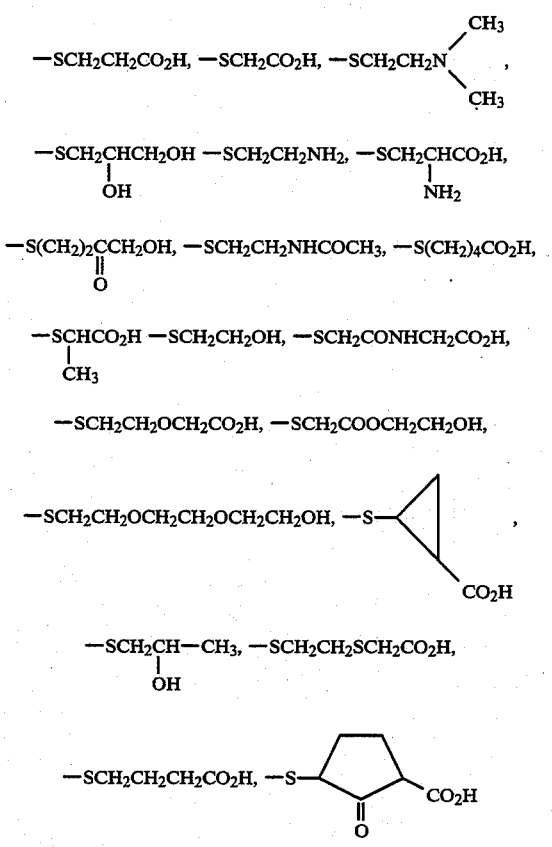

Specific examples of a group represented by Formula (VI) are as follows.

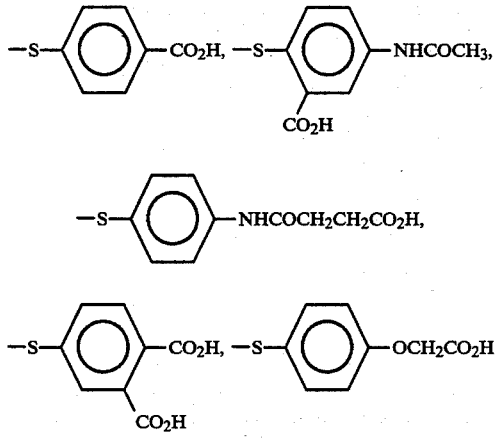
Specific examples of a group represented by Formula (VII) are as follows.
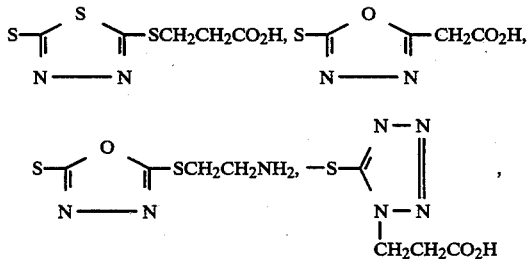
-continued
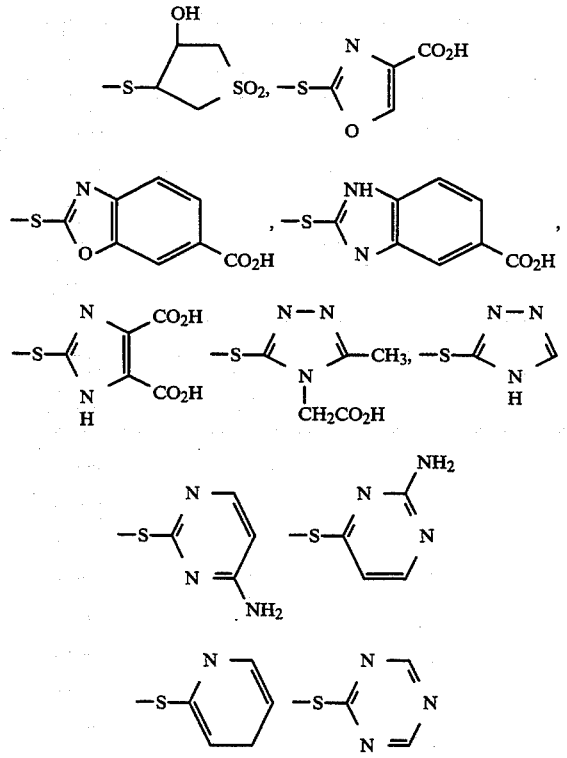
Specific examples of a bleaching accelerator-releasing compound, which can be preferably used in the present invention, will be described below. However, the present invention is not limited to these examples.
B-1
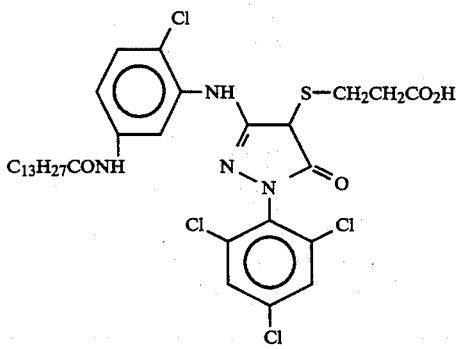
B-2
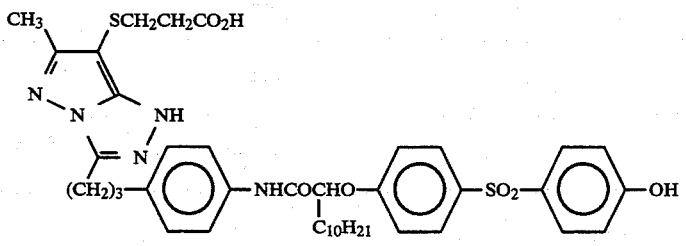

-continued
B-3
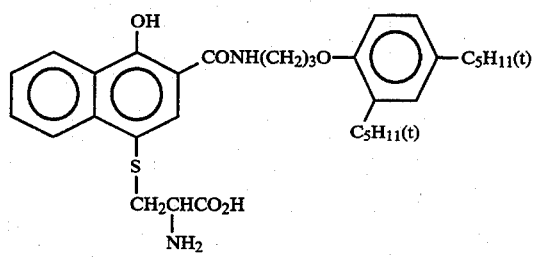
B-4
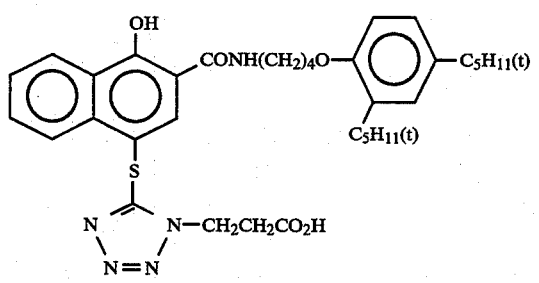
B-5
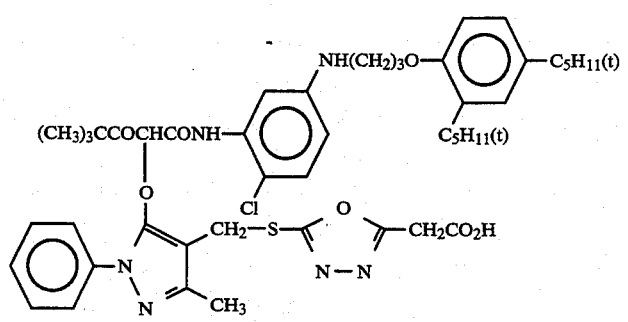
B-6
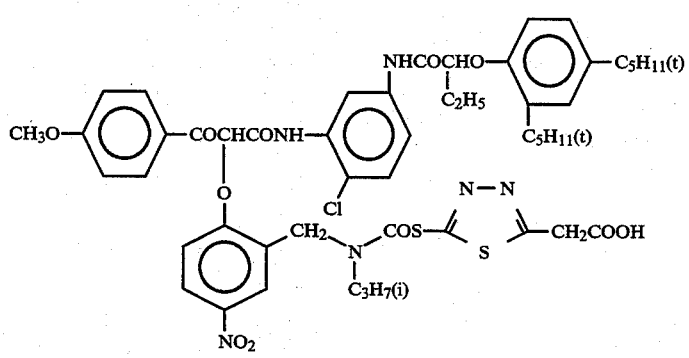
B-7
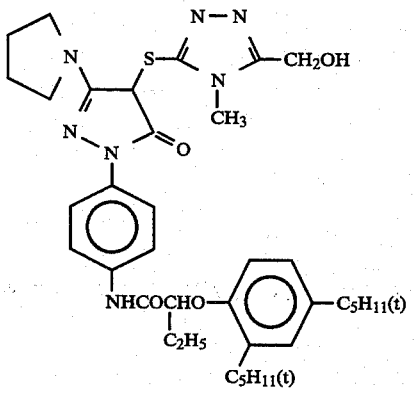

-continued
B-8
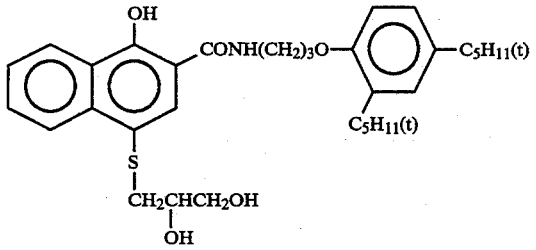
B-9
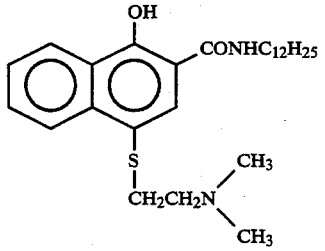
B-10
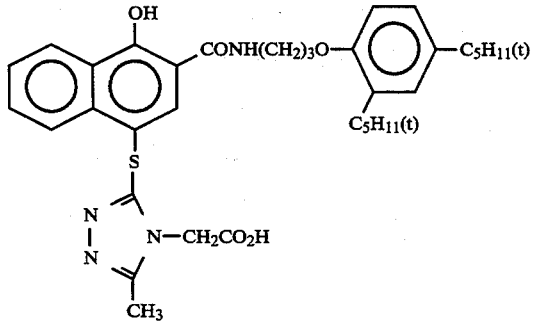
B-11
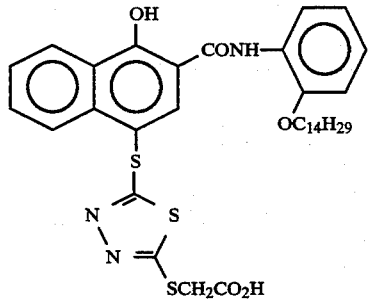
B-12
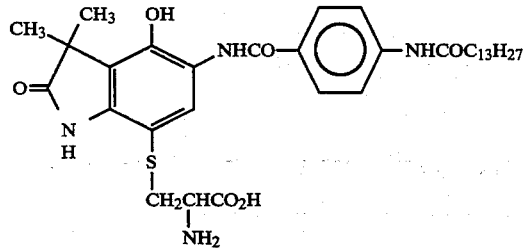

-continued
B-13
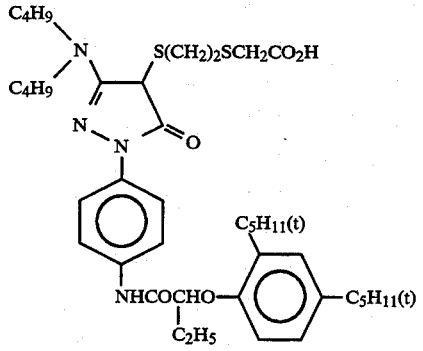
B-14
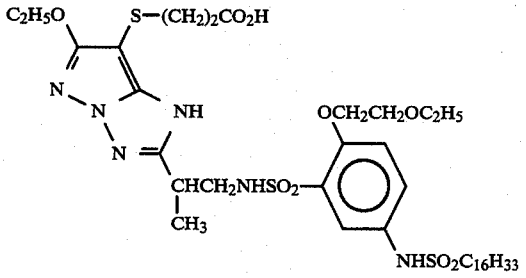
B-15
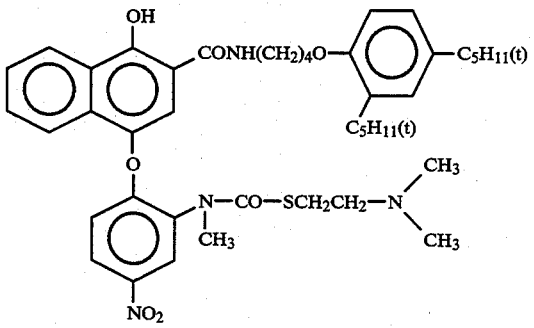
B-16
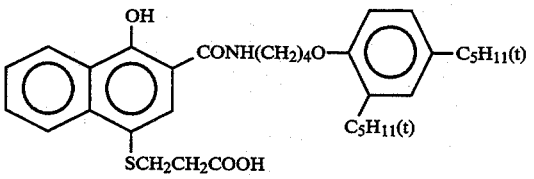
B-17
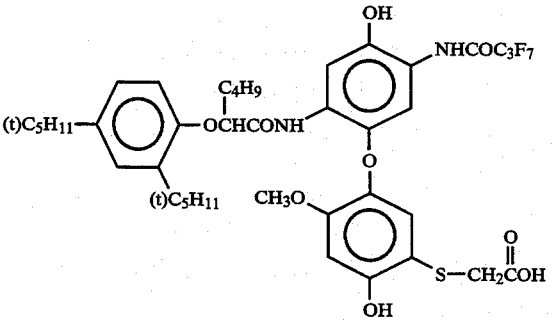

-continued
B-18
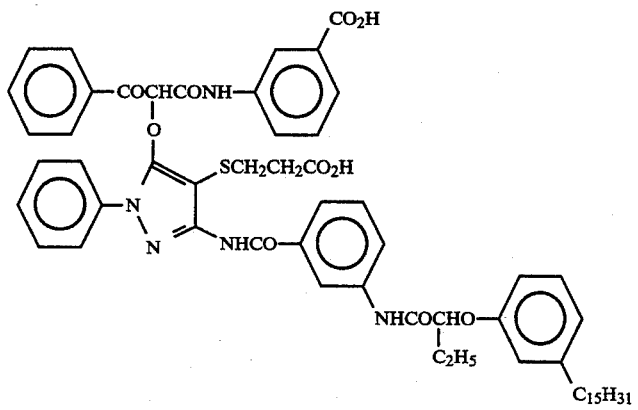
B-19
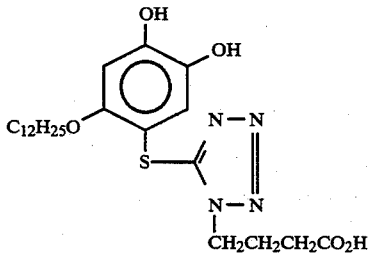
B-20
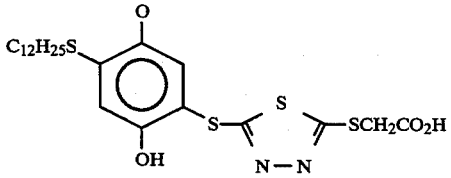
B-21
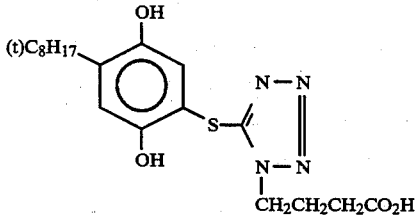
B-22
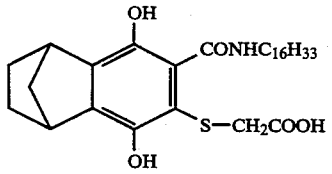
B-23
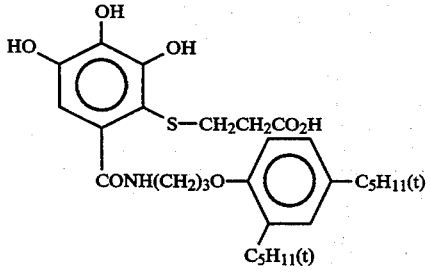

-continued

B-24

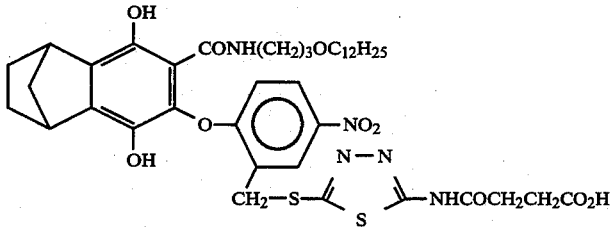

B-25

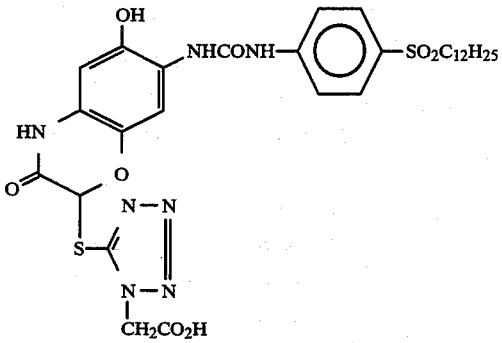

B-26

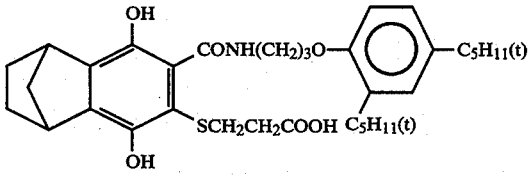

B-27

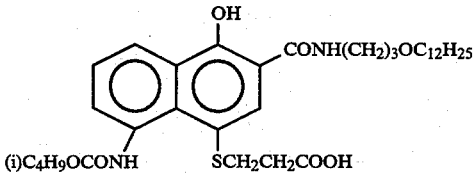

In addition, it is possible to similarly use compounds described in Research Disclosure Item Nos. 24241 and 11449, JP-A-61-201247, JP-A-63-106749, JP-A-63-121843, and JP-A-63-121844.

The bleaching accelerator releasing compounds for use in the present invention can be easily synthesized in accordance with the descriptions in the patent specifications cited above.

Although the addition amount of a compound represented by Formula (B) changes in accordance with the structure of the compound, it is preferably $1\times10^{-5}$ to 1 mol, and most preferably $1\times10^{-4}$ to 0.5 mol per mol of silver present in the same or adjacent layer.

The use of the color photographic light-sensitive material of the present invention obtained as described above makes it possible to obtain a color photographic light-sensitive material superior in graininess, sharpness, color reproducibility, and desilvering properties. However, addition of a compound having the following structure represented by Formula (D) to the color photographic light-sensitive material can further improve the sharpness and the color reproducibility.

Formula (D)

$$A_1-(L_{11})_v-B-(L_{12})_w-DI$$

where $A_1$ represents a group which reacts with an oxidized form of a developing agent to cleave $(L_{11})_v-B-(L_{12})_w-DI$, $L_{11}$ represents a coupling group which cleaves its bond with B after its bond with $A_1$ is cleaved, B represents a group which reacts with an oxidized form of a developing agent to cleave $(L_{12})_w$-DI, $L_{12}$ represents a group which cleaves DI after its bond with B is cleaved, DI represents a developing inhibitor, and each of v and w represents an integer of 0 to 2. When each of v and w represents 2, two $L_{11}$'s and two $L_{12}$'s may be different or the same.

A compound represented by Formula (D) will be described in more detail below.

A compound represented by Formula (D) cleaves DI through the following reaction process during development.

$$A_1-(L_{11})_v-B-(L_{12})_w-DI \xrightarrow{QDI}$$

$$(L_{11})_v-B-(L_{12})_w-DI \longrightarrow B-(L_{12})_w-DI \xrightarrow{QDI}$$

$$(L_{12})_w-DI \longrightarrow DI$$

where $A_1$, $L_{11}$, v, B, $L_{12}$, w, and DI have the same meanings as described above for Formula (D), and QDI represents an oxidized form of a developing agent.

Representative examples of a group indicated by B in Formula (D) will be presented below. In the following formulas, a symbol * represents a position to be bonded to $A_1$—$(L_{11})_v$ in Formula (D), and a symbol ** represents a position to which $(L_{12})_w$—DI in Formula (D) is bonded.

(B-1)

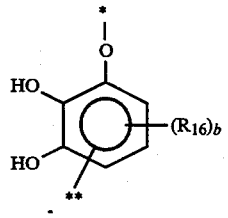

(B-2)

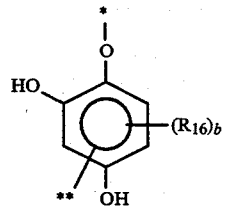

(B-3)

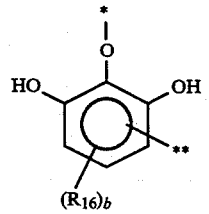

(B-4)

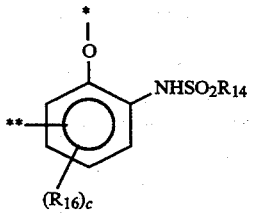

(B-5)

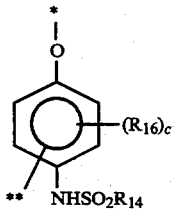

(B-6)

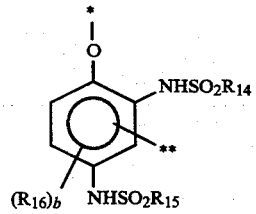

-continued (B-7)

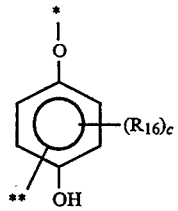

(B-8)

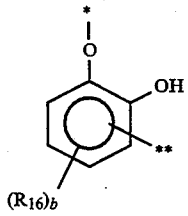

(B-9)

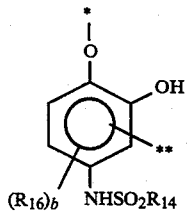

(B-10)

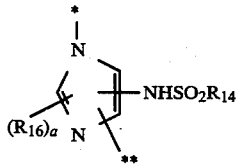

where $R_{16}$ has the same meaning as $R_{64}$, each of $R_{14}$ and $R_{15}$ has the same meaning as $R_{41}$, b represents an integer from 0 to 2, c represents an integer from 0 to 3, and a represents an integer 0 or 1.

When B is split off to form a compound having a reduction effect, specific examples of the compound are reducing agents described in U.S. Pat. Nos. 4,741,994 and 4,477,560, JP-A-61-102646, JP-A-61-107245, JP-A-61-113060, JP-A-64-13547, JP-A-64-13548, and JP-A-64-73346.

As a group indicated by DI in Formula (D), conventionally known development inhibitors are used. For example, a heterocyclic mercapto group, a 1-indazolyl group, or a triazolyl group is preferably used. More specifically, examples of the development inhibitor are a tetrazolylthio group, a thiadiazolylthio group, an oxadiazolylthio group, a triazolylthio group, a benzoxazolylthio group, a benzothiazolylthio group, a benzoimidazolylthio group, a 1-(or 2-)benzotriazolyl group, a 1,2,4-triazol-1-(or 4-)yl group, and a 1-indazolyl group. When these groups have substituents, examples of the substituents are an aliphatic group, an aromatic group, a heterocyclic group, and the substituents enumerated above as substituents which an aromatic group can have.

A compound represented by Formula (D) which constitutes the present invention can be synthesized by methods described in U.S. Pat. Nos. 4,618,571 and 4,770,982, JP-A-63-284159, JP-A-60-203943, and JP-A-63-23152.

Specific examples of a compound represented by Formula (D) of the present invention will be presented below, but the present invention is not limited to these examples.
(I-1)
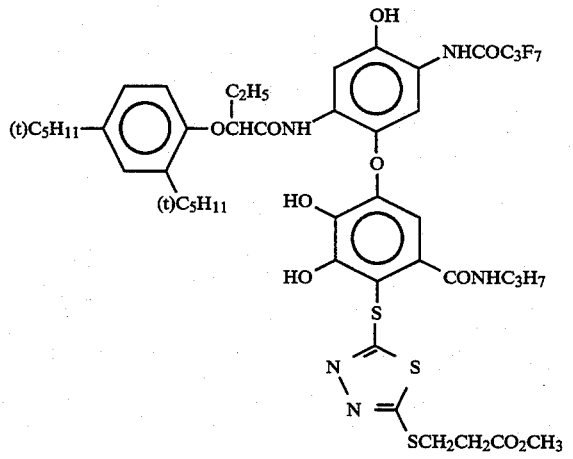
(I-2)
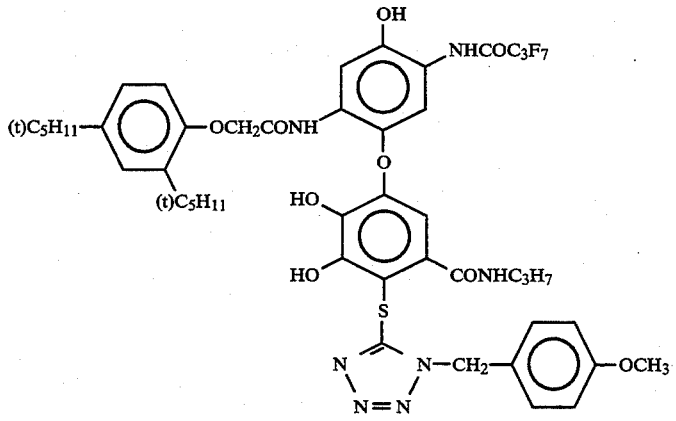
(I-3)
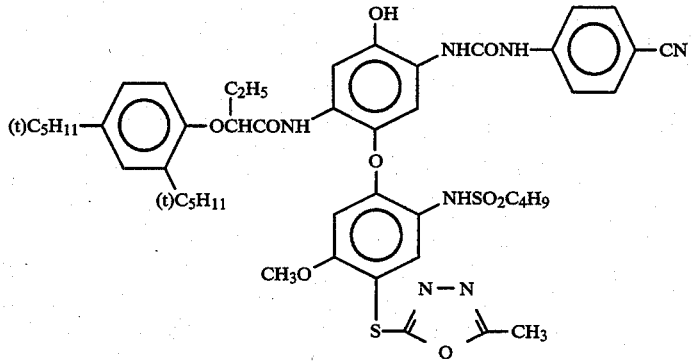

-continued
(I-4)
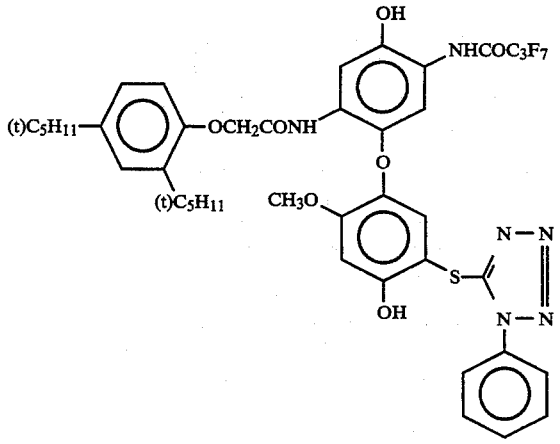
(I-5)
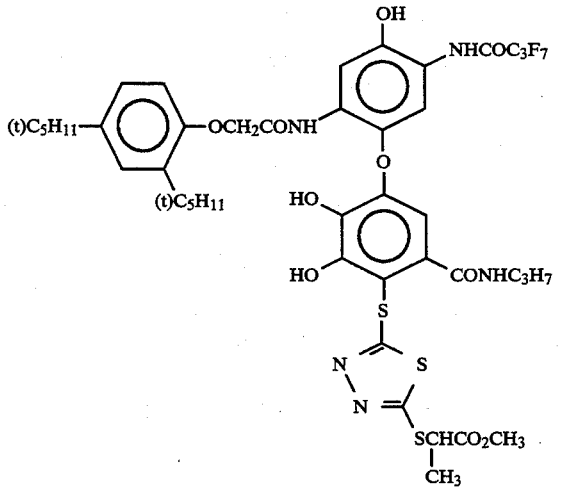
(I-6)
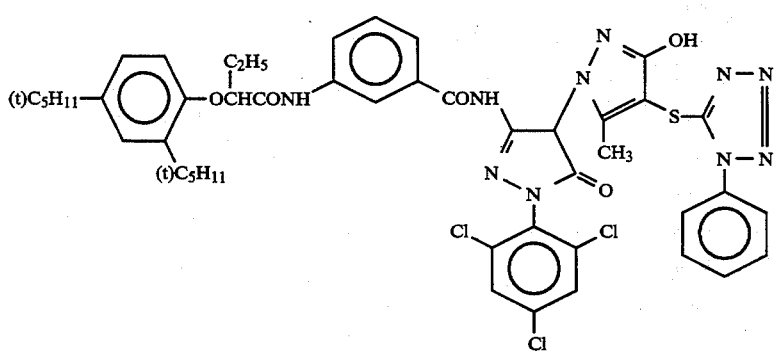
(I-7)
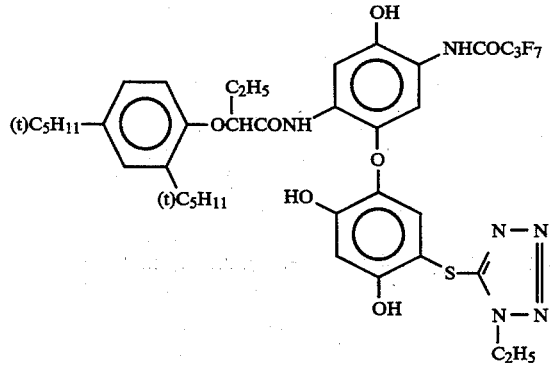

-continued
(I-8)
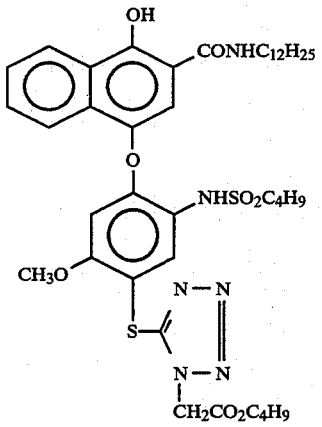
(I-9)
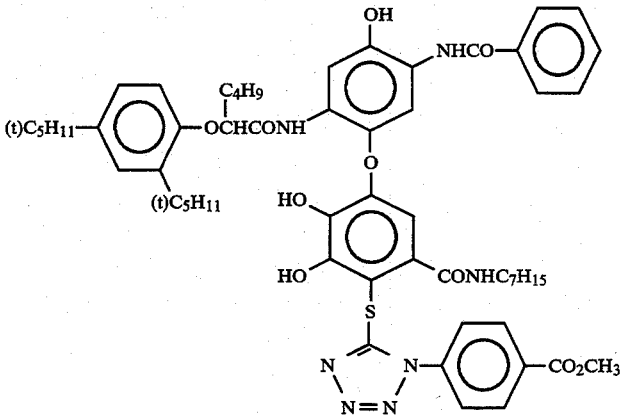
(I-10)
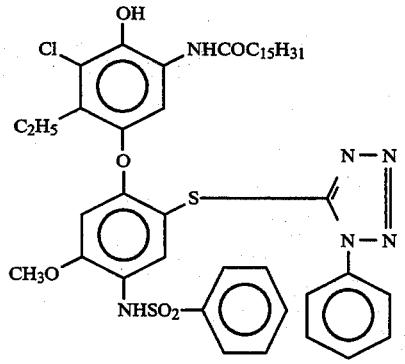
(I-11)
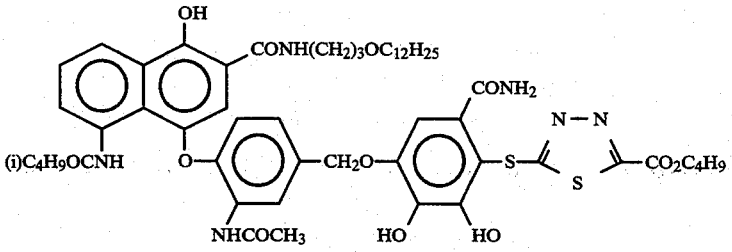

-continued
(I-12)
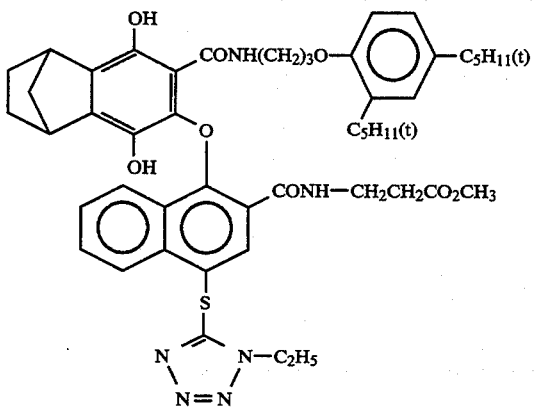
(I-13)
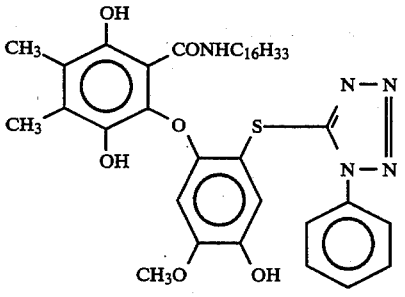
(I-14)
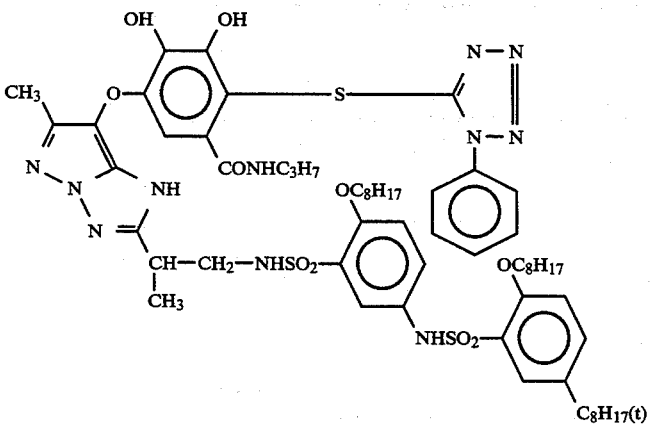
(I-15)
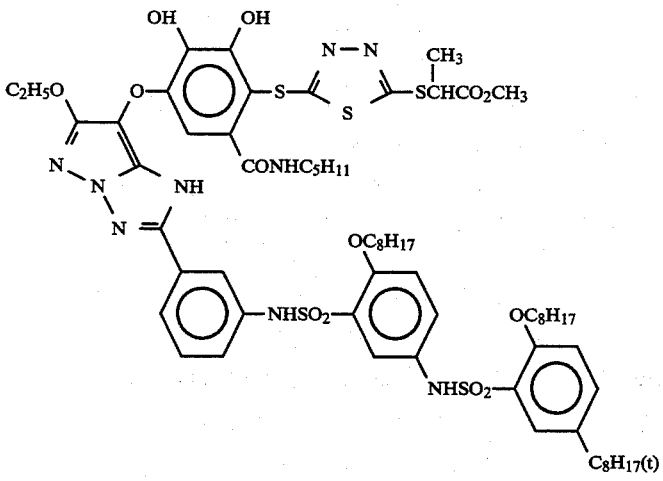

-continued
(I-16)
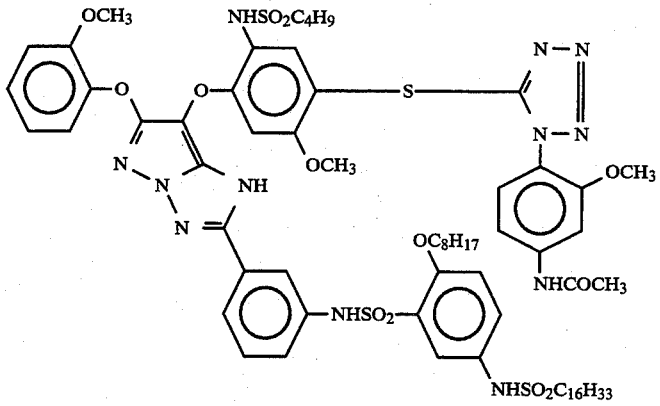
(I-17)
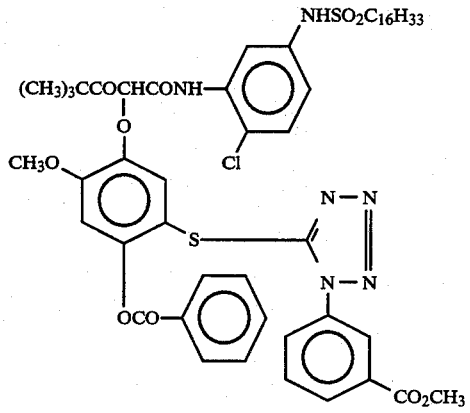
(I-18)
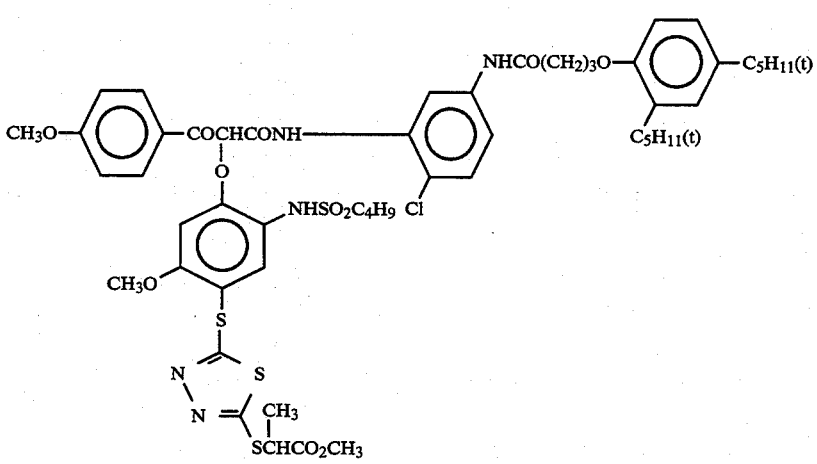
(I-19)
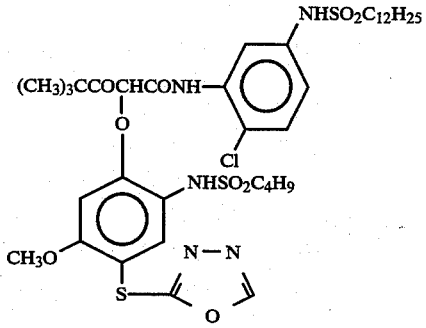

-continued
(I-20)
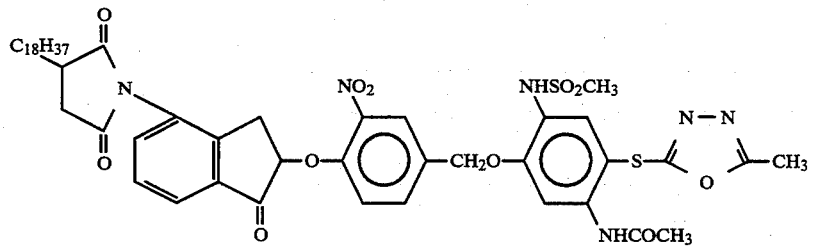
(I-21)
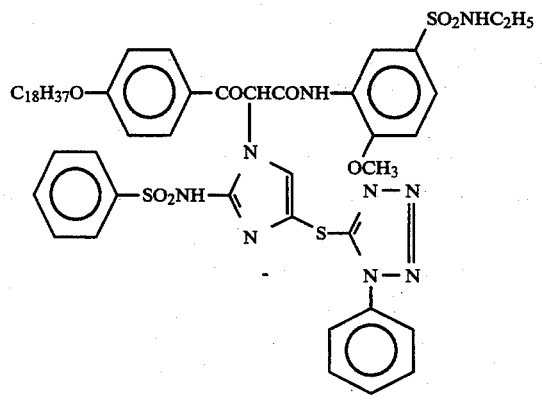
(I-22)
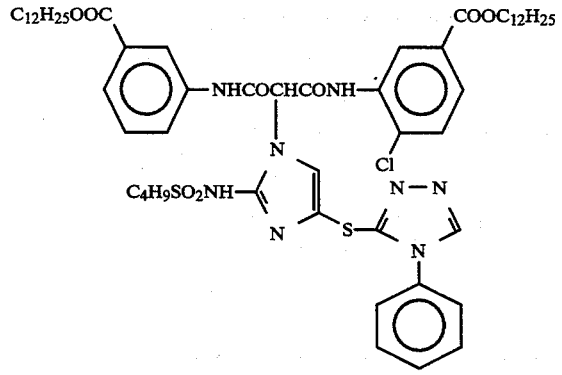
(I-23)
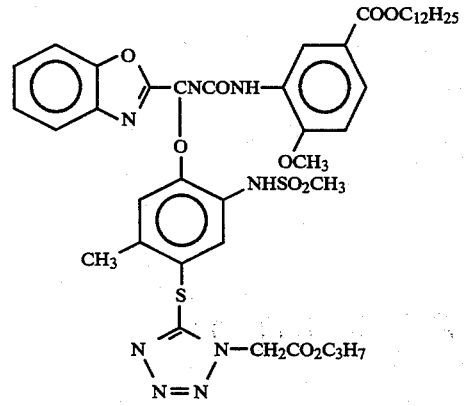

-continued (I-24)

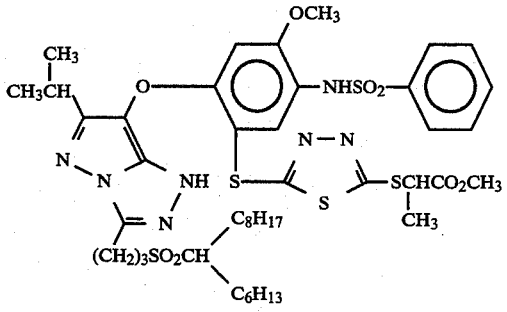

(I-25)

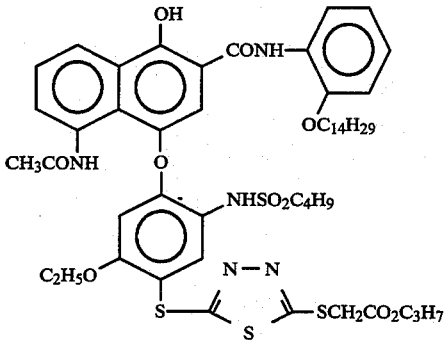

A compound represented by Formula (D) of the present invention is preferably added to light-sensitive silver halide emulsion layers or their adjacent layers in a light-sensitive material. The addition amount of the compound is $1\times10^{-6}$ to $1\times10^{-3}$ mol/m$^2$, preferably $3\times10^{-6}$ to $5\times10^{-4}$ mol/m$^2$, and more preferably $1\times10^{-5}$ to $2\times10^{-4}$ mol/m$^2$.

In the light-sensitive material of the present invention, at least one of blue-, green-, and red-sensitive silver halide emulsion layers need only be formed on a support, and the number and order of the silver halide emulsion layers and non-light-sensitive layers are not particularly limited. A typical example is a silver halide photographic light-sensitive material having, on its support, at least one light-sensitive layer constituted by a plurality of silver halide emulsion layers which are sensitive to essentially the same color but have different sensitivities. This light-sensitive layer is a unit sensitive layer which is sensitive to one of blue light, green light, and red light. In a multilayered silver halide color photographic light-sensitive material, such unit light-sensitive layers are generally arranged in an order of red-, green-, and blue-sensitive layers from a support. However, according to the intended use, this arrangement order may be reversed, or light-sensitive layers sensitive to the same color may sandwich another light-sensitive layer sensitive to a different color.

Non-light-sensitive layers such as various types of interlayers may be formed between the silver halide light-sensitive layers mentioned above and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-sensitivity emulsion layers can be preferably used as described in West German Patent 1,121,470 or British Patent 923,045. In this case, layers are preferably arranged such that the sensitivity is sequentially decreased toward a support, and a non-light-sensitive layer may be formed between the respective silver halide emulsion layers. In addition, as described in JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

More specifically, layers may be arranged from the farthest side from a support in an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-sensitivity emulsion layer/high-sensitivity emulsion layer/low-sensitivity emulsion layer from the farthest side from a support in a layer sensitive to one color as described in JP-A-59-202464.

In addition, an order of high-sensitivity emulsion layer/low-sensitivity emulsion layer/medium-sensitivity emulsion layer or low-sensitivity emulsion layer/medium-sensitivity emulsion layer/high-sensitivity emulsion layer may be adopted. Furthermore, the arrangement can be changed as described above even when four or more layers are formed.

In order to improve color reproducibility, a donor layer (CL) with an interlayer effect, which is described in U.S. Pat, Nos. 4,663,271, 4,705,774, or 4,707,436, JP-A-62-160448, or JP-A-63-89850 and different from the main light-sensitive layers BL, GL, and RL in spectral sensitivity distribution, is preferably formed adjacent to or close to the main light-sensitive layers.

As described above, various layer types and arrangements can be selected according to the intended use of the light-sensitive material.

A preferable silver halide contained in photographic emulsion layers of the photographic light-sensitive material of the present invention is silver bromoiodide, silver chloroiodide, or silver bromochloroiodide containing about 30 mol % or less of silver iodide. The most preferable silver halide is silver bromoiodide or silver bromochloroiodide containing about 2 mol % to about 10 mol % of silver iodide.

Silver halide grains contained in the photographic emulsion may have regular crystals such as cubic, octahedral, or tetradecahedral crystals, irregular crystals such as spherical or tabular crystals, crystals having crystal defects such as twinned crystal faces, or composite shapes thereof.

A silver halide may consist of fine grains having a grain size of about 0.2 μm or less or large grains with its diameter of a projected surface area reaching to 10 μm, and an emulsion may be either a polydisperse or monodisperse emulsion.

A silver halide photographic emulsion which can be used in the light-sensitive material of the present invention can be prepared by methods described in, for example, "I. Emulsion preparation and types," Research Disclosure (RD) No. 17,643 (December, 1978), pp. 22 and 23, RD No. 18,716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394 and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226, 4,414,310, 4,433,048, and 4,439,520, and British Patent 2,112,157.

A crystal structure may be uniform, may have different halogen compositions in the interior and the surface layer thereof, or may be a layered structure. Alternatively, a silver halide having a different composition may be bonded by an epitaxial junction or a compound except for a silver halide such as silver rhodanide or zinc oxide may be bonded. A mixture of grains having various types of crystal shapes may be used.

The above emulsion may be any of a surface latent image type emulsion which mainly forms a latent image on the surface of a grain, an internal latent image type emulsion which forms a latent image in the interior of a grain, and an emulsion of another type which has latent images on the surface and in the interior of a grain. However, the emulsion must be a negative type emulsion. In this case, the internal latent image type emulsion may be a core/shell internal latent image type emulsion described in JP-A-63-264740. A method of preparing this core/shell internal latent image type emulsion is described in JP-A-59-133542. Although the thickness of a shell of this emulsion depends on, e.g., development conditions, it is preferably 3 to 40 nm, and most preferably 5 to 20 nm.

A silver halide emulsion layer is normally subjected to physical ripening, chemical ripening, and spectral sensitization steps before it is used. Additives for use in these steps are described in Research Disclosure Nos. 17,643, 18,716, and 307,105, and they are summarized in the following Table-A.

In the light-sensitive material of the present invention, it is possible to simultaneously use, in a single layer, two or more types of emulsions different in at least one of characteristics of a light-sensitive silver halide emulsion, i.e., a grain size, a grain size distribution, a halogen composition, a grain shape, and a sensitivity.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in light-sensitive silver halide emulsion layers and/or essentially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the light-sensitive material. A method of preparing the internally fogged or surface-fogged silver halide grain is described in U.S. Pat. No. 4,626,498 and JP-A-59-214852.

A silver halide which forms the core of an internally fogged core/shell type silver halide grain may have either a single halogen composition or different halogen compositions. As the internally fogged or surface-fogged silver halide, any of silver chloride, silver chlorobromide, silver bromoiodide, and silver bromochloroiodide can be used. Although the grain size of these fogged silver halide grains is not particularly limited, the average grain size is preferably 0.01 to 0.75 μm, and most preferably 0.05 to 0.6 μm. Since the grain shape is not particularly limited either, regular grains may be used. The emulsion may be a polydisperse emulsion but is preferably a monodisperse emulsion (in which at least 95% in weight or the number of grains of silver halide grains have grain sizes falling within a range of ±40% of an average grain size).

In the present invention, it is preferable to use a non-light-sensitive fine grain silver halide. The non-light-sensitive fine grain silver halide preferably consists of silver halide grains which are not exposed during imagewise exposure for obtaining a dye image and are not essentially developed during development. These silver halide grains are preferably not fogged in advance.

In the fine grain silver halide, the content of silver bromide is 0 to 100 mol %, and silver chloride and/or silver iodide may be added if necessary. The fine grain silver halide preferably contains 0.5 to 10 mol % of silver iodide.

The average grain size (average value of an equivalent-circle diameter of a projected area) of the fine grain silver halide is preferably 0.01 to 0.5 μm, and more preferably 0.02 to 0.2 μm.

The fine grain silver halide can be prepared following the same procedures as for a common light-sensitive silver halide. In this case, the surface of each silver halide grain need not be optically sensitized nor spectrally sensitized. However, before the silver halide grains are added to a coating solution, it is preferable to add a well-known stabilizer such as a triazole-based compound, an azaindene-based compound, a benzothiazolium-based compound, a mercapto-based compound, or a zinc compound. Colloidal silver can be preferably added to this fine grain silver halide grain-containing layer.

The silver coating amount of the light-sensitive material of the present invention is preferably 6.0 g/m$^2$ or less, and most preferably 4.5 g/m$^2$ or less.

Well-known photographic additives usable in the present invention are also described in the three Research Disclosures described above, and they are summarized in the following Table-A.

TABLE-A

| Additives | | RD17643 | RD18716 | RD307105 |
|---|---|---|---|---|
| 1. | Chemical sensitizers | page 23 | page 648, right column | page 866 |
| 2. | Sensitivity increasing agents | | do | |
| 3. | Spectral sensitizers, super sensitizers | pages 23–24 | page 648, right column to page 649, right column | pages 866–868 |
| 4. | Brighteners | page 24 | page 647, right column | page 868 |
| 5. | Antifoggants and stabilizers | pages 24–25 | page 649, right column | pages 868–870 |
| 6. | Light absorbent, filter dye, ultraviolet absorbents | pages 25–26 | page 649, right column to page 650, left column | page 873 |
| 7. | Stain preventing agents | page 25, right column | page 650, left right columns | page 872 |
| 8. | Dye image stabilizer | page 25 | page 650, left column | page 872 |
| 9. | Hardening agents | page 26 | page 651, left column | pages 874–875 |
| 10. | Binder | page 26 | do | pages 873–874 |
| 11. | Plasticizers, lubricants | page 27 | page 650, right column | page 876 |
| 12. | Coating aids, surface active agents | pages 26–27 | do | pages 875–876 |
| 13. | Antistatic agents | page 27 | do | pages 876–877 |
| 14. | Matting agent | | | pages 878–879 |

In order to prevent deterioration in photographic properties caused by formaldehyde gas, the light-sensitive material is preferably added with a compound described in U.S. Pat. No. 4,411,987 or U.S. Pat. No. 4,435,503, which can react with formaldehyde to fix it.

The light-sensitive material of the present invention preferably contains mercapto compounds described in U.S. Pat. Nos. 4,740,454 and 4,788,132, JP-A-62-18539, and JP-A-1-283551.

The light-sensitive material of the present invention preferably contains a compound described in JP-A-1-106052, which releases a fogging agent, a development accelerator, a silver halide solvent, or a precursor of any of them regardless of a developed amount of silver produced by development.

The light-sensitive material of the present invention preferably contains dyes dispersed by methods described in WO 88/04794, or dyes described in EP 317,308A, U.S. Pat. No. 4,420,555, and JP-A-1-259358.

Various color couplers can be used in the present invention, and specific examples of these couplers are described in patents described in above-mentioned Research Disclosure No. 17643, VII-C to VII-G and No. 307105, VII-C to VII-G.

Preferred examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and WO No. 88/04795.

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, EP 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658. In addition, it is also possible to use pyrazoloazole couplers described in JP-A-64-553, JP-A-64-554, JP-A-64-555, and JP-A-64-556 or an imidazole coupler described in U.S. Pat. No. 4,818,672.

Typical examples of a polymerized dye-forming coupler are described in U.S. Pat. Nos. 3,451,820, 4,080,211, 4,367,282, 4,409,320, and 4,576,910, British Patent 2,102,137, and EP 341,188A.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Preferable examples of a colored coupler for correcting additional, undesirable absorption of a colored dye are those described in Research Disclosure No. 17643, VII-G and No. 307105, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Compounds releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Bleaching accelerator releasing couplers described in, e.g., RD Nos. 11449 and 24241 and JP-A-61-201247 can be effectively used to reduce a time required for a treatment having a bleaching function. This effect is notable especially when the coupler is added to a light-sensitive material using the tabular silver halide grains described above. Preferable examples of a coupler for imagewise releasing a nucleating agent or a development accelerator are described in British Patents 2,097,140 and 2,131,188, JP-A-59-157638, and JP-A-59-170840. It is also preferable to use compounds described in JP-A-60-107029, JP-A-60-252340, JP-A-1-44940, and JP-A-1-45687, which release, e.g., a fogging agent, a development accelerator, or a silver halide solvent upon a redox reaction with an oxidized form of a developing agent.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; a ligand releasing coupler described in, e.g., U.S. Pat. No. 4,555,477; a coupler which releases a leuco dye described in JP-A-63-75747; and a coupler which releases a fluorescent dye described in U.S. Pat. No. 4,774,181.

The couplers for use in this invention can be added to the light-sensitive material by various known dispersion methods.

Examples of a high-boiling organic solvent to be used in the oil-in-water dispersion method are described in, e.g., U.S. Pat. No. 2,322,027. Examples of a high-boiling organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl)phthalate, bis(2,4-di-t-amylphenyl)isophthalate, and bis(1,1-di-ethylpropyl)phthalate), phosphates or phosphonates (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoates (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearylalcohol and 2,4-di-tert-amylphenol), aliphatic carboxylates (e.g., bis(2-ethylhexyl)sebacate, dioctylazelate, glyceroltributylate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of an impregnating latex are described in, e.g., U.S. Pat. No. 4,199,363 and West German Patent Application (OLS) Nos. 2,541,274 and 2,541,230.

Various types of an antiseptic agent or a fungicide are preferably added to the color light-sensitive material of the present invention. Examples of the antiseptic agent and the fungicide are phenetyl alcohol 1,2-benzisothiazoline-3-one, n-butyl-p-hydroxybenzoate, phenol, 4-chloro-3,5-dimethylphenol, 2-phenoxyethanol, and 2-(4-thiazolyl)benzimidazole described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, color paper, a color positive film, and color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers on the side having emulsion layers is 28 μm or less, preferably 23 μm or less, more preferably 18 μm or less, and most preferably 16 μm or less. A film swell speed $T_{\frac{1}{2}}$ is preferably 30 sec. or less, and more preferably, 20 sec. or less. The film thickness means a film thickness measured under moisture conditioning at a temperature of 25° C. and a relative humidity of 55% (two days). The film swell speed $T_{\frac{1}{2}}$ can be measured in accordance with a known method in this field of art. For example, the film swell speed $T_{\frac{1}{2}}$ can be measured by using a swell meter described in Photogr. Sci Eng., A. Green et al., Vol. 19, No. 2, pp. 124 to 129. When 90% of a maximum swell film thickness reached by performing a treatment by using a color developing agent at 30° C. for 3 min. and 15 sec. is defined as a saturated film thickness, $T_{\frac{1}{2}}$ is defined as a time required for reaching ½ of the saturated film thickness.

The film swell speed $T_{\frac{1}{2}}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation: (maximum swell film thickness—film thickness)/film thickness.

In the light-sensitive material of the present invention, hydrophilic colloid layers (called back layers) having a total dried film thickness of 2 to 20 fm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD. No. 17643, pp. 28 and 29, RD. No. 18716, page 615, the left to right columns, and RD No. 307105, pp. 880 and 881.

A color developer used in development of the light-sensitive material of the present invention is preferably an aqueous alkaline solution mainly consisting of an aromatic primary amine-based color developing agent. Although an aminophenol-based compound is effective as this color developing agent, a p-phenylenediamine-based compound is preferably used. Typical examples of the p-phenylenediamine-based compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylani line, 3-methyl-4-amino-N-ethyl-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-methyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-N-propyl-N-(4-hydroxybutyl)aniline, and their sulfates, hydrochlorides and p-toluenesulfonates. Of these compounds, it is more preferable to use 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and their hydrochlorides, p-toluenesulfonates, and sulfates. 4-amino-3-methyl-N-ethyl-N-(4-hydroxybutyl)aniline and its hydrochloride are most preferred because they improve color forming properties and provides a color density to some extent even when a developed silver amount is small, and thereby a developing time can be shortened or desilvering properties can be improved. These compounds can be used in a combination of two or more thereof according to the intended use.

In general, the color developer contains a Ph buffering agent such as a carbonate, a borate, or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethyl hydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye forming coupler; a competing coupler; an auxiliary developing agent such as 1-phenyl-3-pyrazolidone; a viscosity imparting agent; and a chelating agent such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenyl such as N-methyl-p-aminophenol can be used singly or in a combination of two or more thereof. The Ph of the color and black-and-white developers is generally 9 to 12. Although the quantity of replenisher of these developers depends on a color photographic light-sensitive material to be processed, it is generally 3 liters or less per $m^2$ of the light-sensitive material. The quantity of replenisher can be decreased to be 500 ml or less by decreasing a bromide ion concentration in the replenisher. In order to decrease the quantity of replenisher, a contact area of a processing tank with air is preferably decreased to prevent evaporation and oxidation of the replenisher upon contact with air.

A contact area of a photographic processing solution with air in a processing tank can be represented by an aperture efficiency defined below:

$$\text{Aperture efficiency} = \frac{\text{the value of contact area of processing solution with air represented in units of cm}^2}{\text{the value of volume of processing solution represented in units of cm}^3}$$

The above aperture efficiency is preferably 0.1 or less, and more preferably, 0.001 to 0.05. In order to reduce the aperture efficiency, a shielding member such as a floating cover may be provided on the liquid surface of the photographic processing solution in the processing tank. In addition, a method of using a movable cover described in JP-A-1-82033 or a slit developing method descried in JP-A-63-216050 may be used. The aperture efficiency is preferably reduced not only in color and black-and-white development steps but also in all subsequent steps, e.g., bleaching, bleach-fixing, fixing, washing, and stabilizing steps. In addition, a quantity of replenisher can be reduced by using a means of suppressing storage of bromide ions in the developing solution.

A color development time is normally two to five minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, according to the intended use. Examples of the bleaching agent are a compound of a multivalent metal such as iron(III); peroxides; quinones; and a nitro compound. Typical examples of the bleaching agent are an organic complex salt of iron(III), e.g., a complex salt of iron(III) and an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt of iron(III) and citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, west German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, and JP-A-53-28426; and Research Disclosure No. 17,129 (July, 1978); a thiazolidine derivative described in JP-A-50-140129; thiourea derivatives described in JP-B-45-8506, JP-A-52-20832, JP-A-53-32735, and U.S. Pat. No. 3,706,561; iodide salts described in West German Patent 1,127,715, and JP-A-58-16235; polyoxyethylene compounds descried in West German Patents 966,410 and 2,748,430; a polyamine compound described in JP-B-45-8836; compounds described in JP-A-49-40943, JP-A-49-59644, JP-A-53-94927, JP-A-54-35727, JP-A-55-26506, and JP-A-58-163940; and a bromide ion.

Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, for example, acetic acid, propionic acid, or hydroxyacetic acid.

Examples of the fixing agent to be used in the fixing solution or the bleach-fixing solution are thiosulfate, a thiocyanate, a thioether-based compound, a thiourea and a large amount of an iodide. Of these compounds, a thiosulfate, especially, ammonium thiosulfate can be used in the widest range of applications. In addition, a combination of thiosulfate and a thiocyanate, a thioether-based compound, or thiourea is preferably used. As a preservative of the fixing solurion or the bleach-fixing solution, a sulfite, a bisulfite, a carbonyl bisulfite adduct, or a sulfinic acid compound described in EP 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mol/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of strengthening the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyor means described in JP-A-60-191257, JP-A-191258, or JP-A-60-191259. As described in JP-A-60-191257, this conveyor means can significantly reduce carry-over of a processing solution from a pre-bath to a post-bath, thereby effectively preventing degradation in performance of the processing solution. This effect significantly shortens especially a processing time in each processing step and reduces a processing solution replenishing amount.

The photographic light-sensitive material of the present invention is normally subjected to washing and/or stabilizing steps after desilvering. An amount of water used in the washing step can be arbitrarily determined over a broad range in accordance with the properties (e.g., a property determined by the materials used such as a coupler) of the light-sensitive material, the intended use of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineers", Vol. 64, PP. 248–253 (May, 1955). According to the above-described multi-stage counter-current scheme, the amount of water used for washing can be greatly decreased. Since washing water stays in the tanks for a long period of time, however, bacteria multiply and floating substances may be undesirably attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and thiabendazol described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986).

The pH of the water for washing the photographic light-sensitive material of the present invention is 4 to 9, and preferably, 5 to 8. The water temperature and the washing time can vary in accordance with the properties and the intended use of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

Stabilizing is sometimes performed subsequently to washing. An example is a stabilizing bath containing a dye stabilizing agent and a surface-active agent to be used as a final bath of the photographic color light-sensitive material. Examples of the dye stabilizing agent are an aldehyde such as formalin and glutaraldehyde, an N-methylol compound, hexamethylenetetramine, and an aldehyde sulfite adduct. various chelating agents or antifungal agents can be added in the stabilizing bath.

An overflow solution produced upon washing and/or replenishment of the stabilizing solution can be reused in another step such as a desilvering step.

In the processing using an automatic developing machine or the like, if each processing solution described above is condensed by evaporation, water is preferably added to correct condensation.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide light-sensitive material of the present invention can be applied to thermal development light-sensitive materials described in, e.g., U.S. Pat. No. 4,500,626, JP-A-60-133449, JP-A-59-218443, JP-A-61-238056, and EP 210,660A2.

EXAMPLE 1

Layers having the following compositions were coated on a subbed cellulose triacetate film support to prepare a sample 101 as a multilayered color light-sensitive material.

(Compositions of light-sensitive layers)

Numbers corresponding to the respective components represent coating amounts in g/m$^2$. As for the silver halide, the numbers represent coating amounts figured out as silver contents. Note that the number represented by each sensitizing dye represents a coating amount (in mol) per mol of the silver halide of the same layer.

| (Sample 101) | | |
|---|---|---|
| First layer (Antihalation layer) | | |
| Black colloidal silver | silver | 0.18 |
| Gelatin | | 1.00 |
| Second layer (Interlayer) | | |
| 2,5-di-t-pentadecylhydroquinone | | 0.18 |
| EX-1 | | 0.18 |
| EX-3 | | 0.02 |
| EX-12 | | $2.0 \times 10^{-3}$ |
| U-1 | | 0.060 |
| U-2 | | 0.080 |
| U-3 | | 0.10 |
| HBS-1 | | 0.10 |
| HBS-2 | | 0.020 |
| Gelatin | | 0.70 |
| Third layer (1st red-sensitive emulsion layer) | | |
| Emulsion A | silver | 0.15 |
| Emulsion B | silver | 0.35 |
| Sensitizing dye I | | $6.9 \times 10^{-5}$ |
| Sensitizing dye II | | $1.8 \times 10^{-5}$ |
| Sensitizing dye III | | $3.1 \times 10^{-4}$ |
| EX-2 | | 0.17 |
| EX-10 | | 0.020 |
| EX-14 | | 0.17 |
| U-1 | | 0.070 |
| U-2 | | 0.050 |
| U-3 | | 0.070 |
| HBS-1 | | 0.060 |
| Gelatin | | 0.75 |
| Fourth Layer (2nd red-sensitive emulsion layer) | | |

-continued

| (Sample 101) | | |
|---|---|---|
| Emulsion G | silver | 1.00 |
| Sensitizing dye I | | $5.1 \times 10^{-5}$ |
| Sensitizing dye II | | $1.4 \times 10^{-5}$ |
| Sensitizing dye III | | $2.3 \times 10^{-4}$ |
| Compound (I-1) represented by Formula (D) | | 0.025 |
| EX-2 | | 0.20 |
| EX-3 | | 0.050 |
| EX-10 | | 0.015 |
| EX-14 | | 0.20 |
| EX-15 | | 0.050 |
| U-1 | | 0.070 |
| U-2 | | 0.050 |
| U-3 | | 0.070 |
| Gelatin | | 1.10 |
| Fifth layer (3rd red-sensitive emulsion layer) | | |
| Emulsion D | silver | 1.60 |
| Sensitizing dye I | | $5.4 \times 10^{-5}$ |
| Sensitizing dye II | | $1.4 \times 10^{-5}$ |
| Sensitizing dye III | | $2.4 \times 10^{-4}$ |
| EX-2 | | 0.097 |
| EX-3 | | 0.010 |
| EX-4 | | 0.080 |
| HBS-1 | | 0.22 |
| HBS-2 | | 0.10 |
| Gelatin | | 1.40 |
| Sixth layer (Interlayer) | | |
| EX-5 | | 0.040 |
| HBS-1 | | 0.020 |
| Gelatin | | 0.60 |
| Seventh layer (1st green-sensitive emulsion layer) | | |
| Emulsion A | silver | 0.10 |
| Emulsion B | silver | 0.20 |
| Sensitizing dye IV | | $3.0 \times 10^{-5}$ |
| Sensitizing dye V | | $1.0 \times 10^{-4}$ |
| Sensitizing dye VI | | $3.8 \times 10^{-4}$ |
| EX-1 | | 0.021 |
| EX-6 | | 0.26 |
| EX-7 | | 0.030 |
| EX-16 | | 0.020 |
| HBS-1 | | 0.10 |
| HBS-3 | | 0.010 |
| Gelatin | | 0.63 |
| Eighth layer (2nd green-sensitive emulsion layer) | | |
| Emulsion C | silver | 0.45 |
| Sensitizing dye IV | | $2.1 \times 10^{-5}$ |
| Sensitizing dye V | | $7.0 \times 10^{-5}$ |
| Sensitizing dye VI | | $2.6 \times 10^{-4}$ |
| EX-6 | | 0.094 |
| EX-7 | | 0.026 |
| EX-16 | | 0.022 |
| HBS-1 | | 0.16 |
| HBS-3 | | $8.0 \times 10^{-3}$ |
| Gelatin | | 0.50 |
| Ninth layer (3rd green-sensitive emulsion layer) | | |
| Emulsion E | silver | 1.20 |
| Sensitizing dye IV | | $3.5 \times 10^{-5}$ |
| Sensitizing dye V | | $8.0 \times 10^{-5}$ |
| Sensitizing dye VI | | $3.0 \times 10^{-4}$ |
| Compound (B-1) represented by Formula (B) | | 0.025 |
| EX-1 | | 0.013 |
| EX-11 | | 0.065 |
| EX-13 | | 0.019 |
| EX-16 | | 0.008 |
| HBS-1 | | 0.25 |
| HBS-2 | | 0.10 |
| Gelatin | | 1.40 |
| Tenth layer (Yellow filter layer) | | |
| Yellow colloidal silver | silver | 0.050 |
| EX-5 | | 0.080 |
| HBS-1 | | 0.030 |
| Gelatin | | 0.60 |
| Eleventh layer (1st blue-sensitive emulsion layer) | | |

-continued (Sample 101)

| | | |
|---|---|---|
| Emulsion A | silver | 0.040 |
| Emulsion B | silver | 0.070 |
| Emulsion F | silver | 0.100 |
| Sensitizing dye VII | | $3.5 \times 10^{-4}$ |
| EX-8 | | 0.042 |
| EX-9 | | 0.72 |
| HBS-1 | | 0.28 |
| Gelatin | | 1.10 |
| Twelfth layer (2nd blue-sensitive emulsion layer) | | |
| Emulsion G | silver | 0.45 |
| Sensitizing dye VII | | $2.1 \times 10^{-4}$ |
| EX-9 | | 0.15 |
| EX-10 | | $7.0 \times 10^{-3}$ |
| HBS-1 | | 0.050 |
| Gelatin | | 0.78 |
| Thirteenth layer (3rd blue-sensitive emulsion layer) | | |
| Emulsion H | silver | 0.77 |
| Sensitizing dye VII | | $2.2 \times 10^{-4}$ |
| EX-9 | | 0.20 |
| HBS-1 | | 0.070 |
| Gelatin | | 0.69 |
| Fourteenth layer (1st protective layer) | | |
| Emulsion I | silver | 0.20 |

-continued (Sample 101)

| | |
|---|---|
| U-4 | 0.11 |
| U-5 | 0.17 |
| HBS-1 | $5.0 \times 10^{-2}$ |
| Gelatin | 1.00 |
| Fifteenth layer (2nd protective layer) | |
| H-1 | 0.40 |
| BB-1 (diameter = 1.7 μm) | $5.0 \times 10^{-2}$ |
| BB-2 (diameter = 1.7 μm) | 0.10 |
| BB-3 | 0.10 |
| S-1 | 0.20 |
| Gelatin | 0.60 |

In addition, in order to improve storage stability, processability, a resistance to pressure, antiseptic and antifungal properties, antistatic properties, and coating properties, W-1, W-2, W-3, BB-4, BB-5, F-1, F-2, F-3, F-4, F-5, F-6, F-7, F-8, F-9, F-10, F-11, F-12, F-13, and an iron salt, lead salt, gold salt, platinum salt, iridium salt, and rhodium salt were added to all of the above layers.

The emulsions and compounds used in the preparation of the sample 101 will be presented below.

TABLE 1

| | Average AgI Content (%) | Average grain size (μm) | Variation coefficient (%) according to grain size | Diameter/thickness ratio | Silver amount ratio (AgI content (%)) |
|---|---|---|---|---|---|
| Emulsion A | 4.0 | 0.25 | 27 | 1.0 | Core/shell = 1/3 (13/1), Duble structure grain |
| Emulsion B | 8.9 | 0.55 | 14 | 4.0 | Core/shell = 3/7 (25/2), Duble structure grain |
| Emulsion C | 10.0 | 0.55 | 18 | 4.0 | Core/shell = 1/2 (24/3), Double structure grain |
| Emulsion D | 16.0 | 0.80 | 19 | 7.5 | Core/shell = 4/6 (40/0), Double structure grain |
| Emulsion E | 10.0 | 0.80 | 17 | 7.0 | Core/shell = 1/2 (24/3), Double strictire grain |
| Emulsion F | 4.0 | 0.15 | 15 | 1.0 | Core/shell = 1/3 (13/1), Double strictire grain |
| Emulsion G | 14.0 | 0.50 | 17 | 5.0 | Core/shell = 1/2 (42/0), Double structure grain |
| Emulsion H | 14.5 | 1.10 | 20 | 7.0 | Core/shell = 37/63 (34/3), Double structure grain |
| Emulsion I | 1 | 0.07 | 15 | 1 | Uniform grain |

U-1

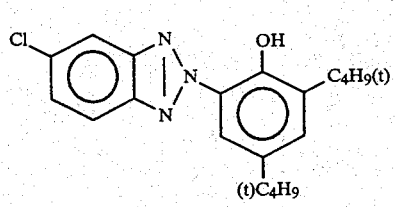

U-2

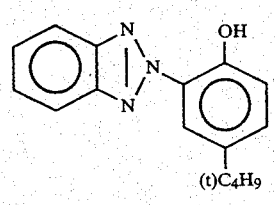

U-3

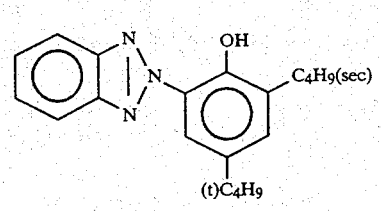

-continued
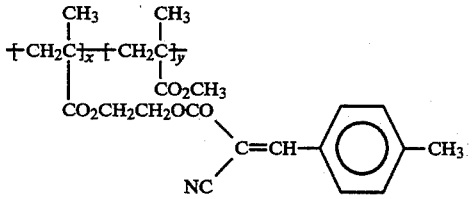
x:y = 70:30 (wt%)
(U-4)
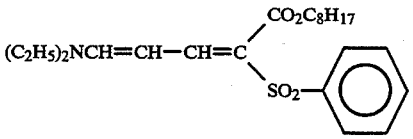
(U-5)
tricresyl phosphate HBS-1
di-n-butylphthalate HBS-2
HBS-3
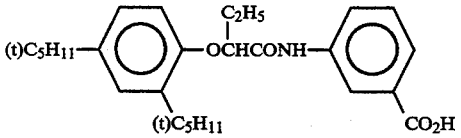
Sensitizing dye I
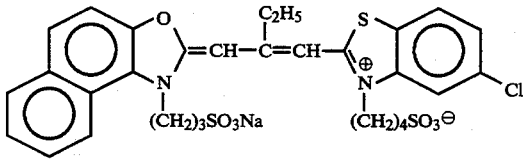
Sensitizing dye II
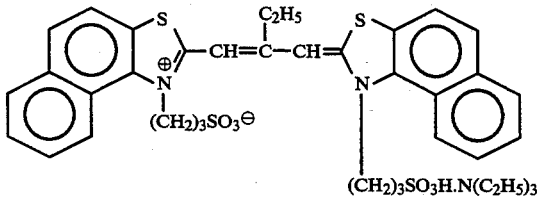
Sensitizing dye III
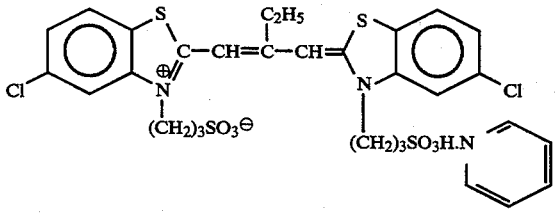
Sensitizing dye IV
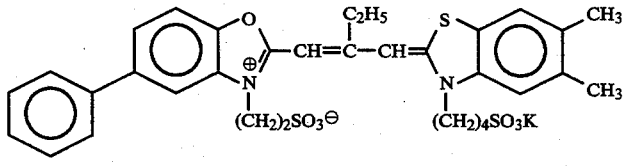
Sensitizing dye V
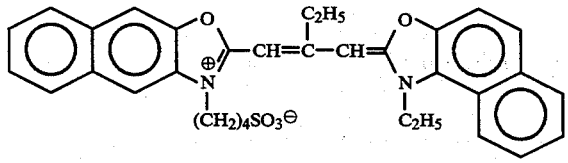

-continued
Sensitizing dye VI
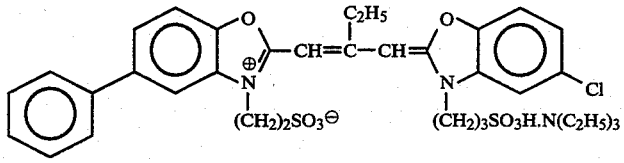
Sensitizing dye VII
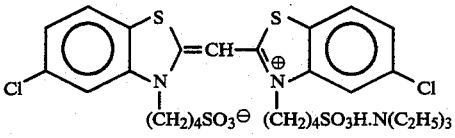
S-1
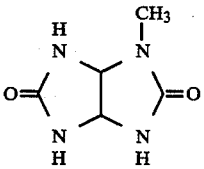
H-1
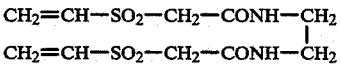
BB-1
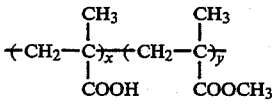
x/y = 10/90
BB-2
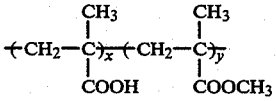
x/y = 40/60
BB-3
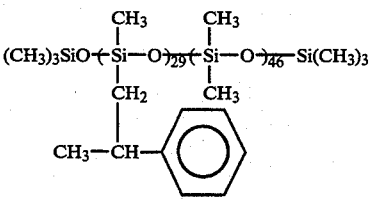
BB-4
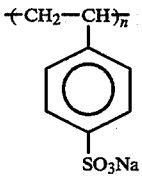
BB-5
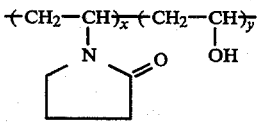
x/y = 70/30
W-1
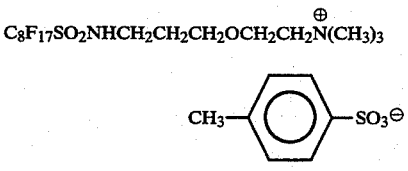
W-2
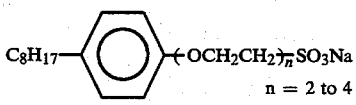
n = 2 to 4

-continued
W-3
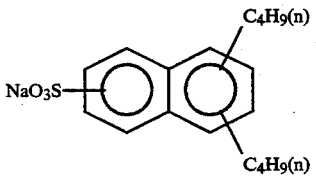
F-1
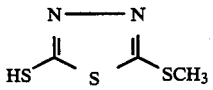
F-2
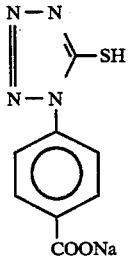
F-3
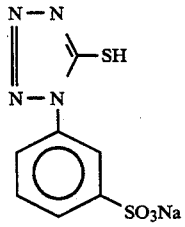
F-4
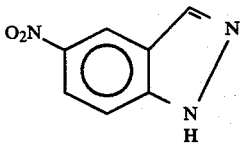
F-5
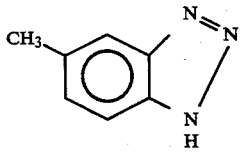
F-6
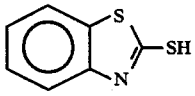
F-7
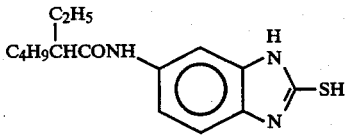
F-8
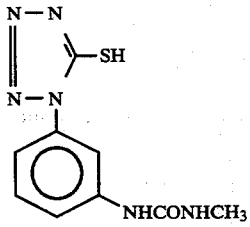

-continued
F-9
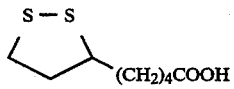
F-10
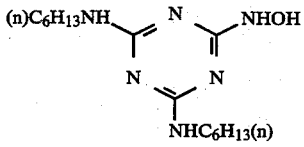
F-11
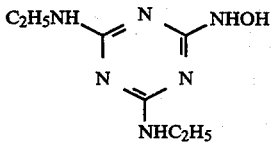
F-12
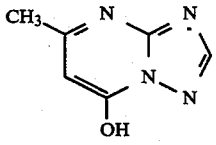
F-13
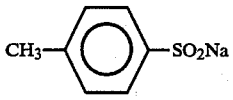
EX-1
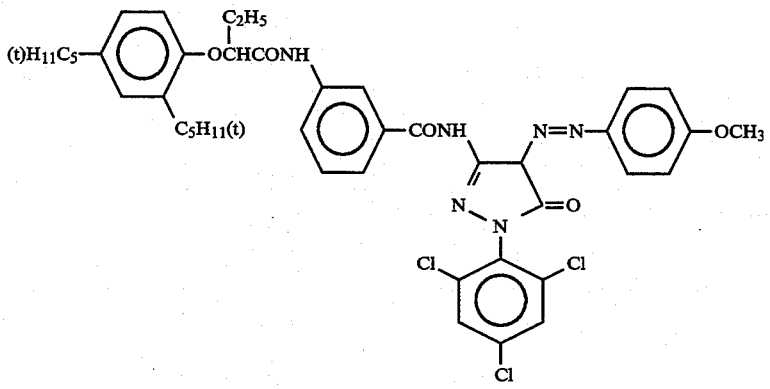
EX-2
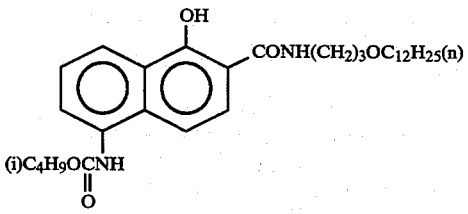
EX-3
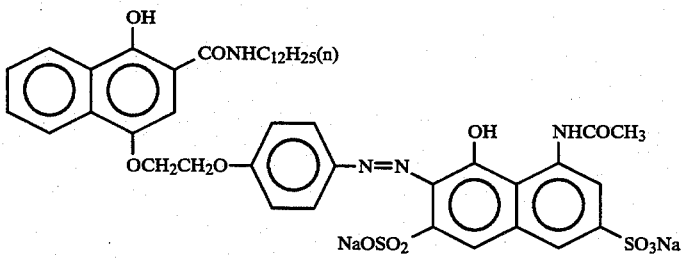

-continued
EX-4
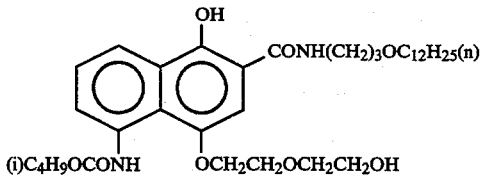
EX-5
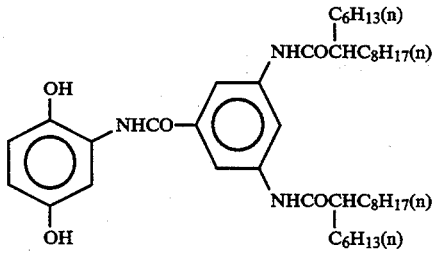
(ExM-9 in JP-A-1-154057)
EX-6
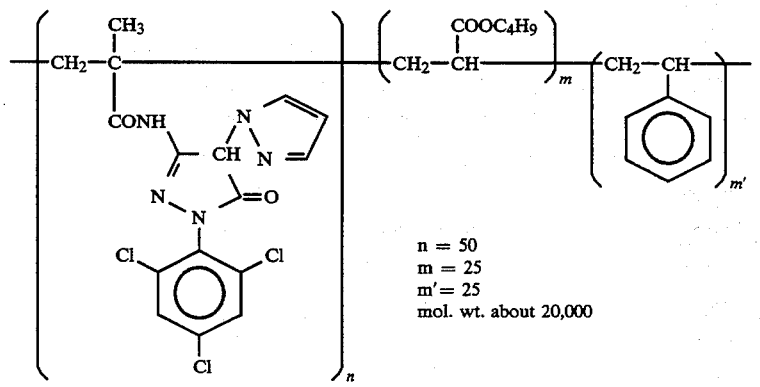
EX-7
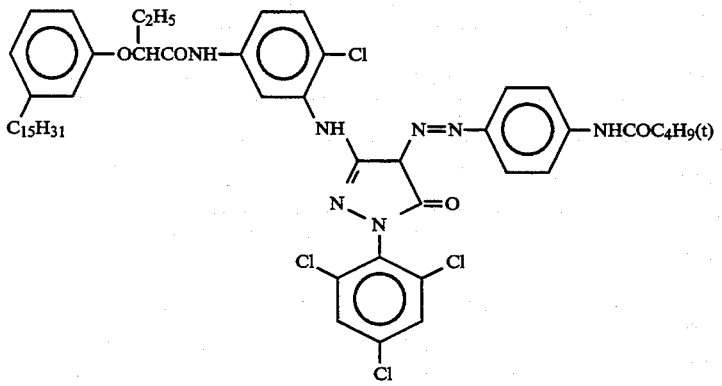
(D-3 in JP-A-60-262158)
EX-8
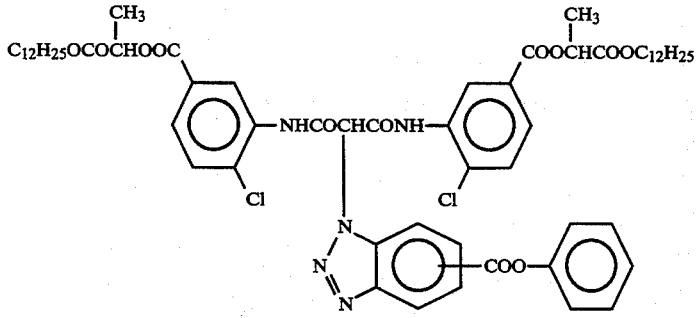

-continued
EX-9
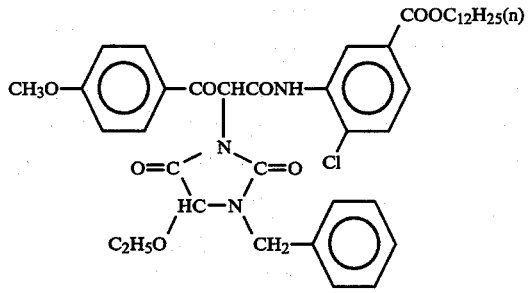
EX-10
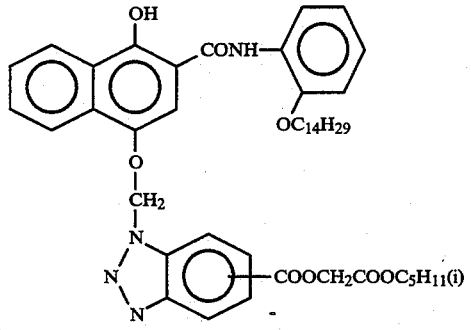
EX-10
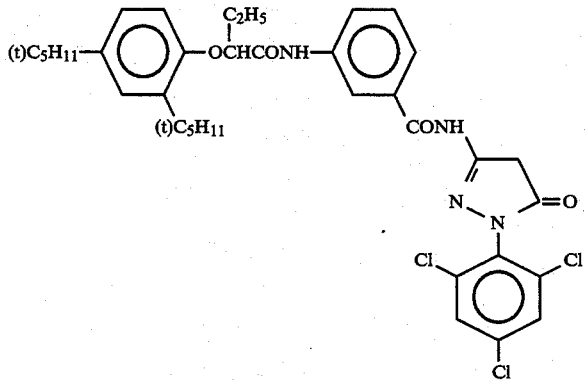
EX-12
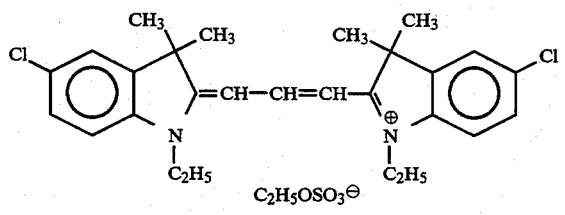
EX-13
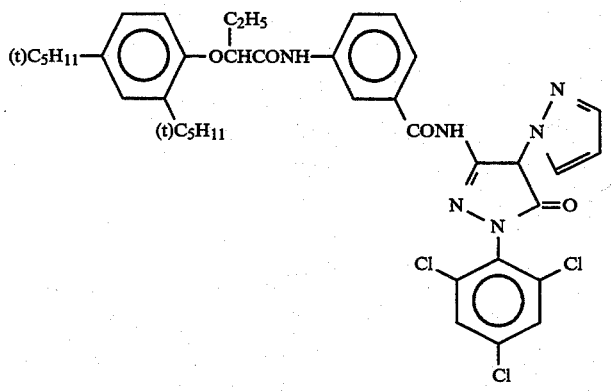

-continued
EX-14
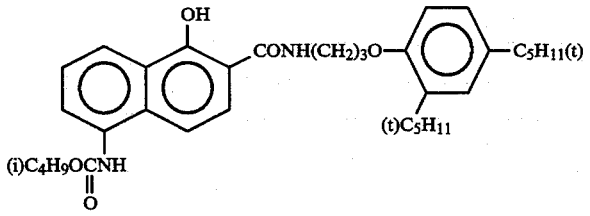
EX-15
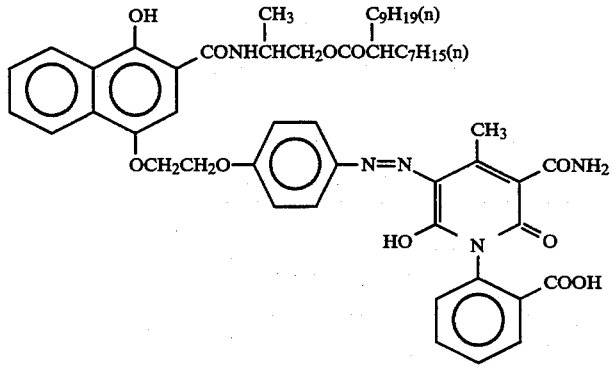
(coupler (13) in JP-A-154057)
EX-16
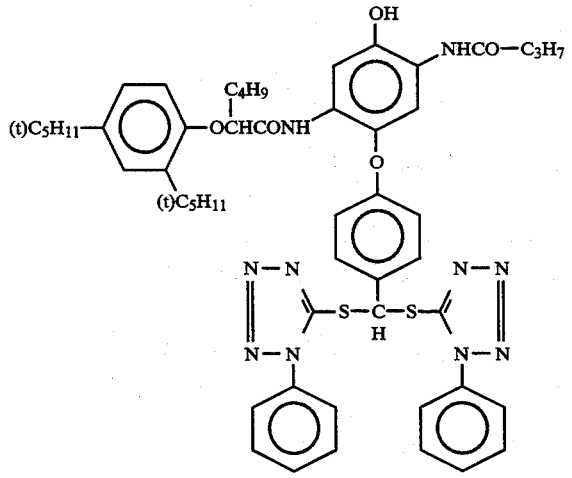
(Compound (9) in JP-A-62-151850)
EX-17
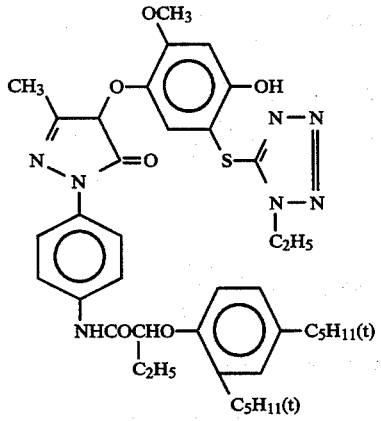
(coupler D-1 in JP-A-63-74058)

-continued

EX-18

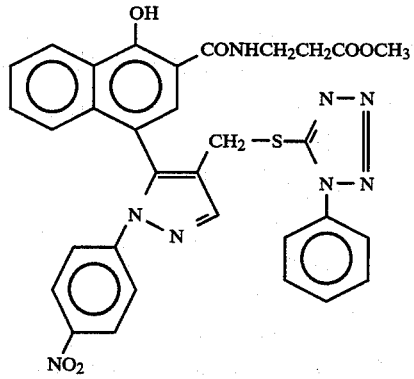

(Compound (4) in JP-A-1-251032)

EX-19

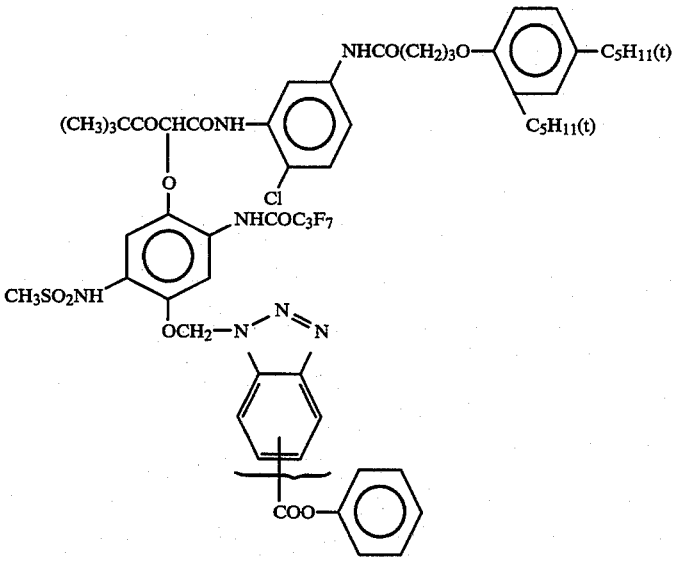

(Sample 102)

A sample 102 was manufactured by replacing the magenta coupler EX-6 in the seventh and eighth layers of the sample 101 with an equal molar quantity of M-1 of the present invention and EX-16 in the seventh, eighth, and ninth layers with a 0.8-times molar quantity of EX-8.

(Samples 103–105)

A sample 103 was manufactured by replacing EX-8 in the seventh, eighth, and ninth layers of the sample 102 with a 1.2-times molar quantity of EX-17 and M-1 with an equal molar quantity of M-7. A sample 104 was manufactured by replacing EX-8 with a 0.6-times molar quantity of EX-18 and M-1 with an equal molar quantity of M-24. A sample 105 was manufactured by replacing EX-8 with a 2.5-times molar quantity of EX-19 and M-1 with an equal molar quantity of M-7.

(Samples 106–115)

Samples 106 to 115 were manufactured by replacing the magenta coupler EX-6 in the seventh and eighth layers and the compound (EX-16) in the seventh, eighth, and ninth layers of the sample 101 with equal molar quantities of the couplers of the present invention as listed in Table 2 to be presented later.

(Sample 116)

A sample 116 was manufactured by removing (B-1) in the ninth layer and (I-1) in the fourth layer of the sample 115.

After green imagewise exposure was given to each of these samples, blue uniform exposure was given such that the yellow density in a red unexposed portion of the sample 101 was 1.8. Thereafter, the following processing was performed, and a value obtained by subtracting the yellow density in a magenta fogged portion from the yellow density at a point where a magenta density of 2.0 was obtained was calculated as a color turbidity. The similar processing was performed to measure the sharpness in accordance with a conventional MTF (Modulation Transfer Function) method, thereby calculating an MTF value at 20 cycles/mm of a magenta image.

Each sample was exposed to white light of 5 lux/sec, and the magenta density was measured following the same procedures as described below except that the bleaching time was changed to 2 min. 15 sec. and 30 min. A value obtained by subtracting the magenta density at the bleaching time of 30 min. from the magenta density at the bleaching time of 2 min. 15 sec. is also listed as unsatisfactory desilvering. In addition, the color turbidity was obtained by the bleaching time of 2 min. 15 sec.

The color photographic light-sensitive material was exposed as described above and processed using an automatic developing machine in accordance with the following method (until the accumulated quantity of replenisher became 3 times the volume of the mother solution tank).

| (Processing Method) | | | | |
|---|---|---|---|---|
| Process | Time | Temperature | Quantity of* replenisher | Tank volume |
| Color development | 3 min. 15 sec. | 38° C. | 33 ml | 20 l |
| Bleaching | 6 min. 30 sec. | 38° C. | 25 ml | 40 l |
| Washing | 2 min. 10 sec. | 24° C. | 1,200 ml | 20 l |
| Fixing | 4 min. 20 sec. | 38° C. | 25 ml | 30 l |
| Washing (1) | 1 min. 05 sec. | 24° C. | Counter flow piping from (2) to (1) | 10 l |
| Washing (2) | 1 min. 00 sec. | 24° C. | 1,200 ml | 10 l |
| Stabilization | 1 min. 05 sec. | 38° C. | 25 ml | 10 l |
| Drying | 4 min. 20 sec. | 55° C. | | |

(*A quantity of replenisher per meter of a 35-mm wide sample)

The compositions of the processing solutions will be presented below.

| | Mother solution (g) | Replenisher (g) |
|---|---|---|
| Color developing solution: | | |
| Diethylenetriamine-pentaacetate | 1.0 | 1.1 |
| 1-hydroxyethylidene-1,1-diphosphonic acid | 3.0 | 3.2 |
| Sodium sulfite | 4.0 | 4.4 |
| Potassium carbonate | 30.0 | 37.0 |

-continued

| | Mother solution (g) | Replenisher (g) |
|---|---|---|
| Potassium bromide | 1.4 | 0.7 |
| Potassium iodide | 1.5 mg | — |
| Hydroxylamine sulfate | 2.4 | 2.8 |
| 4-(N-ethyl-N-β-hydroxylethylamino)-2-methylaniline sulfate | 4.5 | 5.5 |
| Water to make | 1.0 l | 1.0 l |
| pH | 10.05 | 10.10 |
| Bleaching solution: | | |
| Sodium Ferric ethylenediamine-tetraacetate trihydrate | 100.0 | 120.0 |
| Disodium ethylene-diaminetetraacetate | 10.0 | 10.0 |
| Ammonium bromide | 140.0 | 160.0 |
| Ammonium nitrate | 30.0 | 35.0 |
| Ammonia water (27%) | 6.5 ml | 4.0 ml |
| Water to make | 1.0 l | 1.0 l |
| pH | 6.0 | 5.7 |
| Fixing solution: | | |
| Disodium ethylene-diaminetetraacetate | 0.5 | 0.7 |
| Sodium sulfite | 7.0 | 8.0 |
| Sodium bisulfite | 5.0 | 5.5 |
| Ammonium thiosulfate aqueous solution (70%) | 170.0 ml | 200.0 ml |
| Water to make | 1.0 l | 1.0 l |
| pH | 6.7 | 6.6 |
| Stabilizing solution: | | |
| Formalin (37%) | 2.0 ml | 3.0 ml |
| Polyoxyethylene-p-mononononylphenylether (average polymerization degree = 10) | 0.3 | 0.45 |
| Disodium ethylene-diaminetetraacetate | 0.05 | 0.08 |
| Water to make | 1.0 | 1.0 |
| pH | 5.0–8.0 | 5.0–8.0 |

TABLE 2

| Sample | Magenta coupler in 7th and 8th layers | Compound in 7th, 8th, and 9th layers | MTF value | Color turbidity | Short-time bleaching results: Unsatisfactory desilvering | Short-time bleaching results: Color turbidity |
|---|---|---|---|---|---|---|
| 101 (Comparative Example)[1] | EX-6 | EX-16 | 0.74 | 0.12 | 0.07 | 0.16 |
| 102 (Comparative Example)[2] | M-1 | EX-8 | 0.73 | 0.12 | 0.11 | 0.16 |
| 103 (Comparative Example)[3] | M-7 | EX-17 | 0.74 | 0.03 | 0.10 | 0.08 |
| 104 (Comparative Example)[4] | M-24 | EX-18 | 0.70 | 0.10 | 0.09 | 0.14 |
| 105 (Comparative Example)[5] | M-7 | EX-19 | 0.74 | 0.09 | 0.11 | 0.13 |
| 106 (Present Invention) | M-7 | CB-3 | 0.78 | 0.03 | 0.02 | 0.04 |
| 107 (Present Invention) | M-7 | CB-18 | 0.78 | 0.03 | 0.02 | 0.04 |
| 108 (Present Invention) | M-7 | CB-33 | 0.78 | 0.03 | 0.02 | 0.04 |
| 109 (Present Invention) | M-7 | CB-34 | 0.78 | 0.03 | 0.02 | 0.04 |
| 110 (Present Invention) | M-7 | CB-7 | 0.77 | 0.02 | 0.03 | 0.03 |
| 111 (Present Invention) | M-7 | CB-13 | 0.77 | 0.02 | 0.03 | 0.03 |
| 112 (Present Invention) | M-31 | CB-33 | 0.78 | 0.03 | 0.02 | 0.04 |
| 113 (Present Invention) | M-33 | CB-33 | 0.78 | 0.03 | 0.03 | 0.04 |
| 114 (Present Invention) | M-53 | CB-33 | 0.78 | 0.03 | 0.02 | 0.04 |
| 115 (Present Invention) | M-54 | CB-33 | 0.78 | 0.03 | 0.02 | 0.04 |
| 116 (Present Invention) | M-54 | CB-33 | 0.76 | 0.07 | 0.03 | 0.08 |

TABLE 2-continued

| Sample | Magenta coupler in 7th and 8th layers | Compound in 7th, 8th, and 9th layers | MTF value | Color turbidity | Short-time bleaching results: Unsatisfactory desilvering | Short-time bleaching results: Color turbidity |
|---|---|---|---|---|---|---|
| (Present Invention) | | | | | | |

[1]Proposed in JP-A-1-154057
[2]Proposed in JP-A-60-262158
[3]Proposed in JP-A-62-151850
[4]Proposed in JP-A-63-74058
[5]Proposed in JP-A-1-251032

It is obvious from Table 2 that each sample of the present invention is excellent in the sharpness represented by the MTF value, the color reproducibility represented by the color turbidity, and the desilvering properties.

In addition, the comparison between the samples 115 and 116 revealed that it was preferable to use a compound represented by Formula (B) and a compound represented by Formula (D) in the light-sensitive material of the present invention.

EXAMPLE 2

A sample 201 was manufactured by replacing EX-8 in the sixth layer of the sample 101 described in JP-A-2-96747 with an equal molar quantity of M-53 of the present invention and adding 0.010 g/m$^2$ of the compound (CB-34) of the present invention to the third, sixth, and seventh layers.

This sample was evaluated following the same procedures as in Example 1. As a result, the sample 201 of the present invention was superior in color reproducibility, sharpness, and desilvering properties.

EXAMPLE 3

The color turbidity and the desilvering properties of each of the samples 101 to 116 were evaluated following the same procedures as in Example 1 except that 4-[N-ethyl-N-$\beta$-hydroxyethylamino]-2-methylaniline sulfate used as the color developing solution in Example 1 was replaced with an equal molar quantity of 4-[N-ethyl-N-$\delta$-hydroxybutylamino]-2-methylaniline-p-toluene sulfonate and the time of the color developing step was changed from 3 min. 15 sec. to 2 min. 30 sec. As a result, the sensitivity and the gamma of a magenta image obtained by this development were almost equal to those obtained by the processing in Example 1. The obtained results are summarized in Table 3 below.

TABLE 3

| Sample | Magenta coupler in 7th and 8th layers | Compound in 7th, 8th, and 9th layers | Color turbidity | Short-time bleaching results: Unsatisfactory desilvering | Short-time bleaching results: Color turbidity |
|---|---|---|---|---|---|
| 101 (Comparative Example) | EX-6 | EX-16 | 0.09 | 0.06 | 0.13 |
| 102 (Comparative Example) | M-1 | EX-8 | 0.09 | 0.09 | 0.13 |
| 103 (Comparative Example) | M-7 | EX-17 | 0.02 | 0.08 | 0.05 |
| 104 (Comparative Example) | M-24 | EX-18 | 0.08 | 0.08 | 0.11 |
| 105 (Comparative Example) | M-7 | EX-19 | 0.07 | 0.09 | 0.10 |
| 106 (Present Invention) | M-7 | CB-3 | 0.02 | 0.01 | 0.02 |
| 107 (Present Invention) | M-7 | CB-18 | 0.02 | 0.01 | 0.02 |
| 108 (Present Invention) | M-7 | CB-33 | 0.02 | 0.01 | 0.02 |
| 109 (Present Invention) | M-7 | CB-34 | 0.02 | 0.01 | 0.02 |
| 110 (Present Invention) | M-7 | CB-7 | 0.02 | 0.02 | 0.02 |
| 111 (Present Invention) | M-7 | CB-13 | 0.02 | 0.01 | 0.02 |
| 112 (Present Invention) | M-31 | CB-33 | 0.02 | 0.01 | 0.02 |
| 113 (Present Invention) | M-33 | CB-33 | 0.02 | 0.02 | 0.02 |
| 114 (Present Invention) | M-53 | CB-33 | 0.02 | 0.01 | 0.02 |
| 115 (Present Invention) | M-54 | CB-33 | 0.02 | 0.01 | 0.02 |
| 116 (Present Invention) | M-54 | CB-33 | 0.05 | 0.02 | 0.06 |

Similar to the results shown in Table 2 in Example 1, the results shown in Table 3 reveals that each sample of the present invention is excellent in color reproducibility represented by color turbidity and desilvering properties. In addition, the comparison between the results shown in Table 3 and the results of Example 1 shown in Table 2 reveals that these properties are further improved by the development in this example.

As has been described above, according to the present invention, there is provided a silver halide color photographic light-sensitive material superior in sharpness, color reproducibility, and desilvering properties.

What is claimed is:

1. A silver halide color photographic light-sensitive material having at least one light-sensitive silver halide emulsion layer on a support and containing a pyrazoloazole-based coupler, wherein said silver halide color photographic light-sensitive material contains a compound represented by Formula (I) and/or Formula (IV) below:

$$A\text{-}(L_1)_j\text{-}(L_2)_m[(L_3)_n\text{-}PUG]_s \quad (I)$$

where A represents a coupler moiety or an oxidation-reduction group, each of $L_1$ and $L_3$ represents a divalent timing group, $L_2$ represents a timing group with a valency of 3 or more, PUG represents a photographically useful group, each of j and n independently represents 0, 1, or 2, m represents 1 or 2, and s represents a number which is obtained by subtracting 1 from a valence which is obtained by subtracting 1 from a valence number of $L_2$ and is an integer of hot less than 2, if a plurality of $L_1$'s, $L_2$'s, or $L_3$'s are present in the molecule, these $L_1$'s, $L_2$'s or $L_3$'s are the same or different, a plurality of PUGs are the same or different, and $L_2$ is not a timing group using electron transfer via a conjugated system;

(IV)

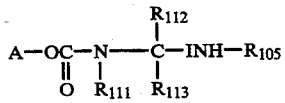

Formula (IV)

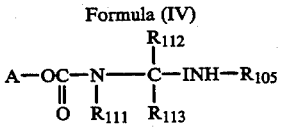

where A has the same meaning as in Formula (I), INH represents a group having a development inhibiting power, $R_{105}$ represents a nonsubstituted phenyl group, a non-substituted primary alkyl group, or a primary alkyl group substituted by a group except for an aryl group, and each of $R_{111}$, $R_{112}$, and $R_{113}$ represents a hydrogen atom or an organic moiety, and any two of $R_{111}$, $R_{112}$, and $R_{113}$ can be divalent groups and combine together to form a ring.

2. A material according to claim 1, wherein each of the formular weight of the residues which are obtained by removing two groups represented by A and PUG from the Formula (I) or (IV) respectively, is 64 to 240.

3. A material according to claim 1, containing a compound which reacts with an oxidized form of an aromatic primary amine-based developing agent to release a bleaching accelerator.

4. A material according to claim 2, containing a compound which reacts with an oxidized form of an aromatic primary amine-based developing agent to release a bleaching accelerator.

5. A material according to claim 1, containing a compound which cleaves after reacting with an oxidized form of an aromatic primary amine-based developing agent and reacts with another molecule of the oxidized form of the developing agent to cleave a development inhibitor.

6. A material according to claim 2, containing a compound which cleaves after reacting with an oxidized form of an aromatic primary amine-based developing agent and reacts with another molecule of the oxidized form of the developing agent to cleave a development inhibitor.

7. A material according to claim 3, containing a compound which cleaves after reacting with an oxidized form of an aromatic primary amine-based developing agent and reacts with another molecule of the oxidized form of the developing agent to cleave a development inhibitor.

8. A material according to claim 4, containing a compound which cleaves after reacting with an oxidized form of an aromatic primary amine-based developing agent and reacts with another molecule of the oxidized form of the developing agent to cleave a development inhibitor.

9. A material according to claim 1, wherein the compound represented by Formula (I) is a compound represented by the following Formula (Ia):

Formula (Ia)

$$A\text{-}L_1\text{-}N\text{-}(Z_3\text{-}PUG)_2$$

where A, $L_1$, and PUG have the same meanings as in Formula (I), and $Z_3$'s represent substituted or non-substituted methylene groups and may be the same or different, two $Z_3$'s being able to combine together to form a ring.

10. A material according to claim 1, wherein each of the formular weight of the residues which are obtained by removing two groups represented by A and PUG from the Formula (I) or (IV) respectively, is 70 to 200.

11. A material according to claim 1, wherein each of the formular weight of the residues which are obtained by removing two groups represented by A and PUG from the Formula (I) or (IV) respectively, is 90 to 180.

12. A method of processing a silver halide color photographic light-sensitive material of claim 1, said method comprising the steps of subjecting the material to imagewise light-exposure, and treating the light-exposed material with a color-developing solution containing 4-amino-3-methyl-N-ethyl-N-(4-hydroxybutyl-)aniline.

* * * * *